US007540701B2

(12) United States Patent
Maehara et al.

(10) Patent No.: US 7,540,701 B2
(45) Date of Patent: Jun. 2, 2009

(54) CARGO TRANSPORTATION BOX BODY WITH CARGO HANDLING DEVICE

(75) Inventors: Yuuji Maehara, Souka (JP); Takayuki Omata, Niihari-gun (JP); Yuuya Suzuki, Niihari-gun (JP); Atsushi Tadokoro, Niihari-gun (JP); Kenshou Fujita, Niihari-gun (JP); Junya Horiuchi, Koshigaya (JP); Yasunori Kyousou, Higashi-ibaraki-gun (JP); Eiichi Muramoto, Niihari-gun (JP); Tomohiko Hoshi, Niihari-gun (JP); Kunio Kojima, Taito-ku (JP)

(73) Assignees: Hitachi Construction Machinery Co., Ltd., Tokyo (JP); Kouji Shokai Co., Ltd., Tokyo (JP)

( * ) Notice: Subject to any disclaimer, the term of this patent is extended or adjusted under 35 U.S.C. 154(b) by 473 days.

(21) Appl. No.: 10/531,084

(22) PCT Filed: Oct. 27, 2003

(86) PCT No.: PCT/JP03/13701

§ 371 (c)(1),
(2), (4) Date: Apr. 7, 2005

(87) PCT Pub. No.: WO2004/039704

PCT Pub. Date: May 13, 2004

(65) Prior Publication Data

US 2006/0182574 A1 Aug. 17, 2006

(30) Foreign Application Priority Data

| | | |
|---|---|---|
| Oct. 29, 2002 | (JP) | 2002-314455 |
| Oct. 29, 2002 | (JP) | 2002-314456 |
| Oct. 29, 2002 | (JP) | 2002-314457 |
| Oct. 29, 2002 | (JP) | 2002-314458 |
| May 19, 2003 | (JP) | 2003-140860 |
| May 19, 2003 | (JP) | 2003-140861 |

(51) Int. Cl.
*B60P 1/00* (2006.01)

(52) U.S. Cl. ..... 414/510

(58) Field of Classification Search ..... 414/509–511, 414/514–517, 521, 525.6, 679; 198/717, 198/721, 736

See application file for complete search history.

(56) References Cited

U.S. PATENT DOCUMENTS 3,422,973 A * 1/1969 Longman ..... 414/508

(Continued)

FOREIGN PATENT DOCUMENTS

JP 60012350 A * 1/1985

(Continued)

*Primary Examiner*—Saúl J Rodríguez
*Assistant Examiner*—Joshua I Rudawitz
(74) *Attorney, Agent, or Firm*—William L. Androlia; H. Henry Koda

(57) ABSTRACT

A cargo transporting box body with a cargo-handling device for cargo unloading or loading, the box body having on its bottom a floor board movable, and a movable partition wall on the floor board such that, when the movable partition wall is latched, only the floor board is movable, and when allowed to move, the movable partition wall moves in association with the floor board. A sprocket is attached around an axis at the base of the movable partition wall and driven by a reversible motor. A first chain has one end fixed to the posterior end of the of the box body and the other end to the anterior end; while a second chain has one end fixed to the posterior end of the box body and the other side the anterior end, and the first and second chains cross with each other at their mid-portions and engage with the sprocket.

6 Claims, 39 Drawing Sheets

U.S. PATENT DOCUMENTS

| | | | | | |
|---|---|---|---|---|---|
| 3,831,789 | A | * | 8/1974 | Brewer | 414/509 |
| 3,901,394 | A | * | 8/1975 | Bowles | 414/511 |
| 3,998,343 | A | * | 12/1976 | Fors | 414/501 |
| 4,082,196 | A | * | 4/1978 | Lutz et al. | 414/521 |
| 4,249,843 | A | * | 2/1981 | Kerr | 414/789.7 |
| 4,877,366 | A | * | 10/1989 | De Filippi | 414/517 |
| 5,009,564 | A | * | 4/1991 | Lutz et al. | 414/510 |
| 5,143,508 | A | * | 9/1992 | Lutz et al. | 414/510 |
| 5,314,290 | A | * | 5/1994 | Lutz et al. | 414/509 |
| 6,632,066 | B1 | * | 10/2003 | Kojima | 414/510 |

FOREIGN PATENT DOCUMENTS

| | | | | |
|---|---|---|---|---|
| JP | 01285516 | A | * | 11/1989 |
| JP | 01285595 | A | * | 11/1989 |
| JP | 02047408 | A | * | 2/1990 |
| JP | 05270664 | A | * | 10/1993 |
| JP | 2000335749 | A | * | 12/2000 |
| JP | 2000355426 | A | * | 12/2000 |
| JP | 2001072251 | A | * | 3/2001 |
| JP | 2002114290 | A | * | 4/2002 |
| JP | 2003063298 | A | * | 3/2003 |

* cited by examiner

CARGO TRANSPORTATION BOX BODY WITH CARGO HANDLING DEVICE

TECHNICAL FIELD

The present invention relates to a cargo transportation box body with a cargo-handling device permitting the mechanized loading and/or unloading of multiple loads which have been packed densely in the box body haphazardly with no pallets being inserted therebetween, without requiring the serious modifications of the body box represented by a container or the cargo bed of a truck, nor the implementation of a large cargo handling device within or without the body box, thereby dispensing with the need for manual cargo handling which is often burdensome, and thus permitting even a mature or senior worker to handle heavy cargo safely and the improved efficiency of cargo handling.

Background Art

Recently, the container-based cargo transportation has been increasingly utilized with a view to reduce the cost involved in transportation and packaging, and the period required for transportation, and to prevent damages inflicted onto cargo during transportation. However, since the container has a box-like shape, and usually has an access port on one terminal end, a crane can not be used for unloading cargo packed in the container. In addition, in the container, multiple loads are densely packed haphazardly with no pallets inserted therebetween with an intention to prevent the collapse of packed loads during transportation and to maintain the high loading efficiency. Consequently, although the transference or transportation of cargo from one place to another may be achieved by a conveyor or fork-lift, loading or unloading of cargo into or out of a container has largely been achieved manually by human workers.

The unloading of cargo from a container is to transfer loads packed in the container to a place outside the container. Some of the loads exist as loose articles represented by chips which require human handling for transportation. Handling of such loose articles is burdensome and should be avoided on account of its possible adverse effect on the worker's safety. Particularly, with the recent increase of the average age of workers engaged in cargo handling, there is a demand for a cargo-handling device which will be able to relieve senior porters of heavy burdens involved in cargo handling which may cause them back pain unless properly addressed. Conventionally, the crane has been used as a means for relieving the burden involved in cargo handling, but the use of a crane has never been tried for handling cargo packed in a container, because installment of a crane besides the container is cumbersome and cargo handling based on the use of a crane is low in speed.

The present inventors submitted a patent application (Japanese Patent Application No. 2000-307713) relating to a container with a cargo-handling device which can be used for loading or unloading cargo into or out of the container.

According to this invention, as shown in FIG. 38, a box body 10 or the enclosure of a container contains a movable partition 12 which can move forward and backward along a longitudinal axis to serve as a cargo handling mechanism, and, when necessary in addition to the movable partition 12, a movable floor board 13 which can move forward and backward along a longitudinal axis, beneath the movable partition 12.

As seen from above, the container is equipped with a cargo-handling device which permits the mechanized handling of multiple loads including loose articles represented by chips densely packed haphazardly with no pallets inserted therebetween. The container includes a box body or an enclosure which contains a movable partition capable of moving in an antero-posterior direction to serve as a cargo-handling mechanism. When it is required to discharge cargo packed in the container, the movable partition moves the cargo including loose articles such as chips towards the access port to expel it out of the container. Conversely, when it is required to charge loads into the container, the movable partition carries the loads towards the anterior end of the container. Thus, according to this invention, it is possible to mechanically charge or discharge into or out of a container multiple loads densely packed haphazardly with no pallets inserted therebetween without requiring the installment of a big transportation machine besides the container.

Assume that it is required to discharge loads from a packed container. The loads,such as chips, are placed on the floor board 13 of the box body, and the floor board 13 is moved backward together with the loads until a rearmost heap of loads get out of the box body. At this stage, the rearmost heap of loads still lie on the floor board. Then, after fastening the movable partition wall to the box body for stoppage, the operator allows the floor board to be pulled forward while holding the rear end of the load, the load, now not being supported by the underlying floor board, will fall of itself.

Then, the operator relieves the fastening of the partition wall to the box body, and moves the floor board carrying the loads further backward until a next rearmost heap of loads get out of the box body. The operator repeats the same operation as above, to remove the load out of the container. This operation is repeated for one heap after another until the entire cargo in the container can be removed.

The antero-posterior movement of the movable partition wall may be achieved by way of a cylinder. The cylinder is not required to be big nor to move at a sizable stroke, because the movable partition wall is not used for pushing loads including loose articles such as chips. The partition wall may not be so strong and its fastening to the body box is not so rigid, as long as it can effectively achieve the function assigned to it.

Then, assume that it is required to charge loads into the container. The operation proceeds in a manner opposite to the above. The movable partition wall is located at the rearmost position. The operator puts a heap of loads including a loose article such as chips on the floor board placed within the box body, and allows the sliding floor board carrying the heap of loads to be moved forward (towards the anterior end of the container). At this stage the heap of loads lie on the floor board. Then, after fastening the partition wall to the box body for stoppage, the operator allows the floor board to be pushed backward while holding the rear end of the load. The operator then puts another heap of loads on the floor board, and, after relieving the fastening of the movable partition wall to the box body, the operator allows the floor board carrying the two heaps-of loads to be pulled forward. This operation is repeated for one heap after another until the container is charged to the full.

As described above, the cargo-handling device comprises a movable partition wall 12 which is movable in an antero-posterior direction to serve as a cargo handling mechanism, and a floor board 13 placed beneath the movable partition wall 12 to be also movable in an antero-posterior direction. The movable partition wall 12 has an associative moving means which permits the partition wall to move together with the floor board 13, and a movement arresting means which arrests the movement of the partition wall 12 while permitting only the movement of floor board 13. With this device, it is necessary to surely perform the two modes of operation alternately.

According to the invention specified in the previous application, the movable partition wall 12 contacts with the floor board 13 only through a base plate 12*a*. A multi-stage expandable cylinder or so-called telescopic cylinder 14 is provided between the movable partition wall 12 and the box body 10, so that the partition wall 12 can move in an antero-posterior direction with the extension or contraction of the telescopic cylinder 14.

Another cylinder 15 which is also movable in an antero-posterior direction is provided between the floor board 13 and the box body 10, so that the floor board 13 can move in an antero-posterior direction with the extension or contraction of the cylinder 15.

Assume that at a first stage the floor board 13 is moved by way of the cylinder 15 towards the access port 11 (backward). Then, a heap of loads on the floor board 13 will also move towards the access port 11. The telescopic cylinder 14 is extended to allow the movable partition wall 12 to move also towards the access port 11 (backward) in synchrony with the movement of the floor board 13.

Next, at a second stage, the telescopic cylinder 14 is arrested to immobilize the movable partition wall 12, thereby also halting the heap of loads at the moment. Then, only the floor board 13 is pulled apart from the access port (forward) by way of the cylinder 15. Each time the first and second steps of operations are performed in succession, the movable partition wall 12 and loads posterior to it move step by step towards the access port 11 to be expelled from the access port 11 out of the container.

As a fastening means 16 for fastening the movable partition wall 12 to the box body 10, a securing mechanism comprising rows of stopper projections 17*a* arranged on the top edges (rack rails) of the lateral walls of box body 10 and swing or seesaw arches lock bar 17*b* provided at both ends of the top edge of movable partition wall 12 as shown in FIG. 39 may be provided in such a manner as to allow the swing arches to engage by tilting or swinging with a pair of stopper projections, instead of the telescopic cylinder 14.

However, if a telescopic cylinder 14 as described above is used, the device will become so large that it is hardly amenable to easy control. If a fastening means 16 as described above is employed, the movement of partition wall 12 will become discontinuous since it must be stopped at discrete positions defined by a pair of stopper projections 17*a*. Thus, it is hardly possible to stop the partition wall 12 at a desired position.

For the container to stably hold loads, each side of movable partition wall 12 should be vertical to and in parallel with the surface of the opposite lateral wall of body box 10 as well as with the bottom surface of body box 10. However, the movable partition wall 12 will easily swing laterally. If the movable partition wall 12 is swung laterally so much, and there is a load pressed against the wall, that load will be exposed to the risk of being distorted in its whole shape.

For the proper operation of the container with the cargo-handling device as described above, it is necessary to design a driving mechanism for driving the cylinder 15 to enable the floor board 13 to move in an antero-posterior direction. On the other hand, it has been thought that the container should have a structure as simple as possible to ease the work involved in cargo loading and unloading. Thus, usually the container has been an empty box. Therefore, if the driving mechanism must receive power from an electric power source or from a pressure source through a hydraulic tube, that power source must be installed outside the container.

For example, a trailer pulled by a truck may carry a mechanical power source which can drive the cylinder 15 via a hydraulic tube. Alternatively, a dynamo carried by a car or the like may be utilized as a power source for driving the cylinder 15. These schemes, however, will impose limitations upon the place where the loading or unloading of cargo into or out of the container should take place.

The floor board 13 may be made of steel or the like. The floor board preferably has a thickness as small as practically possible. If it is too small in thickness, however, it will readily bend in the presence of heavy loads. Particularly, beneath the movable partition wall 12, the floor board must bear the weigh of the movable partition wall 12 as well as the weight of loads, and if the loads are heavy, the floor board will undergo not only a downward bend but also upward bends in parallel with the downward bend which may cause the distortion or collapse of loads resting on those upward deflected portions.

According to the container with a cargo-handling device specified in the previous application, as is commonly observed with conventional containers, the container consists of a box body 10 having a single access port 11 at its rear end. Loading of cargo into the container takes place through the access port 11.

When a heap of loads other than loose articles are hauled into the container, it is usual to place them on a pallet and to haul them into the container using a fork lift. However, since the access port 11 has a limited area, the work is demanding because the height level to which a heap of loads should be hoisted needs to be adjusted anew each time a new heap of loads placed on a pallet is hauled into the container. When a heap of loose loads are hauled into the container, a power shovel or the like must be used, because loose loads would not stably rest on the pallet. It is more difficult to adjust the height of the shovel such that loads captured in the shovel can be hoisted up to an empty area left in the access port 11.

With the cargo-handling device of the previous invention, it is impossible to automatize the cargo loading. In cargo loading with the device as described above, before a heap of loads are put into the container, the movable partition wall 12 is moved forward in the body box 10 to make a space for accepting the heap, and this operation is repeated each time a new heap of loads are put into the container via the access port 11. The device helps the orderly sequential placement of heaps of loads one after another but hardly assists the forward thrust of those heaps.

A first object of the present invention is to provide a cargo transportation box body with a cargo-handling device for cargo unloading or loading, the box body having on its bottom a floor board movable via a cylinder in an antero-posterior direction, and a movable partition wall on the floor board such that, when the movable partition wall is latched, only the floor board is movable, and when allowed to-move, the movable partition wall moves in association with the floor board, wherein whether the movable partition wall should be moved synchronously with the floor board or with a divergence relative to the latter is securely selectable, and the movable partition wall maintains a stabilized condition, being safely prevented against lateral swinging fluctuations.

A second object of the present invention is to provide a cargo transportation box body with a cargo-handling device permitting the mechanized loading and/or unloading of multiple loads which have been packed densely in the box body haphazardly with no pallets being inserted therebetween, dispensing with the need for manual cargo handling which is often burdensome, and thus permitting even a mature or senior worker to handle heavy cargo safely and the improved efficiency of cargo handling, and further permitting the cargo-handling to be performed at any desired place without being imposed by limitations due to the attributes of the place, and without losing the transportation convenience inherent to the container-based transportation.

A third object of the present invention is to provide a cargo transportation box body with a cargo-handling device which is so constructed as to prevent the floor board, even in the presence of heavy pressure, from being bent. A fourth object of the present invention is to provide a cargo transportation box body such as a container with a cargo-handling device permitting the mechanized loading and/or unloading of cargo without requiring the serious modifications of the container, nor the implementation of a large cargo handling device within or without the container, thereby dispensing with the need for manual cargo handling which is often burdensome, and thus permitting even a mature or senior worker to handle heavy cargo safely and the improved efficiency of cargo handling, and enabling easy cargo loading as well as unloading.

Disclosure of the Invention

To achieve the above objects, a first aspect of the invention relates to a cargo transportation box body such as a container or the cargo bed of a truck with a cargo-handling device for cargo unloading or loading, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floor board, wherein a sprocket with projections on its periphery is attached around an axis at the base of the movable partition wall to be rotatable round the axis driven by a reversible motor, a first chain comprising a series of rings has one end fixed to the left (or right) posterior end of the box body and the other end to the right (or left) anterior end of the same body while a second chain comprising a series of rings has one end fixed to the right (or left) posterior end of the box body and the other side to the left (or right) anterior end of the same body, and the first and second chains cross with each other at their mid-portions where resides the sprocket such that the holes of the rings constituting the first and second chains engage with the projections of the sprocket.

According to the first aspect of the invention, unloading of cargo including loose loads such as chips laid on the floor board of a box body such as a container occurs by alternately repeating a cargo-shifting step comprising shifting the floor board together with the overlying cargo and a movable partition wall towards an access port, and a cargo-halting step comprising retreating only the floor board by latching the movable partition wall, thereby prohibiting the retreat of the cargo. Thus, the position of the movable partition wall and cargo relative to the floor board is altered step by step each time the two steps are performed sequentially, such that heaps of loads are brought one after another to the access port to be hauled out.

When the floor board shifts together with the movable partition wall and cargo, the partition wall moves simultaneously with the floor board. This may be achieved by rotating a sprocket using a motor, thereby forcing a chain cross to move in an antero-posterior direction so that the partition wall moves at the same speed as does the floor board.

First and second chains are extended to cross with each other at a mid-point in the box body where the movable partition wall resides such that the movable partition wall, being surrounded by the crossing chains (between the two parallel running chains close to the cross-point) are prevented from being swung laterally, to maintain a stabilized condition.

When a rotation arresting mechanism is activated to arrest the rotation of the sprocket, movement of the chains and their displacement at the cross-point are eliminated since the chains engage with the sprocket. The movable partition wall is now latched, and the cargo-shifting step transfers to the cargo-halting step.

A second aspect of the invention relates to a cargo transportation box body with a cargo-handling device wherein the motor also serves as a braking mechanism for arresting the rotation of the sprocket when inactivated.

According to the second aspect of the invention, the motor not only exerts effects as described in the first aspect, but also serves as a rotation arresting mechanism for arresting the rotation of the sprocket when inactivated. This dispenses with the need for the introduction of a rotation arresting mechanism dedicated for the purpose. Namely, inactivation of the motor not only stops the rotation of the sprocket but also immobilizes the sprocket, thereby halting the movable partition wall.

A third aspect of the invention relates to a cargo transportation box body such as a container or the cargo bed of a truck with a cargo-handling device for cargo unloading or loading, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floor board, wherein first and second rotary bodies are attached at a low level on the sides of the movable partition wall one on each side, and third and fourth rotary bodies are similarly attached on the sides of the movable partition wall such that the first and third rotary bodies come into proximity on one side while the second and fourth rotary bodies come into proximity on the other side, the mid portion of a first chain comprising a series of rings is wound round the first and fourth rotary bodies while the mid portion of a second chain comprising a series of rings is wound round the second and third rotary bodies such that the two chains are stretched between the respective two rotary bodies, and the first and second chains are stretched between the first and fourth rotary bodies and the second and third rotary bodies with a sprocket at the center which is rotatable round an axis, can be stopped via a rotation arresting mechanism attached to the axis, and has on its periphery projections to engage with the holes of the rings of the chain wherein one set comprising the first chain engaging with the first and fourth rotary bodies and the other set comprising the second chain engaging with the second and third rotary bodies form a stack with respect to the sprocket with the rotation arresting mechanism attached thereto such that, when one set-combines with the sprocket, the movable partition wall is fastened to the box body and when the other set combines with the sprocket, the movable partition wall is fastened to the floor board or vice versa.

According to the third aspect of the invention, unloading of cargo including loose loads such as chips laid on the floor board of a box body such as a container occurs by alternately repeating a cargo-shifting step comprising shifting the floor board together with the overlying cargo and a movable partition wall towards an access port, and a cargo-halting step comprising retreating only the floor board by latching the movable partition wall, thereby prohibiting the retreat of the cargo. Thus, the position of the movable partition wall and cargo relative to the floor board is altered step by step each time the two steps are performed sequentially, such that heaps of loads are brought one after another to the access port to be hauled out.

First and second chains are extended to intersect in the form of a so-called "cross" at a central point in the box body where the movable partition wall resides such that the movable partition wall, being surrounded by the crossing chains (between the two parallel running chains close to the cross-point) are prevented from being swung laterally, to maintain a stabilized condition. The crossing point displaces in association with the movement of the movable partition wall (when the partition wall moves in association with the floor board). During the movement of the movable partition wall, the sprocket rotates freely and does not interfere with the displacement of the crossing point.

When a rotation arresting mechanism is activated to arrest the rotation of the sprocket, movement of the chains and their displacement at the cross-point are eliminated since the chains engage with the sprocket. The movable partition wall is now latched, and the cargo-shifting step transfers to the cargo-halting step.

One set comprising the first chain engaging with the first and fourth rotary bodies and the other set comprising the second chain engaging with the second and third rotary bodies form a stack with respect to the sprocket. The rotation arresting mechanism is attached to the sprocket to allow the operator to choose as desired either of the two options: to fasten the movable partition wall to the box body by combining the former (or latter) set with the sprocket, or to fasten the movable partition wall to the floor bed by combining the latter (or former) set with the sprocket.

A fourth aspect of the invention relates to a cargo transportation box body with a cargo-handling device wherein the stretch of each of the first and second chains from the fixed terminal end to the initially encountered rotary body is housed in a groove with a laterally opened slit provided over the floor board along a basal lengthwise corner of the box body.

According to the fourth aspect of the invention, the chains can be extended over the floor board not to disturb the cargo-handling.

A fifth aspect of the invention relates to a cargo transportation box body with a cargo-handling device wherein the groove has its laterally opened slit closed with a hanging flexible plate body.

According to the fifth aspect of the invention, it is possible to prevent the entry of loads into the groove since the laterally opened slit of the groove is closed by a hanging flexible plate body.

A sixth aspect of the invention relates to a cargo transportation box body with a cargo-handling device which is a container.

According to the sixth aspect of the invention, it is possible to enhance the advantages inherent to the container-based cargo transportation such as reduced cost involved in transportation and packaging, reduced period for transportation, and less damages of cargo during transportation.

A seventh aspect of the invention relates to a cargo transportation box body such as a container or the cargo bed of a truck with a cargo-handling device for cargo unloading or loading, the box body having on its bottom a floor board movable via a cylinder in an antero-posterior direction, a movable partition wall on the floor board such that, when the movable partition wall is latched, only the floor board is movable, and when allowed to move, the movable partition wall moves in association with the floor board, and a hydraulic control system for driving the cylinder at an anterior position in the box body.

According to the seventh aspect of the invention, unloading of cargo including loose loads such as chips laid on the floor board of a box body such as a container or the cargo bed of a truck occurs by alternately repeating a cargo-shifting step comprising shifting the floor board together with the overlying cargo and a movable partition wall towards an access port, and a cargo-halting step comprising retreating only the floor board by latching the movable partition wall, thereby prohibiting the retreat of the cargo. Thus, the position of the movable partition wall and cargo relative to the floor board is altered step by step each time the two steps are performed sequentially, such that heaps of loads are brought one after another to the access port to be hauled out.

The antero-posterior movement of the floor board is achieved by way of a cylinder which is activated by a hydraulic control system installed at an anterior position in the box body, and does not require any additional driving power source.

An eighth aspect of the invention relates to a cargo transportation box body with a cargo-handling device wherein the hydraulic control system comprises a pump, a work oil tank, an engine for driving the pump, and a fuel supply tank According to the eighth aspect of the invention, the hydraulic control system comprises a pump, a work oil tank, an engine for driving the pump, and a fuel supply tank. With a container equipped with such a system, the operator can basically manage the handling of cargo without requiring any additional equipment.

A ninth aspect of the invention relates to a cargo transportation box body with a cargo-handling device wherein a rail is provided lengthwise on the floor board, the movable partition wall is mounted on the rail to move on the rail, a unilateral braking mechanism using a cam is provided on one side of the movable partition wall so that the cam can engage with the rail.

According to the ninth aspect of the invention, the movable partition wall maintains a stabilized condition even when violently pressed by heavy loads, and smoothly moves synchronously with the floor board by virtue of the unilateral braking mechanism. In order to latch the movable partition wall and move only the floor board, the unilateral braking mechanism may be inactivated. When the movable partition wall alters its position relative to the floor board, it performs this by running on the rail which ensures a stable shift free from sideward fluctuations.

A tenth aspect of the invention relates to a cargo transportation box body with a cargo-handling device wherein cylinder units are provided at anterior and posterior positions on the floor board, and when activated, the cylinder units move the floor board in the same direction.

According to the tenth aspect of the invention, unloading of cargo including loose loads such as chips laid on the floor board of a box body such as a container occurs by alternately repeating a cargo-shifting step comprising shifting the floor board together with the overlying cargo and a movable partition wall towards an access port, and a cargo-halting step comprising retreating only the floor board by latching the movable partition wall, thereby prohibiting the retreat of the cargo. Thus, the position of the movable partition wall and cargo relative to the floor board is altered step by step each time the two steps are performed sequentially, such that heaps of loads are brought one after another to the access port to be hauled out.

Since the floor board is pulled in the same direction by means of cylinder units arranged at the anterior and posterior positions of the floor board, such that only pulling forces are applied to the floor board while the application of pushing forces thereto is eliminated, the floor board does not undergo any bending or distortion during its movement, and can effectively receive pulling forces transmitted by the cylinder units.

An eleventh aspect of the invention relates to a cargo transportation box body with a cargo-handling device wherein cylinder units are provided at anterior and posterior positions of the floor board, the anterior cylinder unit moves the floor board in a direction opposite to the one wrought by the posterior cylinder unit, and only the cylinder unit to pull the floor board is activated.

The advantage obtained from the eleventh aspect of the invention is essentially similar to the one obtained from the tenth aspect of the invention. The movement of the floorboard effected by the extension of the anterior cylinder unit is opposite in direction to the one effected by the extension of the posterior cylinder unit, and whenever the floorboard must be moved in a certain direction, the cylinder unit whose pull effects the movement of the floor board in that direction is selected for the work. This prevents the development of any bending on the floor board.

A twelfth aspect of the invention relates to a cargo transportation box body with a cargo-handling device for cargo unloading or loading provided in the box body or within the enclosure of a container, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floorboard, wherein the box body has an access port for cargo unloading with doors hinged thereon on its posterior end, and contains, in addition to the access port, a cargo loading opening on the roof or on a side wall thereof.

According to the twelfth aspect of the invention, the container is equipped with a cargo-handling device, and it is possible to mechanize the loading and/or unloading of multiple loads, such as chips, which have been packed densely in the box body haphazardly with no pallets being inserted therebetween. The container contains, within its enclosure, a movable partition wall to serve as a device for cargo unloading or loading. For cargo unloading, it is possible to shift cargo including loose loads such as chips towards the access port to expel the cargo out of the container by moving the partition wall. For cargo loading, it is possible to transfer cargo towards the anterior end of the container by using the movable partition wall. It is possible to mechanize the loading and/or unloading of multiple loads which have been packed densely in the container haphazardly with no pallets being inserted therebetween, without requiring the serious modifications of the container, nor the implementation of a large cargo handling device besides the container.

The box body contains, in addition to the access port with doors hinged thereon, a cargo-loading opening on the roof or on a side wall, which facilitates the anterior shift of loads hauled in the body box. If a cargo-loading opening is formed on the roof of the box body, charging of loads into the box body may occur through this cargo loading opening on the roof. Thus, for cargo loading, the operator can use a crane or shovel. If a cargo-loading opening is formed on a side wall, the opening may have a wide area. Then, for cargo loading, the operator can conveniently use a fork-lift or shovel.

A thirteenth aspect of the invention relates to a cargo transportation box body with a cargo-handling device wherein the cargo loading opening is formed at an anterior portion of the box body.

The thirteenth aspect of the invention ensures, in addition to the advantage given by the twelfth aspect of the invention, efficient cargo handling: since the cargo loading opening is formed at an anterior portion of the box body, heaps of loads can be put from the anterior opening into the box body one after another to be sent posteriorly, and they are taken out from the posterior end one after another in a first-come first-out manner.

A fourteenth aspect of the invention relates to a cargo transportation box body with a cargo-handling device for cargo unloading or loading provided in the box body or within the enclosure of a container, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floor board, wherein the box body has an access port for cargo unloading with doors hinged thereon on its posterior end, and contains, in addition to the access port, a cargo loading opening on the roof close to the access port.

The advantage given by the fourteenth aspect of the invention is essentially similar to that given by the aspect of the invention described in claim 12 as far as cargo unloading is concerned. For cargo loading, however, since it is possible to charge loads into the box body through the cargo loading opening formed on the roof, the operator can use a crane or shovel.

A fifteenth aspect of the invention relates to a cargo transportation box body with a cargo-handling device wherein upon the floor board laid is a flexible mat which extends, having one end fixed on the movable partition wall, beyond the posterior end of the floor board to support loads thereupon.

According to the fifteenth aspect of the invention, during cargo loading, the doors of the access port are closed to serve as a fence to limit the further backward shift of cargo, thereby facilitating the orderly packing of heaps of loads in an antero-posterior direction. Since loads are laid on the mat whose one end is fixed to the movable partition wall, they remain stationary as long as the movable partition wall is latched to be immobilized, even when the floor board is moved. Furthermore, since the mat is so flexible that its redundant portion extending from the posterior end of floor board hangs downward from that end and does not disturb the dropping of loads during cargo unloading.

A sixteenth aspect of the invention relates to a cargo transportation box body with a cargo-handling device for cargo unloading or loading provided in the box body or within the enclosure of a container, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floor board, wherein the box body has an access port for cargo unloading and loading on its posterior end having doors hinged thereon wherein a stopper is provided on its lower edge to intercept the retreat of loads once hauled in.

The advantage given by the sixteenth aspect of the invention is essentially similar to that given by the twelfth aspect of the invention as far as cargo unloading is concerned. For cargo loading, however, since it is possible to charge loads into the box body through the access port whose doors are opened, and thus to accomplish the orderly packing of cargo in an antero-posterior direction with the stopper serving as an intercept for limiting the backward movement of loads once hauled in.

A seventeenth aspect of the invention relates to a cargo transportation box body with a cargo-handling device for cargo unloading or loading provided in the box body, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floor board, wherein a groove with a laterally opened slit is provided along a basal lengthwise corner of the box body, a rack rail is housed in the groove, and a cam capable of unidirectional stoppage of the rack rail is attached to the movable partition wall.

According to the seventeenth aspect of the invention, the box body such as a container contains a cargo handling device which enables the mechanized loading and/or unloading of cargo including loose loads such as chips which have been packed densely in the container haphazardly with no pallets being inserted therebetween.

The box body further comprises a movable partition wall movable in an antero-posterior direction to serve as a cargo-handling device to be used during cargo-loading and unloading. During cargo unloading, the movable partition wall is moved towards the access port, thereby shifting cargo including loose loads such as chips until the cargo is expelled out of the box body. During cargo loading, the movable partition wall is used for transferring cargo towards the anterior end of the box body. Thus, it is possible to mechanize the loading and/or unloading of multiple loads which have been packed densely in the box body haphazardly with no pallets being inserted therebetween, without requiring the serious modifications of the box body, nor the implementation of a large cargo handling device besides the box body.

Heaps of loads including chips are laid on the floor board of the box body, and they move backward being carried by the floor board until a rearmost heap of loads come out of the box body. At this stage, that heap is sill on the floor board protruding outside the box body. Then, after fastening the movable partition wall to the box body, the operator allows the floor board to be pulled forward, while holding the rearmost end of the heap of loads in question. That heap of loads will fall now losing the underlying support.

Fastening of the movable partition wall to the box body is released, and the heaps of loads are allowed to move again backward together with the movable partition wall being carried by the floor board until a next rearmost heap of loads come out of the box body. These steps are performed sequentially, such that the heaps of loads are expelled one after another out of the box body to fall.

The antero-posterior movement of the floor board may be achieved by way of a cylinder. The cylinder is not required to be big nor to move at a sizable stroke, because the movable partition wall is not used for pushing loads including loose loads such as chips. The partition wall may not be so strong and its fastening to the body box is not so rigid, as long as it can effectively achieve the function assigned to it.

On the other hand, when the cargo-handling device is used for cargo loading, the operation proceeds in a manner opposite to the above process. The movable partition wall is located at the rearmost position. The operator puts a heap of loads including a loose load such as chips on the floor board placed within the box body, and allows the sliding floor board carrying the heap of loads to be moved forward (towards the anterior end of the container). At this stage the heap of loads lie on the floor board. Then, after fastening the partition wall to the box body for stoppage, the operator allows the floor board to be pushed backward while holding the rear end of the load. The operator then puts another heap of loads on the floor board, and, after relieving the fastening of the movable partition wall to the box body, the operator allows the floor board carrying the two heaps of loads to be pulled forward. This operation is repeated to allow heaps of loads to be shifted from back forward one after another in a sequential, orderly fashion.

Fastening or unfastening the movable partition wall to or from the box body can be easily achieved at any desired position in the box body by engaging or disengaging a cam with or from a rack rail. The engagement of the cam with the rack rail is so designed as to permit unidirectional movement of the rack rail.

Since the movable partition wall is fastened to the box body at its lower portion, it is safely protected against fluctuations and antero-posterior tilting.

When it is required to return the movable partition wall located close to the access port to a previous anterior position, the cam-rack rail engagement is reversed to allow the movable partition wall to move in the direction opposite to the previous one. Likewise, at a first stage, the movable partition wall is allowed to move together with loads and the floor board, and at a second stage, the cam is engaged with the rack rail to latch the movable partition wall, then only the floor board is allowed to move towards the access port (backward). The two stages are repeated to allow the movable partition wall to move towards the anterior end of the box body step by step.

An eighteenth aspect of the invention relates to a cargo transportation box body with a cargo-handling device wherein a flexible plate body is provided to cover the laterally opened slit of the groove.

According to the eighteenth aspect of the invention, since a flexible plate body covers the laterally opened slit of the groove which houses the rack rail, it is possible to prevent trash escaping from loads such as chips from entering the groove or being captured between the cam and the rack rail.

A nineteenth aspect of the invention relates to a cargo transportation box body with a cargo-handling device wherein, in addition to the rack rail housed in the groove provided on the box body, another rack rail is provided on the floor board, and, in correspondence with those rack rails, plural cams are provided on both sides of the movable partition wall.

According to the nineteenth aspect of the invention, since the movable partition wall can also be fastened to the floor board via additional cams and rack rails, it is possible to further ensure the synchronous movement of the movable partition wall with the floor board.

BEST MODE FOR CARRYING OUT THE INVENTION

Figure 1:
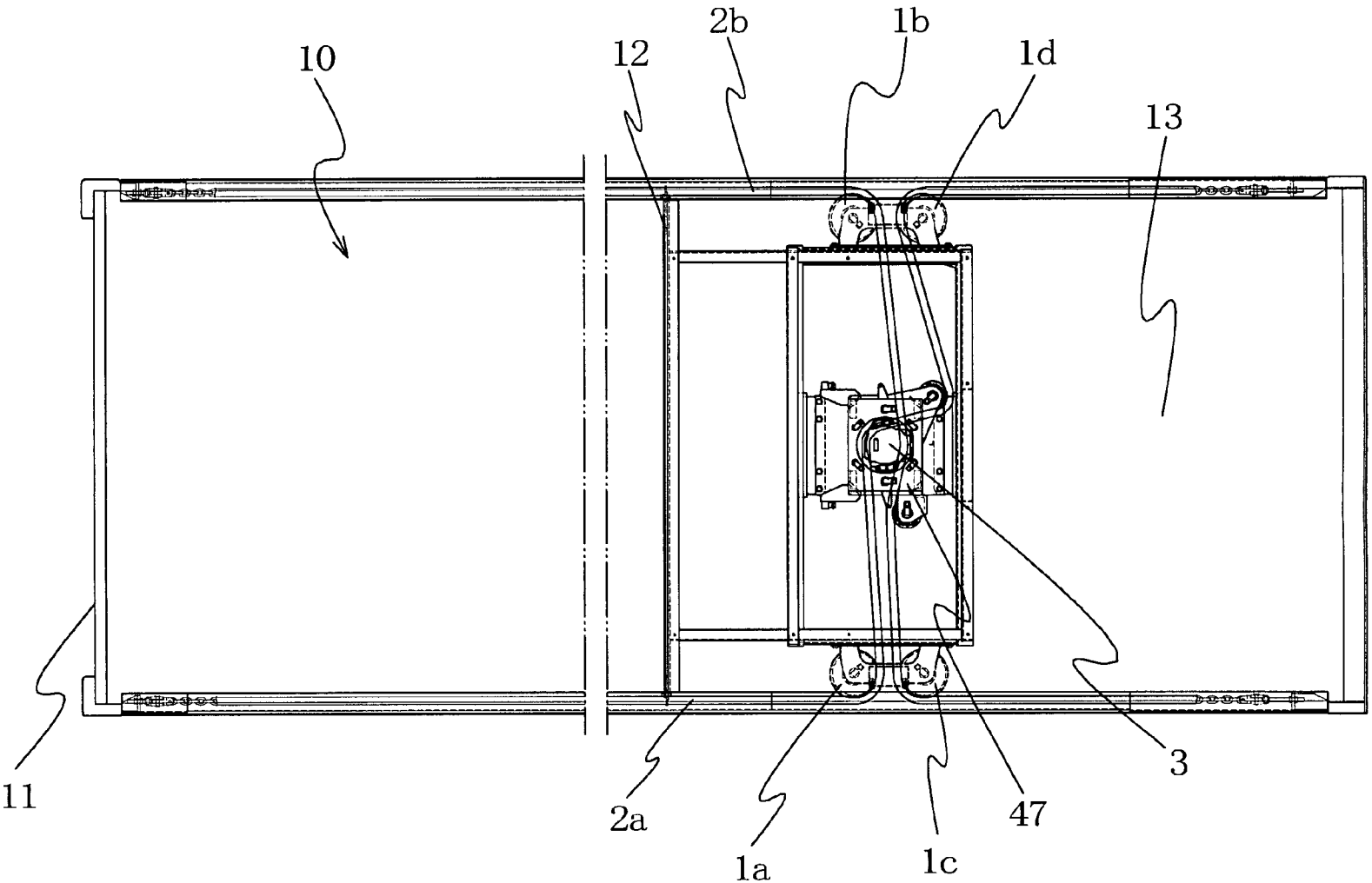
FIG. 1 is a crosswise sectional flat view of a cargo transportation box body with a cargo-handling device representing a first embodiment of the invention.
Figure 2:
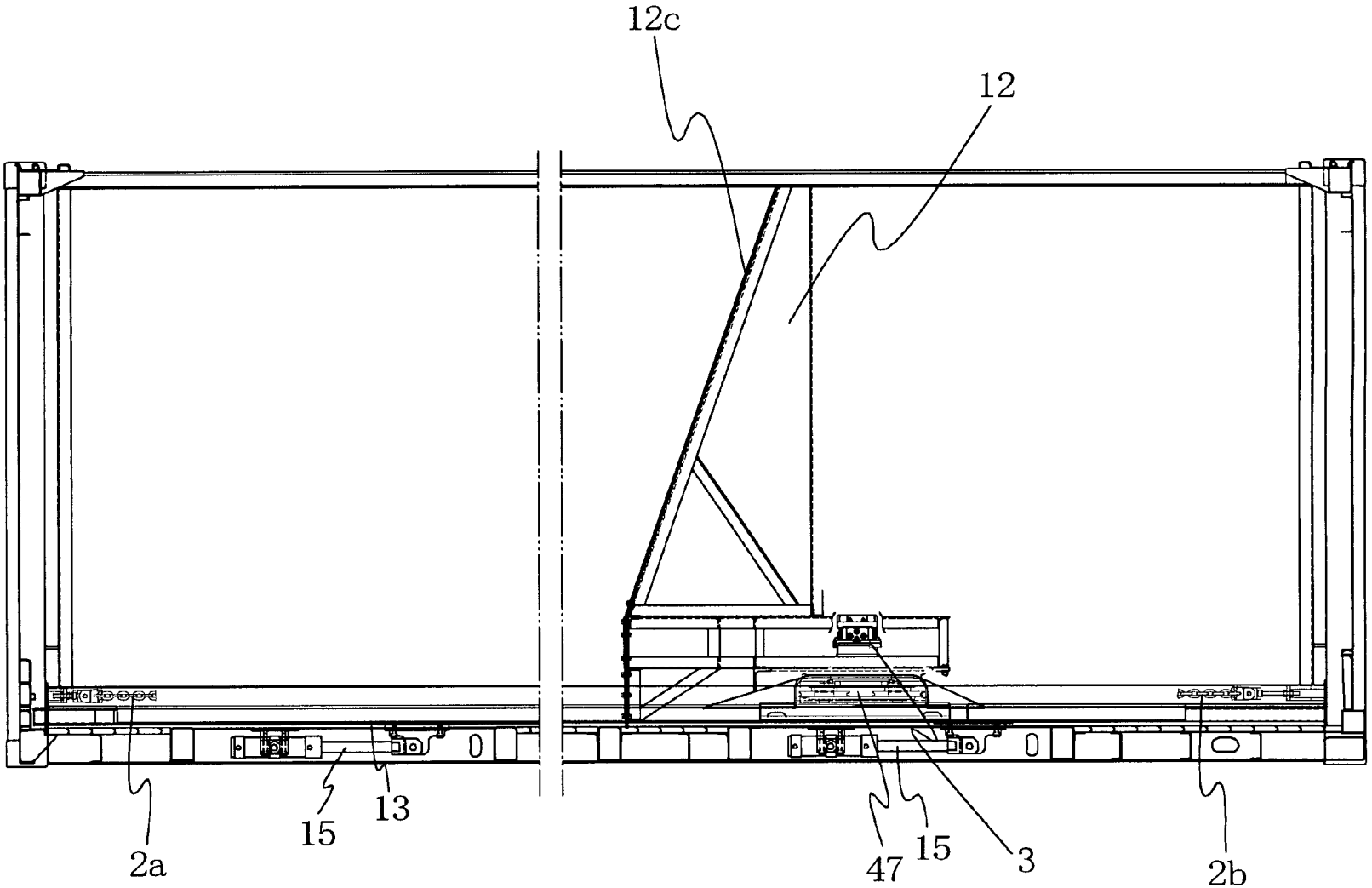
FIG. 2 is a lengthwise sectional front view of the cargo transportation box body with a cargo-handling device representing a first embodiment of the invention.

The embodiments of the present invention will be described in detail below with reference to the drawings. FIGS. 1 and 2 represent the crosswise sectional flat view and lengthwise sectional lateral view of a cargo transportation box body with a cargo-handling device, respectively, representing a first embodiment of the invention. In those figures, a box body 10 represents a container with an access port 11 at its rear end.

The inventive box body 10, like the previous one mentioned above, contains a movable partition wall 12 movable in an antero-posterior direction to serve as a cargo-handling device which assists the loading and unloading of cargo. The box body further contains a floor board (sliding plate) 13 movable in an antero-posterior direction beneath the movable partition wall 12.

The movable partition wall 12 is made of steel, and is in parallel with the plane defined by the access port 11, assumed that the box body 10 has a rectangular shape. The movable partition wall 12 has a sloping surface 12*c* with its lower end more protruding towards the access port 11. The floor board 13 is also made of steel or stainless steel, and may have a comparatively small thickness.

The movable partition wall 12 is placed above the floor board 13 with its lower end being in contact with the latter. A cylinder 15 movable back and forth is provided in a gap between the floor board 13 and the box body 10.

A first rotary body 1*a* (guide roller) and a second rotary body 1*b* are provided beneath the movable partition wall 12 apart from and opposite to each other in a width direction of the box body. A third rotary body 1*c* is provided close to the first rotary body 1*a* while a fourth rotary body 1*d* to the second rotary body 1*b*.

A first chain 2*a* is provided whose one end is fixed to the rear end of the box body 10 and other end to the front end of the same body, and whose mid portion is wound round the first and fourth rotary bodies 1*a*, 1*d* so as to-connect the rotary bodies through the chain.

A second chain 2*b* is provided whose one end is fixed to the rear end of the box body 10 and other end to the front end of the same body, and whose mid portion is wound round the second and third rotary bodies 1*b*, 1*d* so as to connect the rotary bodies through the chain.

The first chain 2*a* and the second chain 2*b* run parallel or nearly parallel and comparatively close to each other between the first and third rotary bodies 1*a*, 1*c* on one hand and the second and fourth rotary bodies 1*b*, 1*d* on the other.

Figure 4:
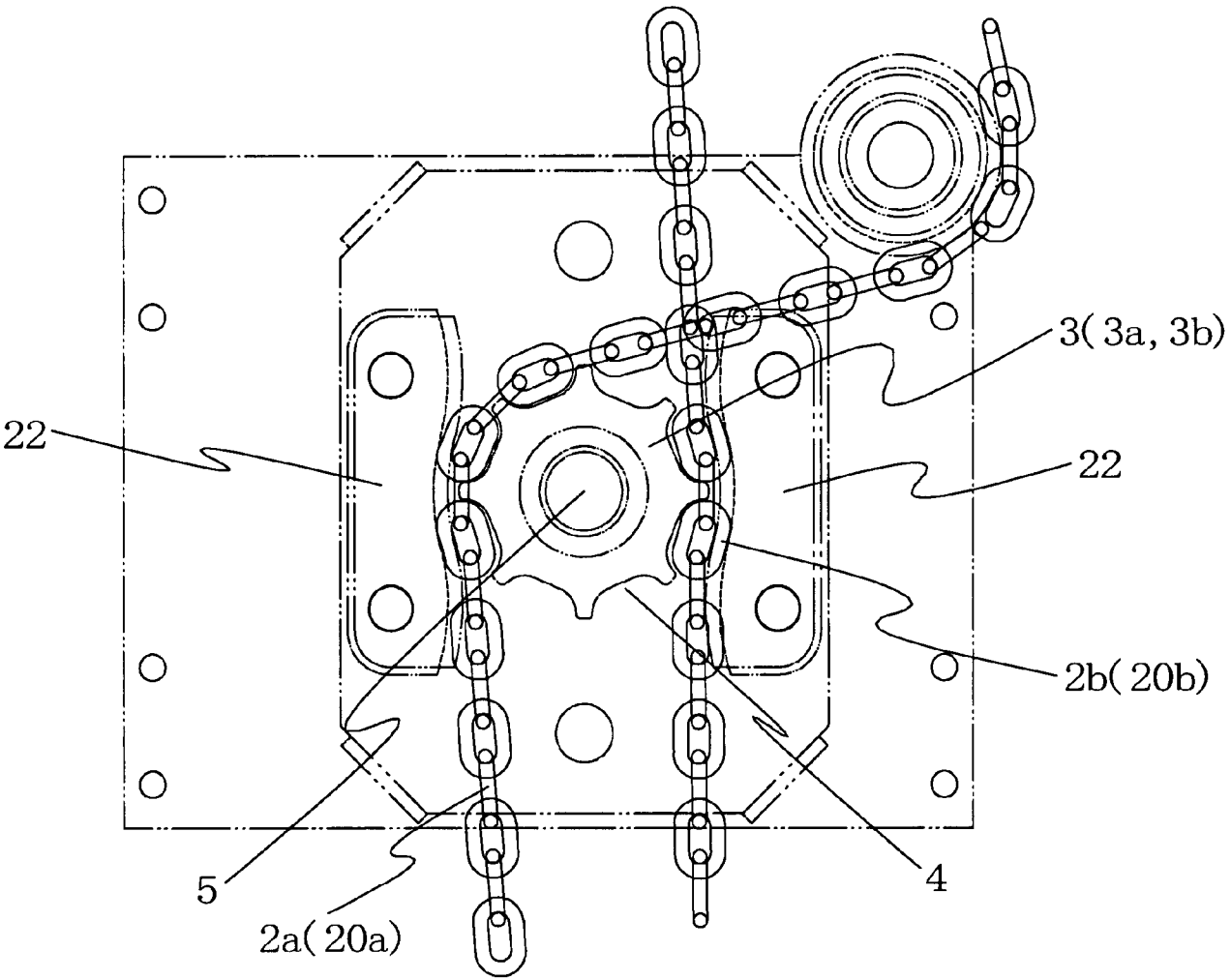
FIG. 4 is a flat view of a part of interest of the cargo transportation box body with a cargo-handling device representing a first embodiment of the invention.

A sprocket 3 is provided between the first chain 2*a* and the second chain 2*b* as shown in FIG. 4, the sprocket 3 having a series of recesses 4 at an appropriately chosen interval on its periphery each of which engages with one of the consecutive ring bodies constituting the chain. To ensure the engagement of the first and second chains 2*a*, 2*b* with the sprocket 3*a*, there are provided guides 22 that have a curved surface which is so shaped as to press the chains 2*a*, 2*b* against the sprocket 3. The guides 22 are placed in contact with the first and second chains 2*a*, 2*b*, and their surface in contact with the chain has a wavy profile in order that it may not disturb the smooth passage of the chain.

The sprocket 3 is attached to a rotational axis of a motor 47 which can rotate clockwise or counterclockwise. The motor 47 is so constructed as to serve as a brake for arresting the rotation of the sprocket 3 when it is stopped.

Alternatively, the movable partition wall 12 may be placed on the floor board 13 (sliding plate), and, when the above stopper mechanism is inactivated, the movable partition wall 12 may move together with the floor board 13 by way of friction.

Next, the use of the inventive box body will be explained. Assume that the inventive box body 10 or a container is brought by a truck being carried on its trailer to a cargo dock where loads packed in the box body 10 should be hauled out. The access port 11 is opened. The movable partition wall 12 is located at a forward position of box body 10.

When the cylinder 15 is allowed to extend, the floor board 13 moves towards the rear end of box body 10. At the same time, the motor 47 is activated to put the sprocket 3 into rotation. Then, in synchrony with the movement of floor board 13, the movable partition wall 12 also moves towards the rear end of box body 10. As a result, loads lying on the floor board 13 as well as the movable partition wall 12 move by the same distance.

At this stage, the mid portion of first chain 2*a* is wound round the first and fourth rotary bodies 1*a*, 1*d* to be stretched between the first rotary body 1*a* and the fourth rotary body 1*d* in parallel with the width of the movable partition wall 12. Likewise, the mid portion of second chain 2*b* is wound round the second and third rotary bodies 1*b*, 1*d*. Thus, the movable partition wall 12 which has the first and second chains 2*a*, 2*b* intersected crosswise on its front side and whose lateral edges are pulled forward or backward in box body 10 with the first and second rotary bodies 1*a*, 1*b* or the third and fourth rotary bodies 1*c*, 1*d* as pivots, is prevented from swinging to left and right, and can securely maintain a stabilized position.

It should be noted here that when the floor board 13 moves together with the movable partition wall 12 as described above, the movable partition wall 12 moves with the first and second chains 2*a*, 2*b* intersected on its front side while the first and second rotary bodies l*a*, 1*b* and the third and fourth rotary bodies 1*c*, 1*d* slide along the first and second chains 2*a*, 2*b*.

Next, let's consider the case where the cylinder 15 is allowed to contract, and the floor board 13 moves opposite to the previous direction. The motor 47 is inactivated to act as a braking mechanism which arrests the rotation of the sprocket 3. This leads, via the sprocket 3, to the arresting of the first and second chains 2*a*, 2*b*. As a reaction to this process the movable partition wall 12 is also arrested. Then, loads whose front sides contact with the movable partition wall 12 are prevented from moving and stay at the last-carried place, and only the floor board 13 moves forward to return to its original position.

This process can be summarized as follows: (1) Backward movement of floor board 13, and synchronous backward movement of movable partition wall 12 and loads; (2) Stoppage of movable partition wall 12; and (3) Forward movement only of floor board 13. This process is repeated to move the movable partition wall 12 together with the loads step by step to shift loads backward with respect to the floor board 13 so that loads are allowed to fall from the rear end of box body 10 sequentially in the order of their proximity to the rear end of boxy body 10.

When all the loads have been discharged from the container, the container should be arranged for a renewed fill or cargo loading. For this purpose, the movable partition wall 12 should be moved to a forward position of the floor board 13.

To achieve this, the motor 47 is activated to rotate in a direction opposite to the previous one, so that only the movable partition wall 12 can move forward to be ready for accepting a new fill.

Next, the alternative embodiment will be described where the movable partition wall 12 is placed on the floor board 13 (sliding plate), the arrested motor-based stopper mechanism is not employed, and the movable partition wall 12 moves together with the floor board 13 by way of friction.

According to this embodiment, the motor 47 is provided ahead the sprocket3-based stopper mechanism and the movable partition wall 12, and is used only when the unloading of cargo is required.

Figure 3:
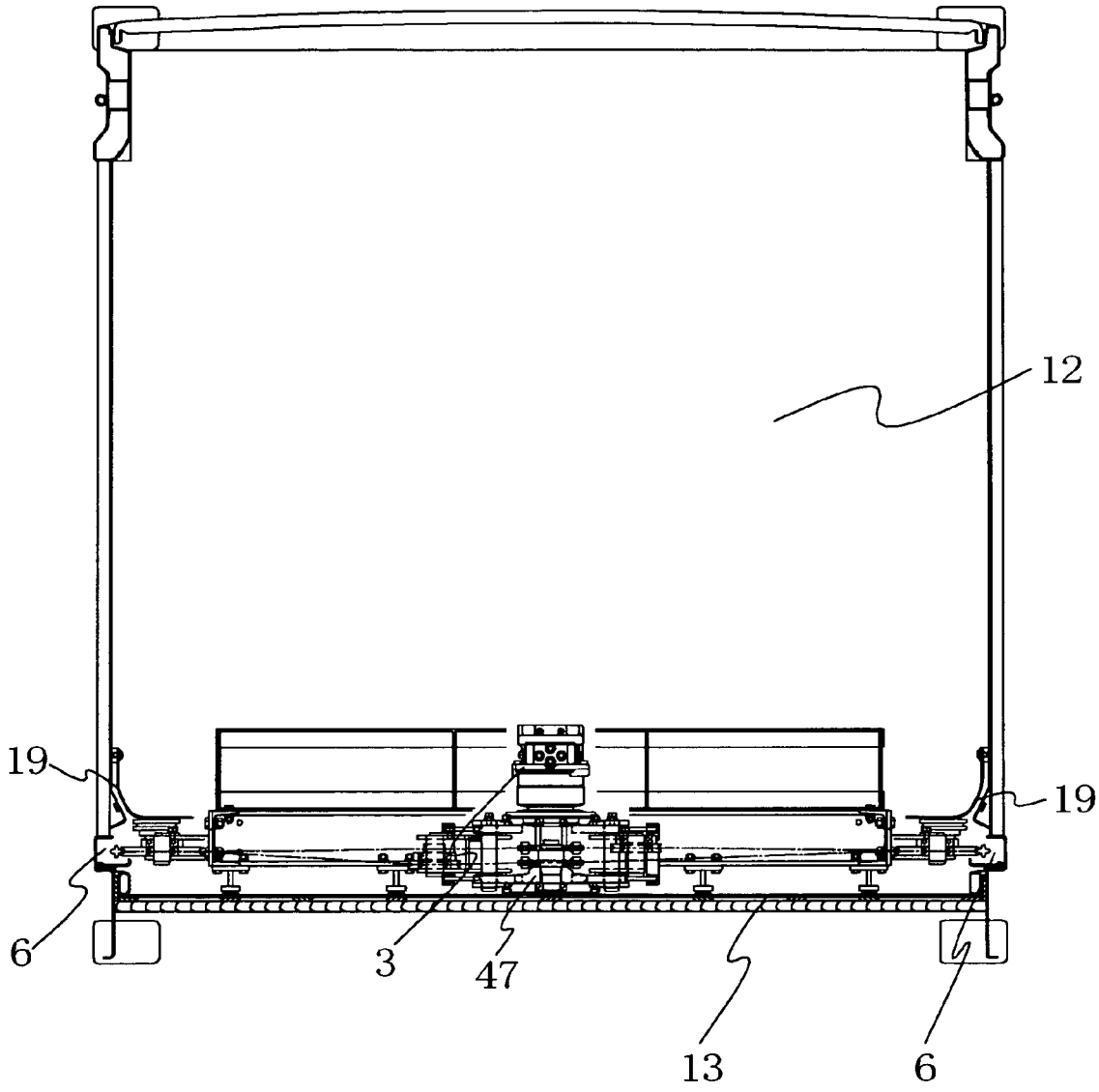
FIG. 3 is a crosswise sectional lateral view of the cargo transportation box body with a cargo-handling device representing a first embodiment of the invention.

Incidentally, as shown in FIG. 3, groove portions 6 having a slit facing laterally are provided along the basal lengthwise corners of the box body 10. The groove portions 6 receive the portions of first and second chains 1*a*, 1*b* which extend from the attachments of those chains to the box body 10 or to the floor board 13 to the contact points with the rotary bodies, 1*a*-1*d*.

This arrangement makes it possible for the first and second chains 1*a* and 1*b* not to disturb the movement of loads on the floor board 13.

If the slit of each groove portion 6 is closed with a hanging elastic plate-like body 19 such as a rubber plate or the like, it will be possible, even when a load contains sand or pebbles, or particles or grains of a certain material, to prevent the entry of such minute particles into the groove portion 6.

The first and second chains 1*a*, 1*b* after leaving the rotary bodies 1*a*-1*d* run crosswise over the floor board 13 before they enter into the respective groove portions 6. The entry, however, would be intercepted by the elastic plate-like bodies 19 unless properly treated. If the skirt of the elastic plate-like body 19 is raised to allow the entry of the chain into the groove, the elastic plate-like body 19 will not obstruct in any way the passage of the chain.

The above embodiment has been described with reference to the case where cargo is unloaded from the inventive body box. The embodiment can be similarly applied for cargo loading. The inventive cargo transportation box body is not limited to the container, but may represent as effectively, for example, the cargo bed of a truck.

Figure 5:
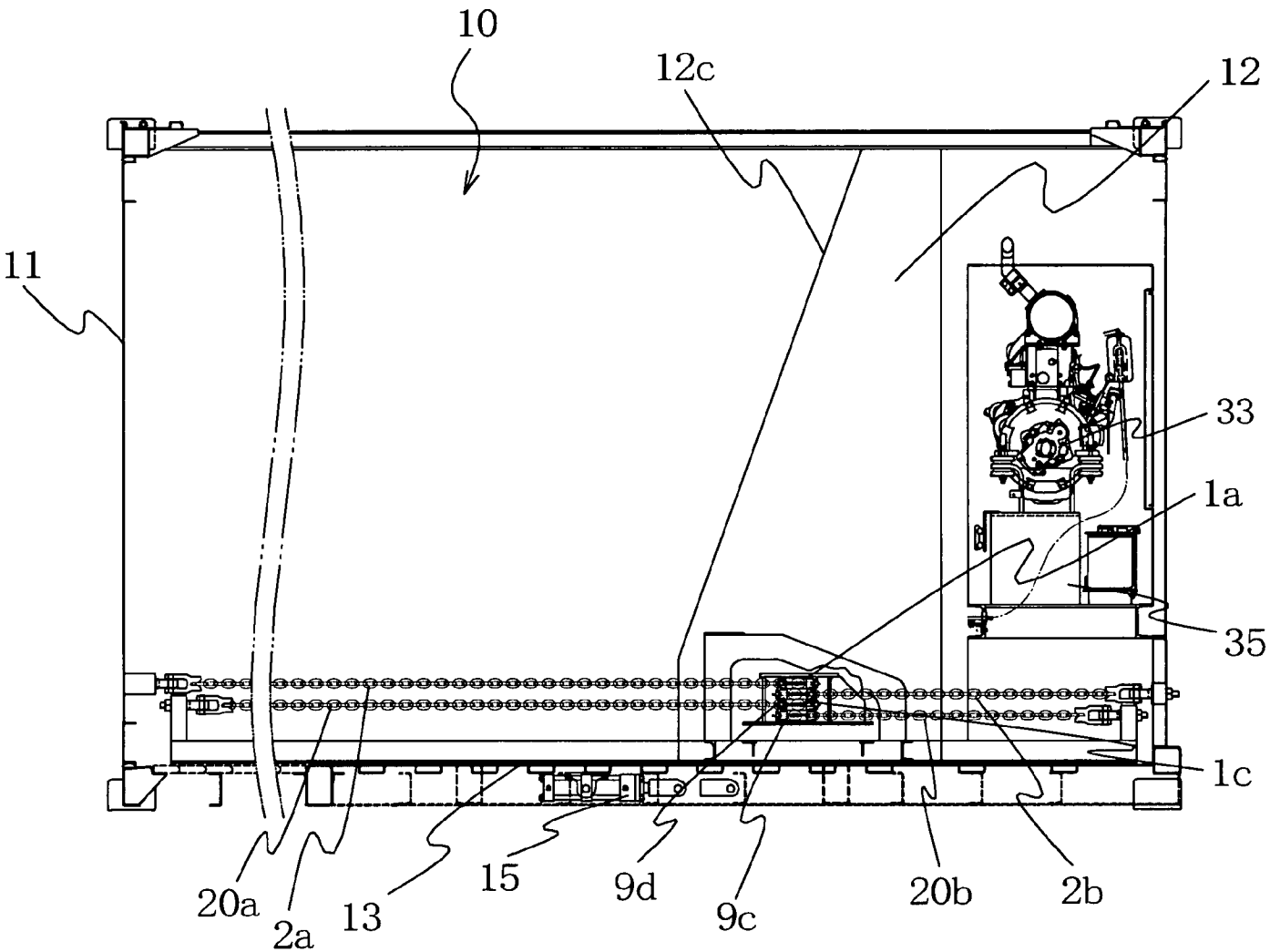
FIG. 5 is a lengthwise sectional lateral view of a cargo transportation box body with a cargo-handling device representing a second embodiment of the invention.
Figure 6:
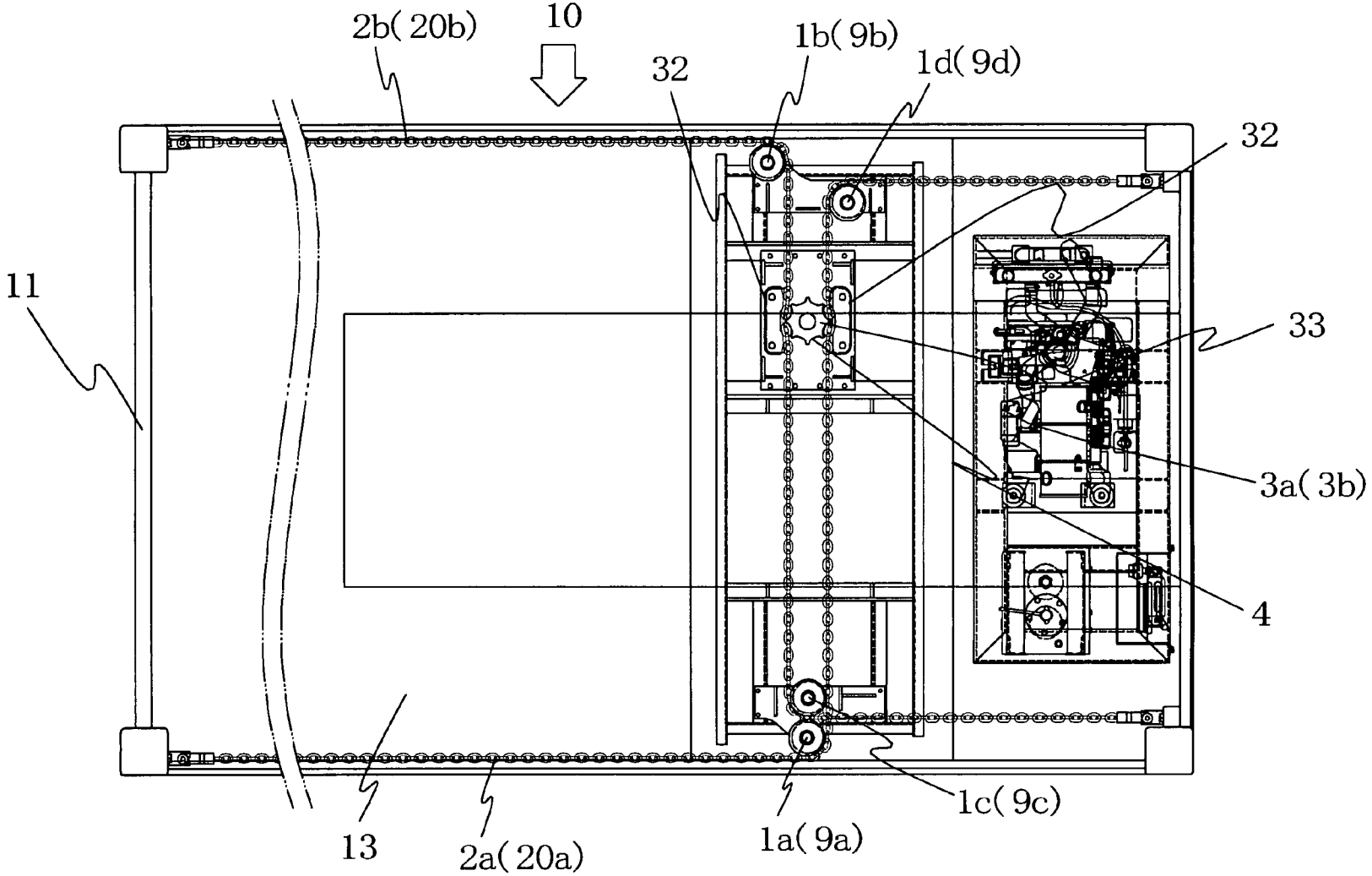
FIG. 6 is a crosswise sectional flat view of the cargo transportation box body with a cargo-handling device representing the second embodiment of the invention.
Figure 7:
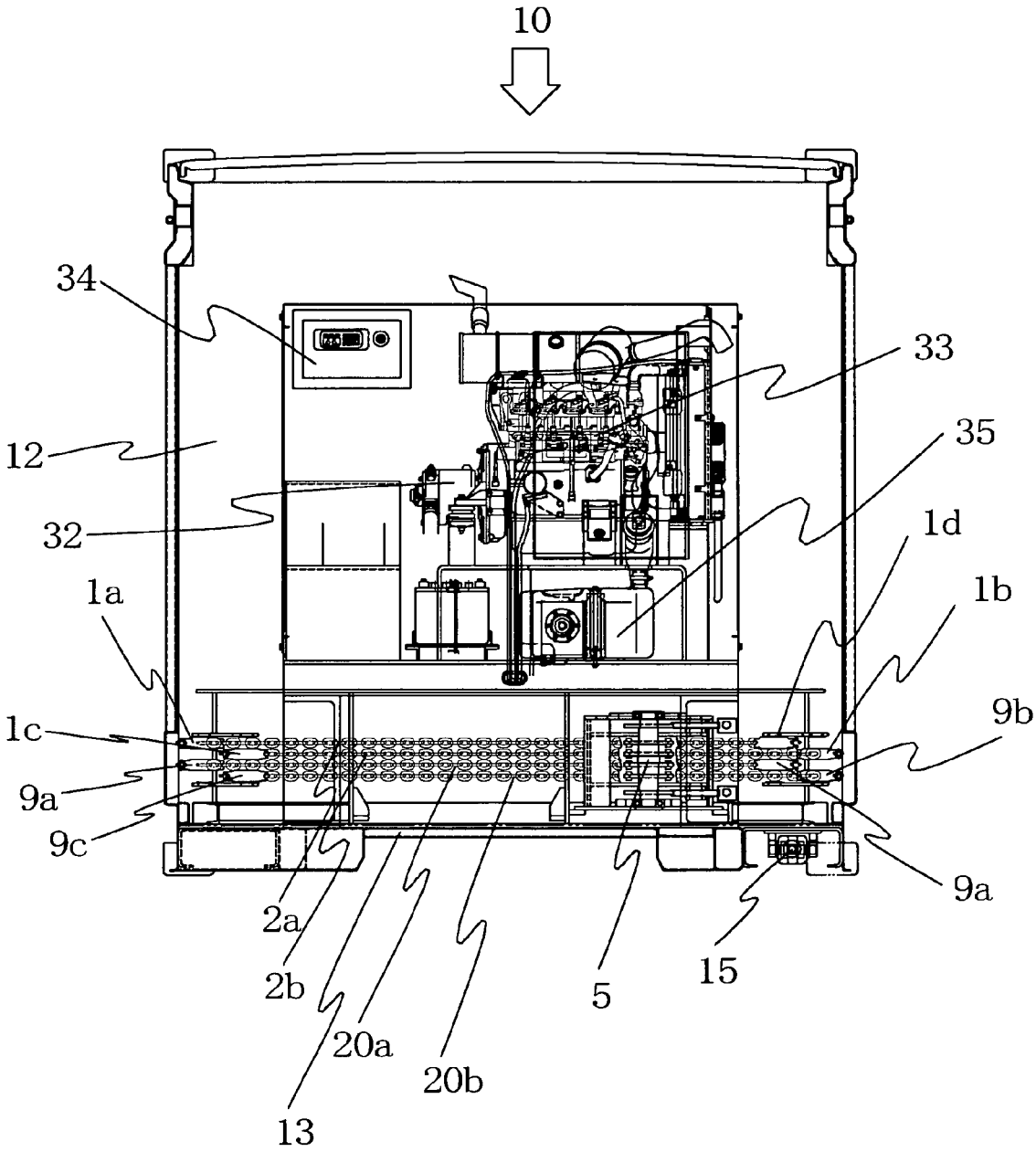
FIG. 7 is a crosswise sectional front view of the cargo transportation box body with a cargo-handling device representing a second embodiment of the invention.

The power source for driving the cylinder 15 may include a hydraulic control system as shown in FIGS. 5-7. The hydraulic control system for driving the cylinder 15 located in a forward position of the box body 10 comprises a pump 32, working oil tank 34, engine 33 for driving the pump, and oil supply tank 35. A portion of the box body 10 to receive the hydraulic control system may have partition walls on the front and rear sides of the hydraulic control system, although their illustration is omitted.

According to the embodiment, as described above, a first rotary body 1*a* (guide roller) and a second rotary body 1*b* are provided beneath the movable partition wall 12 apart from and opposite to each other in a width direction of the box body. A third rotary body 1*c* is provided close to the first rotary body 1*a* while a fourth rotary body 1*d* to the second rotary body 1*b*. The first chain 2*a* has one end fixed to the rear end of the box body 10 and other end to the front end of the same body, and mid portion wound round the first and fourth rotary bodies 1*a*, 1*d* so as to connect the rotary bodies through the stretched chain. The second chain 2*b* has one end fixed to the rear end of the box body 10 and other end to the front end of the same body, and mid portion wound round the second and third rotary bodies 1*b*, 1*c* so as to connect the rotary bodies through the stretched chain. Likewise, a first rotary sub-body 9*a* (guide roller) and a second rotary sub-body 9*b* are provided beneath the movable partition wall 12 apart from and opposite to each other in a width direction of the box body. A third rotary sub-body 9*c* is provided close to the first rotary sub-body 9*a* while a fourth rotary sub-body 9*d* to the second rotary sub-body 9*b*. The first to fourth rotary sub-bodies 9*a* to 9*d* correspond to the first to fourth rotary bodies 1*a* to 1*d* respectively with each pair of rotary body and rotary sub-body being arranged one over the other connected via a central axis.

A first sub-chain 20*a* has one end fixed to the rear end of the floor board 13 and other end to the front end of the box body, and mid portion wound round the first and fourth rotary sub-bodies 9*a*, 9*d* so as to connect the rotary sub-bodies through the stretched chain. A second sub-chain 20*b* has one end fixed to the rear end of the floor board 13 and other end to the front end of the box body, and mid portion wound round the second and third rotary sub-bodies 9*b*, 9*c* so as to connect the rotary bodies through the stretched chain. A sub-sprocket 3*b* having a series of projections 4 at an appropriately chosen interval on its periphery is provided between the first sub-chain 20*a* and the second chain 20*b* such that the projections 4 mate with rings constituting the sub-chains.

The one end of first and second chains 2*a*, 2*b* may be connected to the floor board 13 instead of the box body 10, and the one end of the first sub-chains 20*a*, 20*b* may be connected to the box body 10 instead of the floor board 13.

Figure 8:
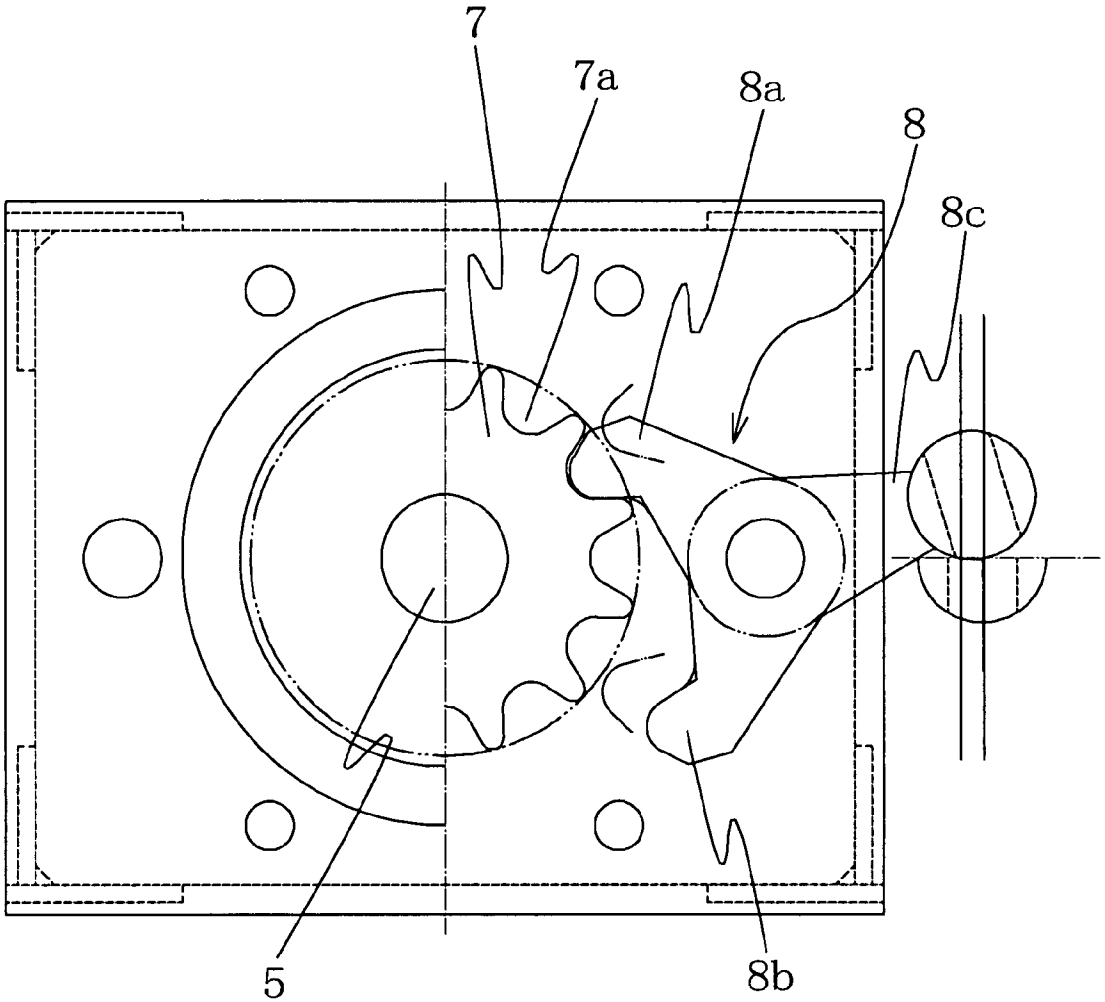
FIG. 8 is a flat view of a rotation arresting mechanism attached to the rotational axis of a sprocket.

As shown in FIG. 8, the sprockets 3*a* and 3*b* have a gear 7 around a rotational axis 5, to which is provided a stopper cam 8 capable of engaging with the gear 7. The stopper cam 8 has a pair of nails 8*a* and 8*b* each to engage with a recess 7*a* of the gear 7. The nails 8*a*, 8*b* are constructed with respect to the gear 7 such that, when the nail 8*a* engages with a recess 7*a* of the gear 7, the stopper cam 8 prevents, for example, the counterclockwise rotation of the gear 7 but allows its clockwise rotation, while, when the nail 8*b* engages with a recess 7*a* of the gear 7, the stopper cam 8 prevents the clockwise rotation of the gear 7 but allows its counterclockwise rotation. For example, when the nail 8*a* engages with a recess 7*a* of the gear 7, the nail 8*a* in contact with recess 7*a* is so shaped as to smoothly escape from the recess 7*a* when the gear rotates clockwise. The stop-rotation relationship of the nails 8*a*, 8*b* to the gear 7 may be reversed. In FIG. 8, 8*c* represents a manually operable lever attached to the stopper cam 8 by which the operator can select the nail 8*a* or 8*b* to be engaged with a recess 7*a* of the gear 7.

It is also possible, though not illustrated here, to rotate the sprocket 3*b* using a rotational driving mechanism based, on a hydraulic motor to move the first and second sub-chains 20*a*, 20*b* so that the movable partition wall 12 can move in synchrony with the floor board 13 when the floor board 13 is moved by way of the cylinder 15. The rotational driving mechanism based on a hydraulic motor may include a hydraulic control system comprising a pump 32, working oil tank 34, engine 33 for driving the pump, and oil supply tank 35 as described above.

Figure 9:
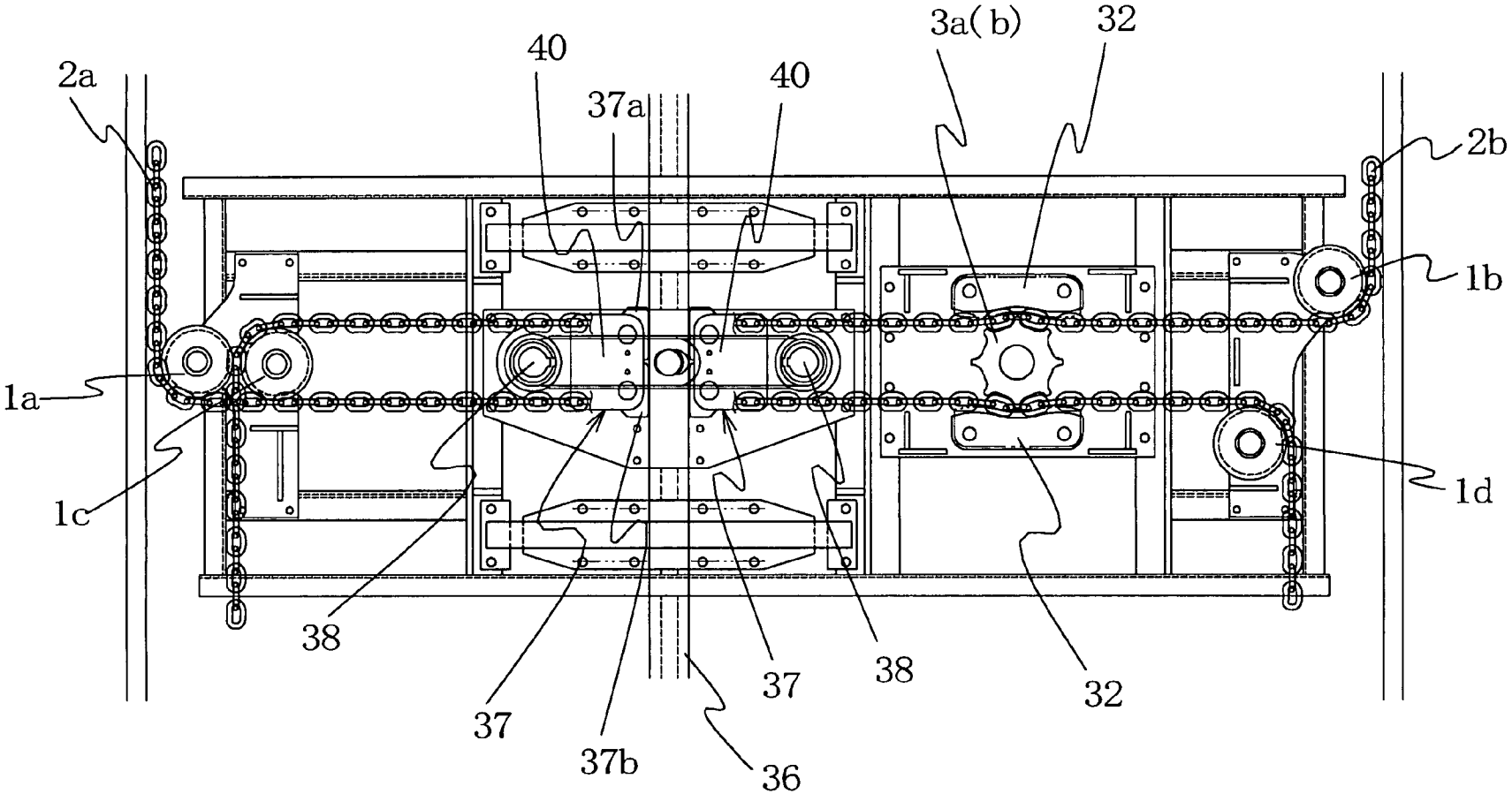
FIG. 9 is a flat view of a part of interest of the cargo transportation box body with a cargo-handling device representing the second embodiment of the invention.
Figure 10:
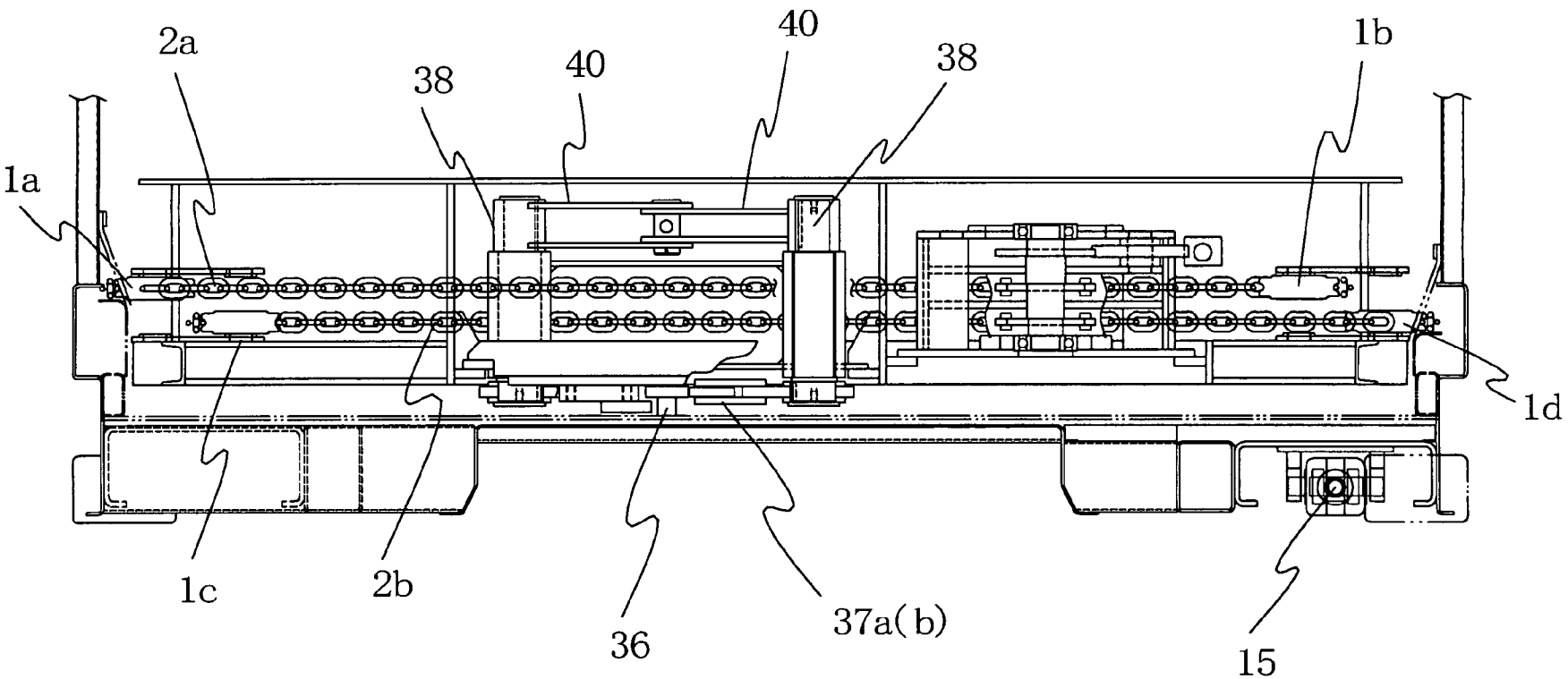
FIG. 10 is a lengthwise sectional lateral view of a part of interest of the cargo transportation box body with a cargo-handling device representing the second embodiment of the invention.
Figure 11:
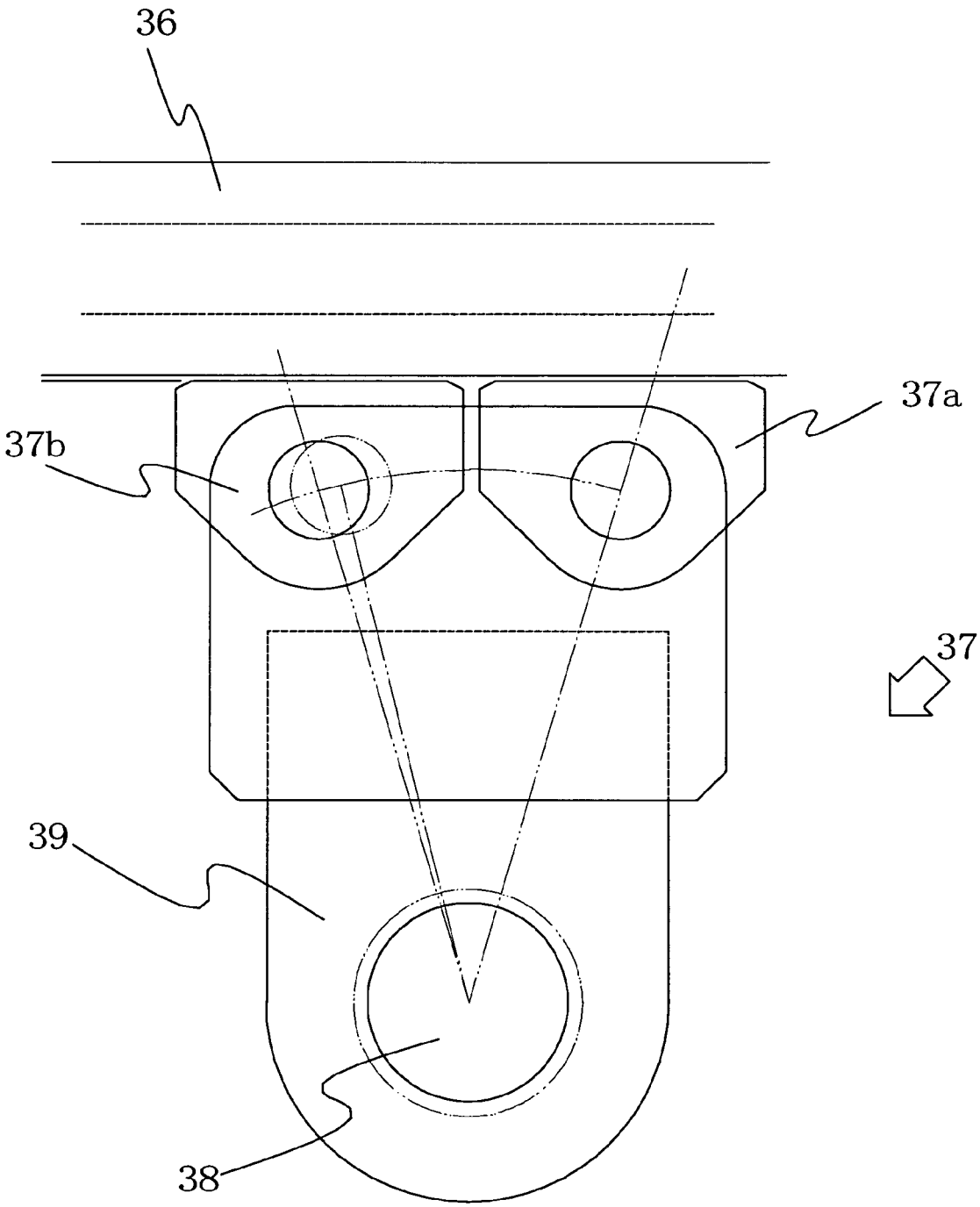
FIG. 11 is a flat view of a part of interest of a frictional braking mechanism for unilateral stoppage.

As shown in FIGS. 9 and 10, a rail 36 with a T-shaped cross-section is provided at the center in a lengthwise direction over the floor board 13 such that the movable partition wall 12 rides on the rail 36 to slide along it.

It should be noted that in FIGS. 8 and 9, illustration of the first to fourth rotary sub-bodies 9*a* to 9*d* (guide rollers), and the first and second sub-chains 20*a*, 20*b* as well as the first and second chains 2*a*, 2*b* is omitted.

A frictional unilateral braking mechanism 27 comprised of joining cams 37*a*, 37*b* which are brought into contact with the rail 36 is provided in connection with the movable partition wall 12. As shown in FIG. 10, the joining cams 37*a*, 37*b* are hinged to the central end of an arm 39 which can rotate around an axis 38. When the arm 39 is positioned at right angles with respect to the rail 36, parallel gaps having the same width are formed between the joining cams 37*a*, 37*b* and the rail 36.

If the arm 39 is rotated slightly in one direction (e.g., clockwise) around the axis 38, one of the joining cams 37*a*, 37*b* with its contacting surface inclined is brought into contact with the rail 36 which stops by friction the movement of the rail 36 in one direction (e.g., anterior direction) while permitting its movement in the opposite direction (e.g., posterior direction).

If the arm 39 is rotated in the opposite direction (e.g., counterclockwise), the other joining cam 37*a* or 37*b* with its inclined surface is brought into contact with the rail 36 which stops by friction the movement of the rail 36 in one direction (e.g., posterior direction) while permitting its movement in the opposite direction (e.g., anterior direction).

In the particular embodiment shown in the figures, two frictional braking mechanisms 37 are provided around the rail 36 such that the two braking mechanisms sandwich the rail 36 from its both sides.

The two axes 38 arranged on both sides of the rail 36 extend upward, and two operation arms 40 attached are hinged to each other at the center to connect the two axes 38 together such that when they are moved in one direction, they flex together in that direction to take a form like a letter "L."

Now, the operation of this embodiment will be described below. Assume that an inventive box body 10 or a container is brought by a truck being carried on its trailer to a cargo dock where loads packed in the container should be hauled out. The access port 11 is opened. The movable partition wall 12 is located at a forward position of box body 10.

A hydraulic control system comprising a pump 32, working oil tank 34, engine 33 for driving the pump, and oil supply tank 35 is activated to extend the cylinder 15 to move the floor board 13 backward in the body box 10. Then, the movable partition wall 12 moves in association by the same amount with the shift of the floor board 13.

At this stage, the mid portions of first chain and sub-chain 2*a*, 20*a* are wound round the first and fourth rotary bodies and sub-bodies 1*a*, 1*d* and 9*a*, 9*d* to be stretched between the first rotary body and sub-body 1*a*, 9*a* and the fourth rotary body and sub-body 1*d*, 9*d* in parallel with the width of the movable partition wall 12. Likewise, the mid portions of second chain and sub-chain 2*b*, 20*b* are wound round the second and third rotary bodies and sub-bodies 1*b*, 1*c* and 9*b*, 9*c*. Thus, the movable partition wall 12 which has the first and second chains and sub-chains 2*a*, 2*b* and 20*a*, 20*b* intersected crosswise on its front side and whose lateral edges are pulled forward or backward in box body 10 with the first body and sub-body 1*a*, 9*a*, second body and sub-body 1*b*, 9*b*, third body and sub-body 1*c*, 9*c*, and fourth body and sub-body 1*d*, 9*d* as pivots, is prevented from swinging to left and right to securely maintain a stabilized position.

When the movable partition wall 12 moves in association with the floor board 13, the stopper cam 8 is allowed to engage with the gear 7, thereby arresting the rotation of sprocket 3*a*. Then, the movable partition wall 12 is immobilized together with the floor board 13. Assume, for sprocket 3*a*, a recess 7*a* of gear 7 receives the nail 8*a* of stopper cam 8. Then, the nail 8*a* can escape from the engagement with the recess 7*a* to permit the gear 7 to rotate, thereby allowing the sprocket 3*a* to rotate freely. Then, the first rotary body 1*a*, second rotary body 1*b*, third rotary body 1*c*, and fourth rotary body 1*d* slide on the first chain 2*a* and second chain 2*b*, to let the movable partition wall 12 move by means of the first chain 2*a* and second chain 2*b* intersected crosswise on the front side of the wall 12.

At this stage, when the operation arms 30 are flexed to take, in combination, a form like a letter "L," so that each arm 29 slightly shifts laterally from the axis 28, one of joining cams 27*a*, 27*b* for each side with its contact surface inclined is brought into contact with the rail 26, which serves as a unilateral frictional brake. At this stage, the movable partition wall 12 is prohibited from returning towards the previous position.

Then, let's consider the case where the cylinder 15 is allowed to contract to move the floor board 13 in the direction opposite to the previous one, or from back to forward. Then, the gear 7 is prohibited from rotating clockwise by means of the stopper cam 8, and thus the sprocket 3*a* is stopped, thereby arresting the movement of first and second chains 2*a*, 2*b*. As a result of this series of events, the movable partition wall 12 is fixed to the box body 10. Since loads have their frontal ends pressed against the movable partition wall 12, they rest there and only the floor board 13 moves forward to its original position. In this case, however, with regard to sprocket 3*b*, a recess 7*a* of gear 7 receives the nail 8*a* of stopper cam 8, the nail 8*a* can escape from the engagement with the recess 7*a* to cause the gear 7 to rotate, thereby allowing the sprocket 3*b* to rotate freely. Then, the first rotary sub-body 9*a*, second rotary sub-body 9*b*, third rotary sub-body 9*c*, and fourth rotary sub-body 9*d* slide on the first sub-chain 20*a* and second sub-chain 20*b*, to let the movable partition wall 12 move by means of the first sub-chain 20*a* and second sub-chain 20*b* intersected crosswise on the front side of the wall 12.

In this case, the friction-based braking mechanism 37 does not work, and the movable partition wall 12 is allowed to move in association with the movement of floor board 13.

This process can be summarized as follows: (1) Backward movement of floor board 13, and associative movement of movable partition wall 12 and loads; (2) Stoppage of movable partition wall 12; and (3) Forward movement only of floor board 13. This process is repeated to move the movable partition wall 12 together with the loads step by step to shift loads backward with respect to the floor board 13 so that loads are allowed to fall from the rear end of box body 10 sequentially in the order of their proximity to the rear end of box body 10.

When all the loads have been discharged from the container, the container should be arranged for a renewed fill or cargo loading. For this purpose, the movable partition wall 12 should be moved to a forward position of the floor board 13.

In this case, a manually operable lever 8*c* is operated such that the nail 8*b* of the stopper cam 8, instead of the nail 8*a*, engages with a recess 7*a* of the gear 7, thereby prohibiting the counterclockwise rotation of the gear 7, while permitting its clockwise rotation.

In addition, the operation arms 40 are flexed in the direction opposite to the previous one to take, in combination, a form like an oppositely directed letter "L," so that the joining cam 37*a*, 37*b* to be brought into contact with the rail 36 can be changed.

This process can be summarized as follows: (1) Forward movement of floor board 13, and associative movement of movable partition wall 12 (in cargo loading, loads are also moved in association); (2) Stoppage of movable partition wall 12; and (3) Backward movement only of floor board 13. This process is repeated to move the movable partition wall 12 forward to be ready for accepting additional loads.

Figure 12:
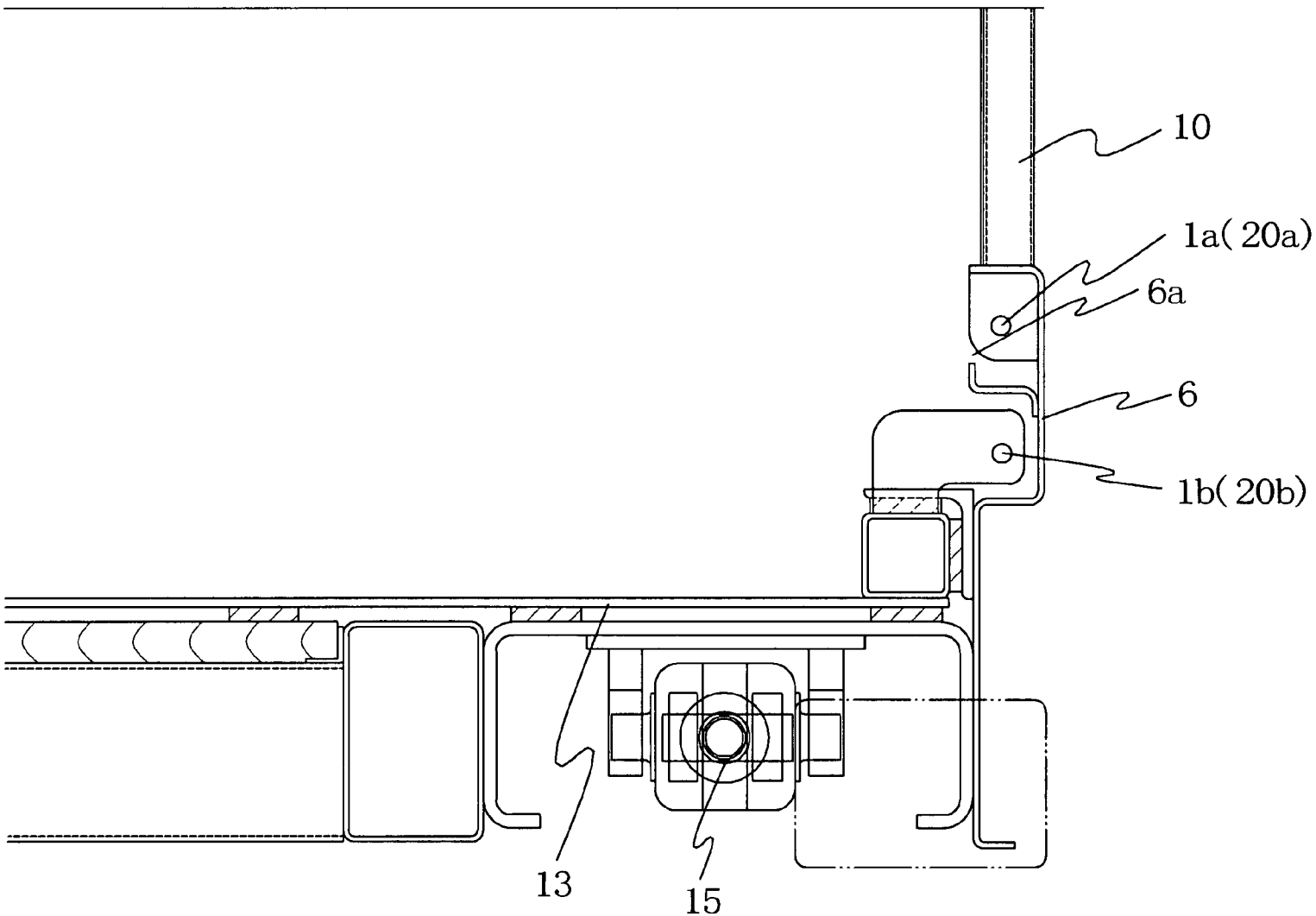
FIG. 12 is a lengthwise sectional front view of a part of interest of a third embodiment of the invention.

Incidentally, as shown in FIG. 12, groove portions 6 having a slit facing laterally are provided along the basal lengthwise corners of the box body 10. The groove portions 6 receive the portions of first chain and sub-chain 1*a*, 20*a* and second chain and sub-chain 1*b*, 20*b* which extend from the attachments of those chains to the box body 10 or to the floor board 13 to the contact points with the rotary bodies and sub-bodies 1*a*-1*d*, 9*a*-9*d*.

This arrangement makes it possible for the first chain and sub-chain 1*a*, 20*a* and second chain and sub-chain 1*b*, 20*b* not to disturb the movement of loads on the floor board 13.

Figure 13:
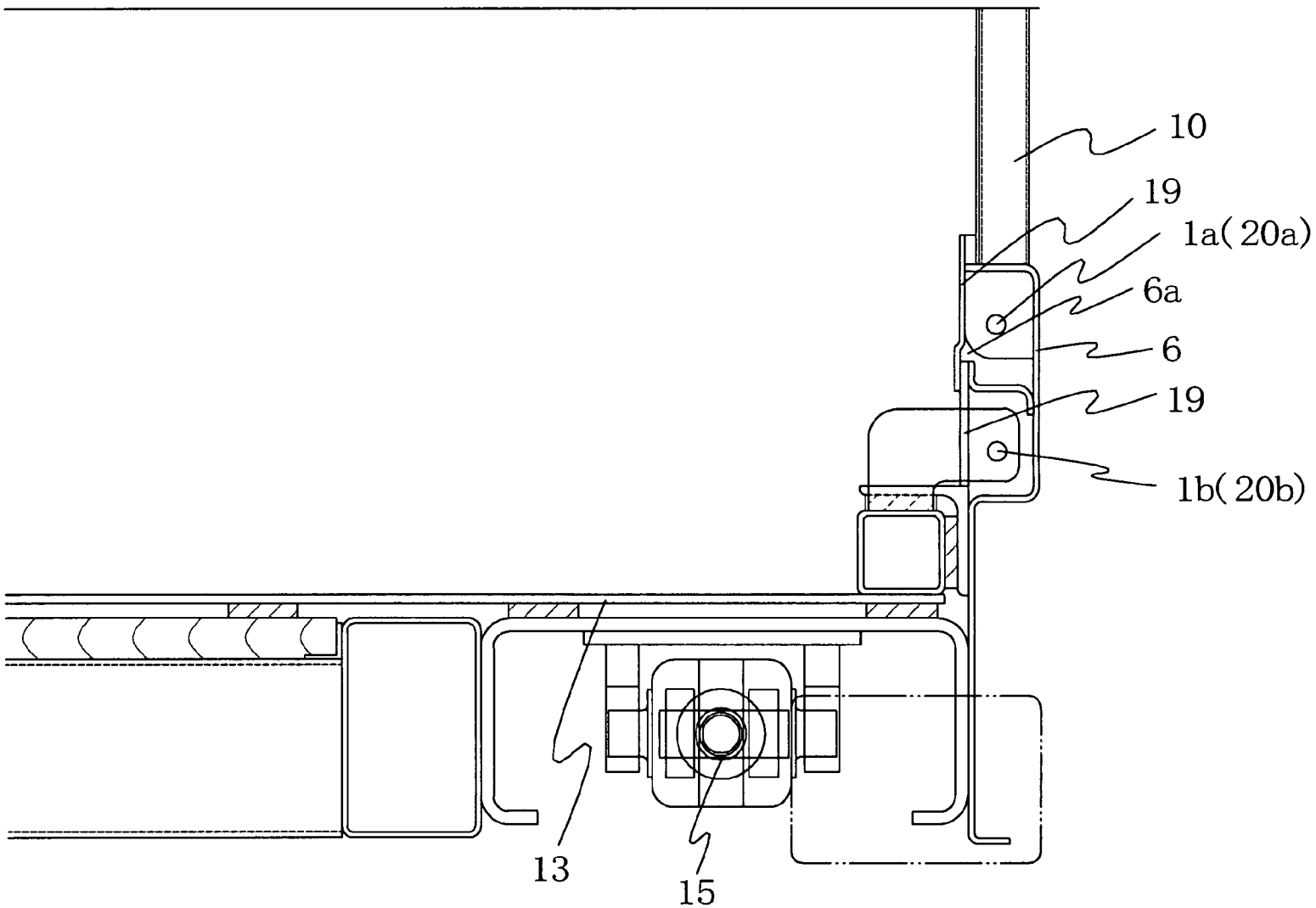
FIG. 13 is a lengthwise sectional front view of a part of interest of a fourth embodiment of the invention.

If the lateral facing slit 6*a* of each groove portion 6 is closed with a hanging elastic plate-like body 19 such as a rubber plate or the like as shown in FIG. 13, it will be possible, even when a load contains sand or pebbles, or particles or grains of a certain material, to prevent the entry of such minute particles into the groove portion 6 by means of the elastic plate-like body 19.

The first chain and sub-chain 1*a*, 20*a*, and second chain and sub-chain 1*b*, 20*b* after leaving the rotary bodies 1*a*-1*d* and sub-bodies 9*a*-9*d* run crosswise over the floor board 13 before they enter into the respective groove portions 6. The entry, however, would be intercepted by the elastic plate-like bodies 19 unless properly treated. If the skirt of the elastic plate-like body 19 is raised to allow the entry of the chain into the groove, the elastic plate-like body 19 will not obstruct in any way the passage of the chain.

The movable partition wall 12 is placed above the floor board 13 with its lower end being in contact with the latter. A cylinder movable back and forth is provided in a gap between the floor board 13 and the box body 10.

Figure 14:
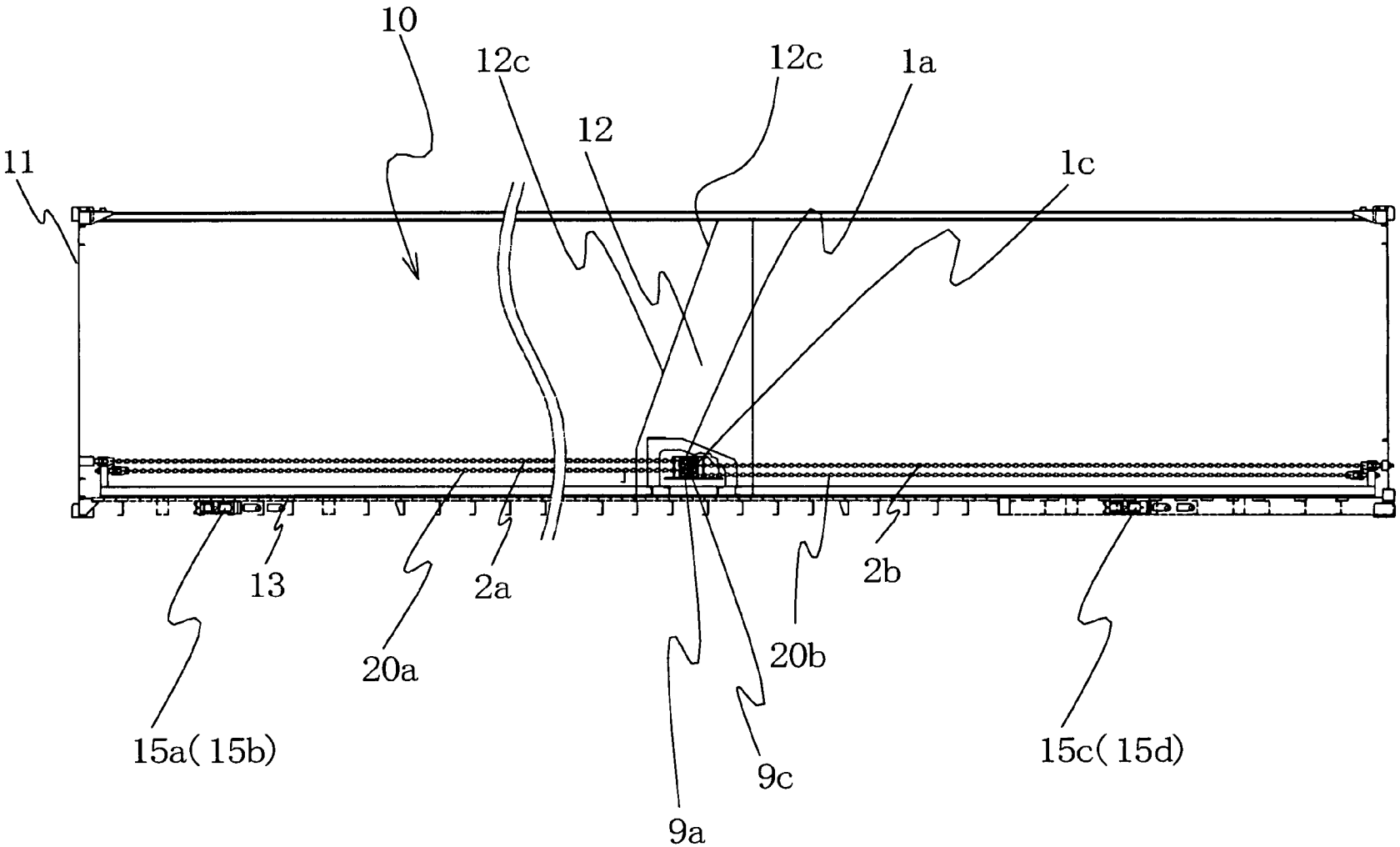
FIG. 14 is a lengthwise sectional lateral view of a cargo transportation box body with a cargo-handling device representing a fifth embodiment of the invention.
Figure 15:
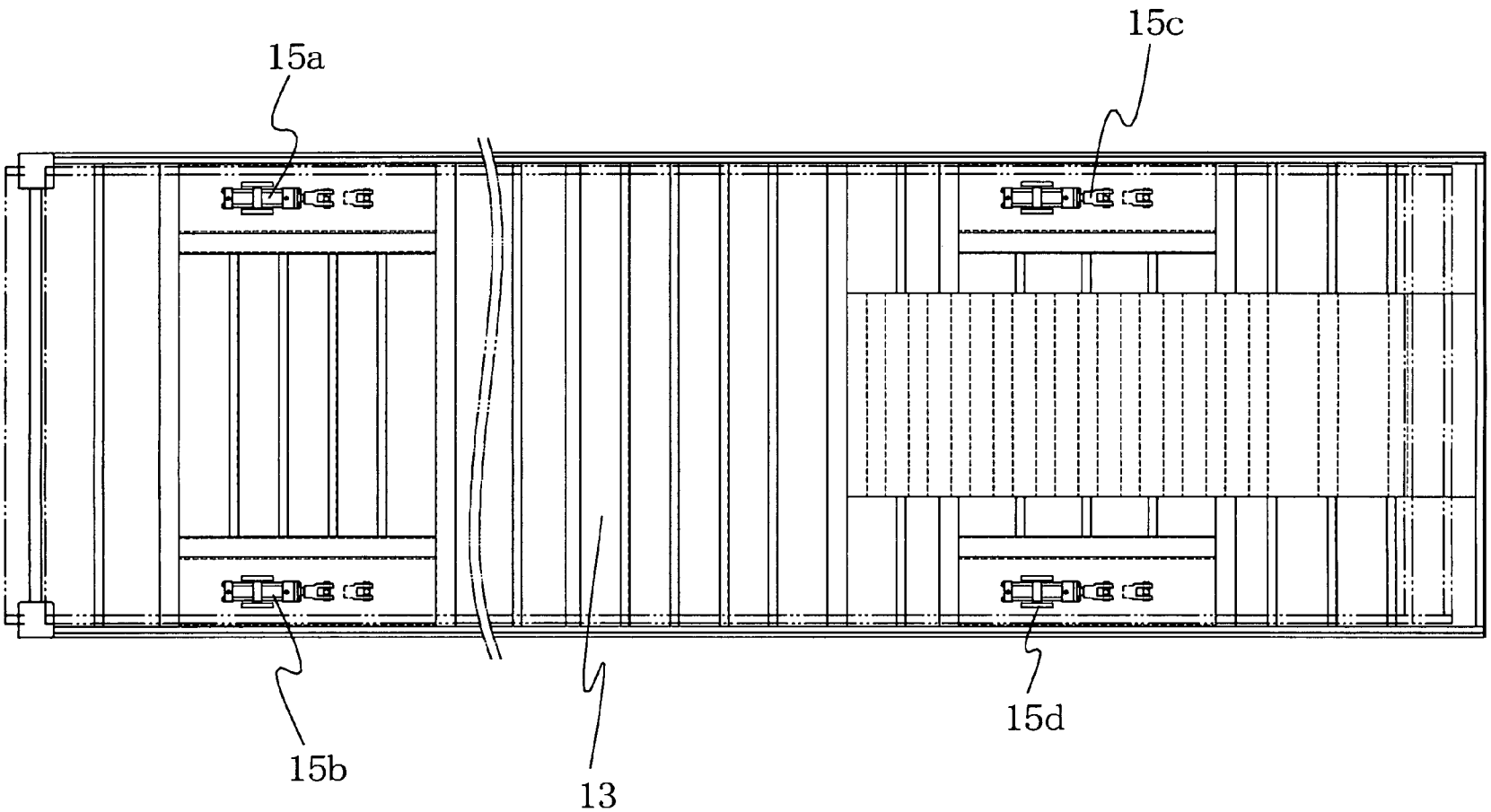
FIG. 15 is a bottom view of the cargo transportation box body with a cargo-handling device representing the fifth embodiment of the invention.

The cylinder may consist of cylinder units 15*a*, 15*b* provided on the lateral edges of floor board 13 at a backward level across the box body 10, and cylinder units 15*c*, 15*d* provided on the lateral edges of floor board 13 at a forward level across the box body 10 as shown in FIGS. 14 and 15. All the backward and forward cylinder units 15*a*, 15*b*, 15*c*, 15*d* work in a unified manner to shift the floor board 13 in the same direction.

Figure 16:
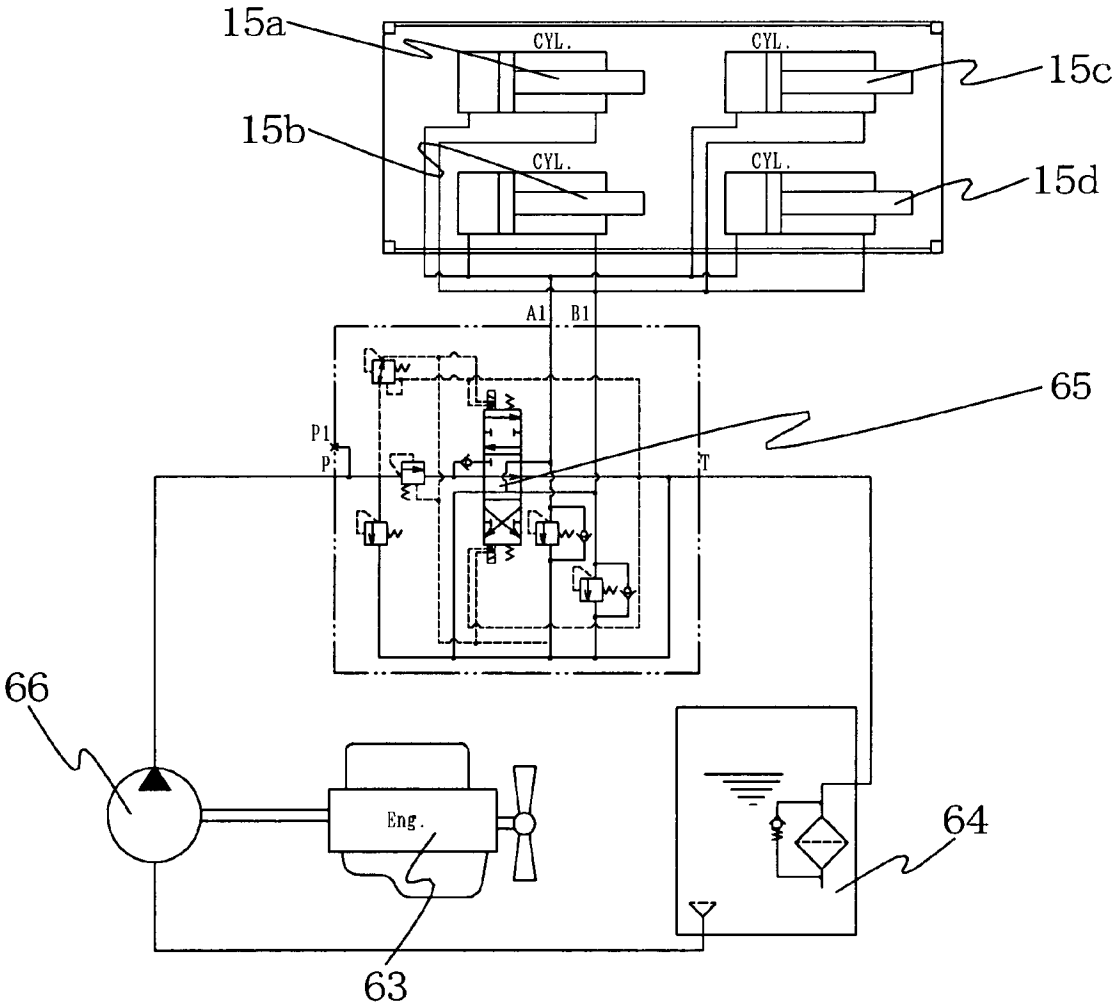
FIG. 16 is a circuit diagram of a hydraulic system of the cargo transportation box body with a cargo-handling device representing the fifth embodiment of the invention.

FIG. 16 is a circuit diagram of a hydraulic system. An engine 63 drives a pump 66 which distributes oil uniformly via a valve 65 to the cylinder units 15*a*, 15*b*, 15*c*, 15*d*. The number 64 represents an oil supply tank.

Now, the operation of the embodiment will be described below. Assume that an inventive box body 10 or a container is brought by a truck being carried on its trailer to a cargo dock where loads packed in the container should be hauled out. The access port 11 is opened. The movable partition wall 12 is located at a forward position of box body 10.

When the hydraulic control system is activated to extend the cylinder units 15*a*, 15*b*, 15*c*, 15*d*, the floor board 13 moves from front to backward in the body box 10. Then, the movable partition wall 12 as well as loads on the floor board 13 moves in association by the same amount with the shift of the floor board 13.

In this case, since the floor board 13 is pulled in the same direction at four sites, two at an anterior level and two at a posterior level, it can smoothly move without undergoing any bending or distortion.

At this stage, as shown in FIGS. 5 and 6, the mid portions of first chain and sub-chain 2*a*, 20*a* are wound round the first rotary body and sub-body 1*a*, 9*a* and the fourth rotary body and sub-body 1*d*, 9*d*, to be stretched between the first rotary body and sub-body 1*a*, 9*a* and the fourth rotary body and sub-body 1*d*, 9*d* in parallel with the width of the movable partition wall 12. Likewise, the mid portions of second chain and sub-chain 2*b*, 20*b* are wound round the second and third rotary bodies and sub-bodies 1*b*, 1*c* and 9*b*, 9*c*. Thus, the movable partition wall 12 which has the first and second chains and sub-chains 2*a*, 2*b* and 20*a*, 20*b* intersected crosswise on its front side and whose lateral edges are pulled forward or backward in box body 10 with the first body and sub-body 1*a*, 9*a*, second body and sub-body 1*b*, 9*b*, third body and sub-body 1*c*, 9*c*, and fourth body and sub-body 1*d*, 9*d* as pivots, is prevented from swinging to left and right to securely maintain a stabilized position.

When the movable partition wall 12 moves in association with the floor board 13, the stopper cam 8 is allowed to engage with the gear 7, thereby arresting the rotation of sprocket 3*a*. This immobilizes the movable partition wall 12 as well as the floor board 13.

Assume, for sprocket 3*a*, a recess 7*a* of gear 7 receives the nail 8*a* of stopper cam 8. Then, the nail 8*a* can escape from the engagement with the recess 7*a* to permit the gear 7 to rotate, thereby allowing the sprocket 3*a* to rotate freely. Then, the first'rotary body 1*a*, second rotary body 1*b*, third rotary body 1*c*, and fourth rotary body 1*d* slide on the first chain 2*a* and second chain 2*b*, to let the movable partition wall 12 move by means of the first chain 2*a* and second chain 2*b* intersected crosswise on the front side of the wall 12.

Then, let's consider the case where the cylinders 15*a*, 15*b*, 15*c*, 15*d* are allowed to contract to move the floor board 13 in the direction opposite to the previous one, or from back to forward. Then, the gear 7 is prohibited from rotating clockwise by means of the stopper cam 8, and thus the sprocket 3*a* is stopped, thereby arresting the movement of first and second chains 2*a*, 2*b*. As a result of this series of events, the movable partition wall 12 is fixed to the box body 10. Since loads have their frontal ends pressed against the movable partition wall 12, they rest there and only the floor board 13 moves forward to its original position. In this case, however, with regard to sprocket 3*b*, a recess 7*a* of gear 7 receives the nail 8*a* of stopper cam 8, the nail 8*a* can escape from the engagement with the recess 7*a* to cause the gear 7 to rotate, thereby allowing the sprocket 3*b* to rotate freely. Then, the first rotary sub-body 9*a*, second rotary sub-body 9*b*, third rotary sub-body 9*c*, and fourth rotary sub-body 9*d* slide on the first sub-chain 20*a* and second sub-chain 20*b*, to let the movable partition wall 12 move by means of the first sub-chain 20*a* and second sub-chain 20*b* intersected crosswise on the front side of the wall 12.

This process can be summarized as follows: (1) Backward movement of floor board 13, and associative backward movement of movable partition wall 12 and loads; (2) Stoppage of movable partition wall 12; and (3) Forward movement only of floor board 13. This process is repeated to move the movable partition wall 12 together with the loads step by step to shift loads backward with respect to the floor board 13 so that loads are allowed to fall from the rear end of box body 10 sequentially in the order of their proximity to the rear end of boxy body 10.

When all the loads have been discharged from the container, the container should be arranged for a renewed fill or cargo loading. For this purpose, the movable partition wall 12 should be moved to a forward position of the floor board 13.

In this case, the nail 8*b* of stopper cam 8 is allowed to engage with a recess 7*a* of gear 7, thereby prohibiting the counterclockwise rotation of the gear 7, while permitting its clockwise rotation.

Then, follows the process consisting of: (1) Forward movement of floor board 13, and associative movement of movable partition wall 12 (in cargo loading, loads are also moved in association); (2) Stoppage of movable partition wall 12; and (3) Backward movement only of floor board 13. This process is repeated to move the movable partition wall 12 forward to be ready for accepting additional loads.

Figure 17:
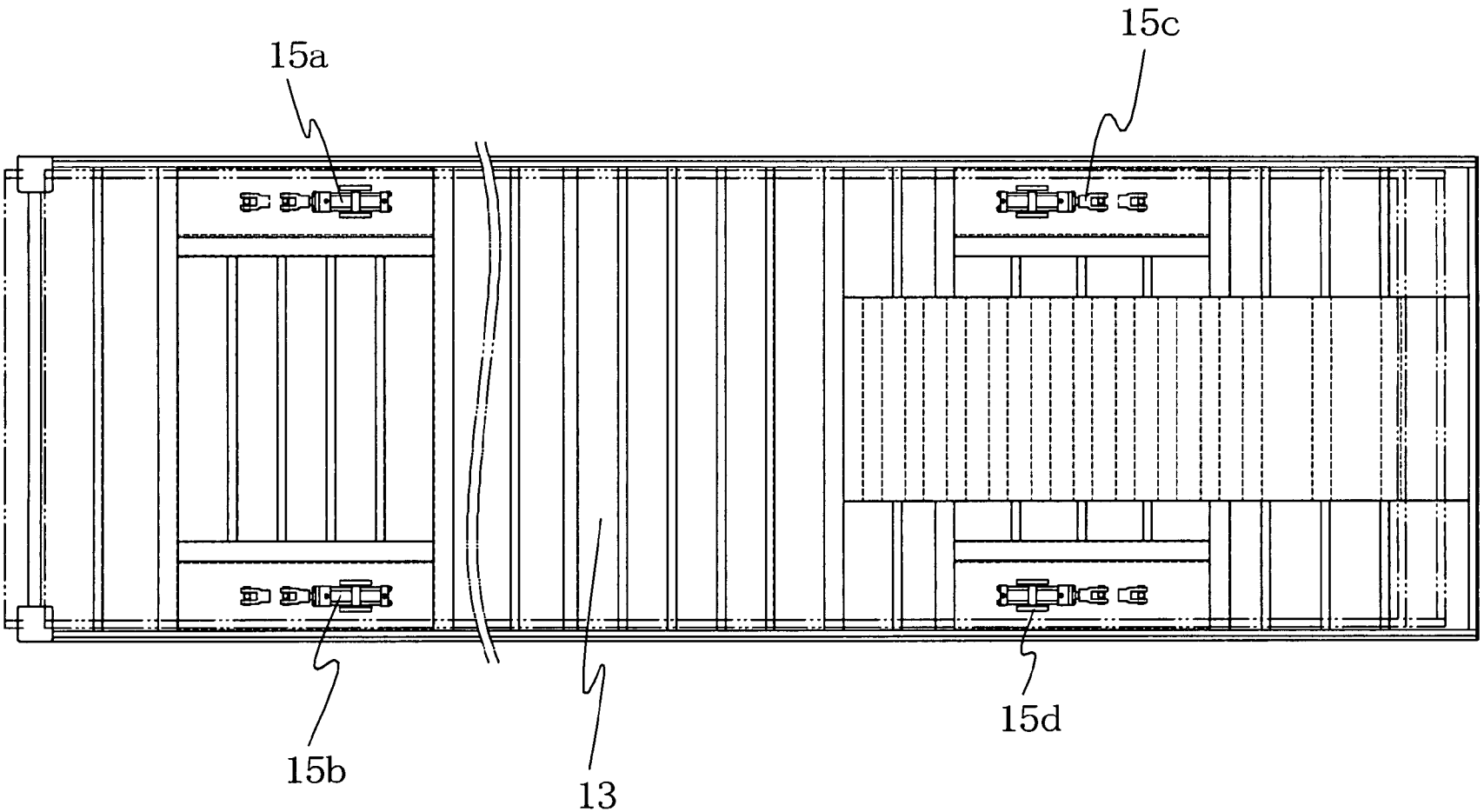
FIG. 17 is a bottom view of a cargo transportation box body with a cargo-handling device representing a sixth embodiment of the invention.

FIG. 17 represents a second variant of this embodiment where cylinder units 15*a*, 15*b* provided on a posterior level of the floor board 13 and cylinder units 15*c*, 15*d* on an anterior level of the floor board 13 are oriented opposite to each other.

Figure 18:
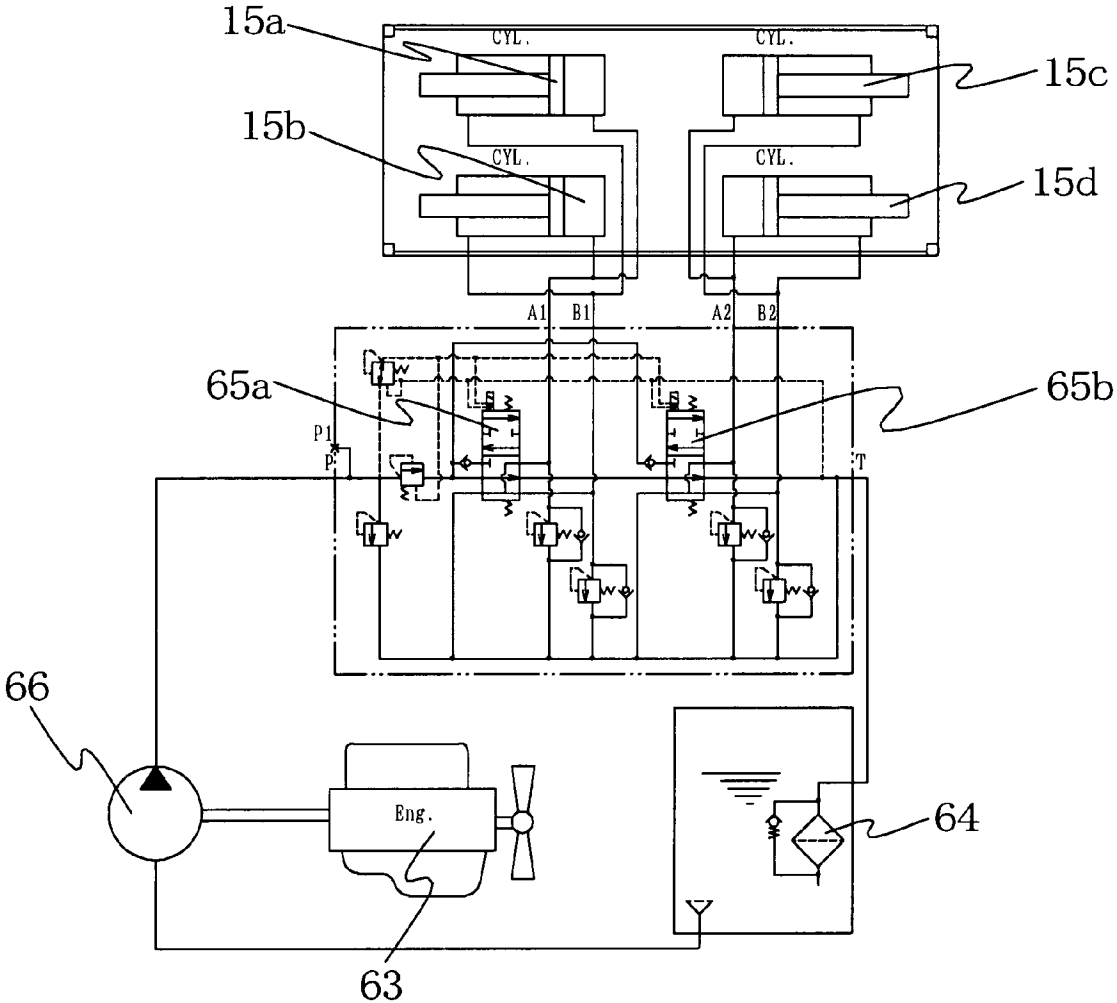
FIG. 18 is a circuit diagram of a hydraulic system of the cargo transportation box body with a cargo-handling device representing the sixth embodiment of the invention.

FIG. 18 is a circuit diagram of a hydraulic system. An engine 63 drives a pump 66 which distributes oil via valves 65*a*, 65*b* alternately to cylinder units 15*a*, 15*b*, and cylinder units 15*c*, 15*d*.

When it is required to move the floor board 13 from front to backward in the box body 10, the cylinder units 15*a*, 15*b* are activated. On the contrary, when it is required to move the floor board 13 from back to forward to a previous position, the cylinder units 15*c*, 15*d* are activated.

In this case, since the floor board 13 is pulled in the same direction only by a pair of pulling cylinder units, it can smoothly move without undergoing any bending or distortion.

Figure 19:
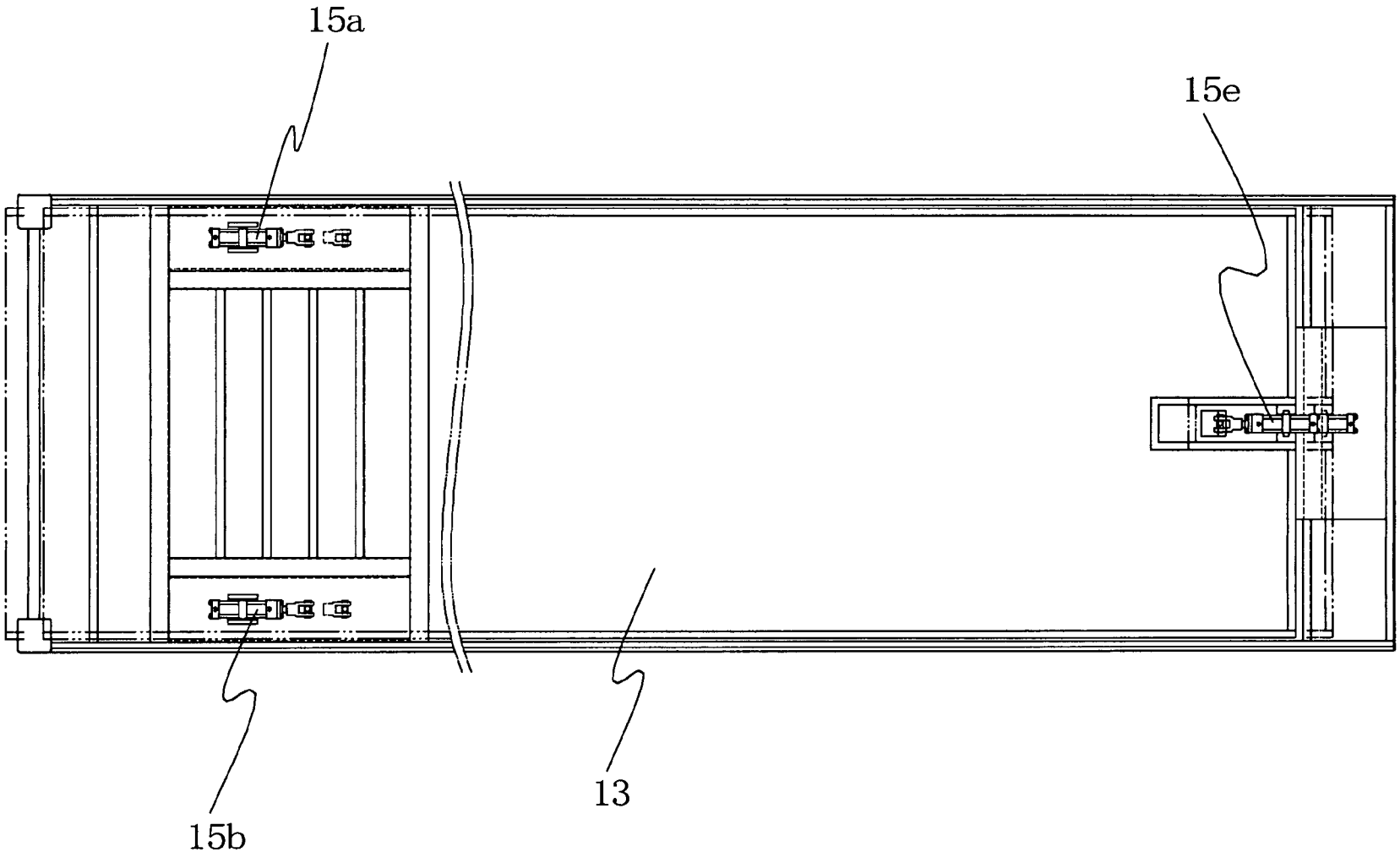
FIG. 19 is a bottom view of a cargo transportation box body with a cargo-handling device representing a seventh embodiment of the invention.
Figure 20:
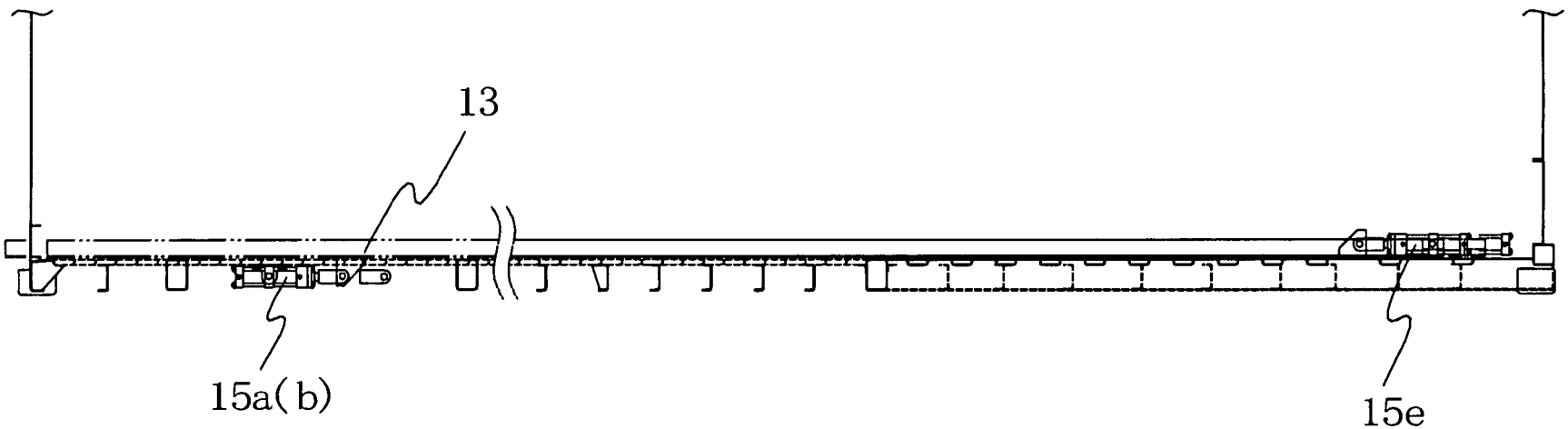
FIG. 20 is a lengthwise sectional view of the cargo transportation box body with a cargo-handling device representing the seventh embodiment of the invention.

FIGS. 19 and 20 represent a third variant of this embodiment. Cylinder units 15*a*, 15*b* provided at a posterior level of the floor board 13 are basically used for moving the floor board 13. A third supplementary cylinder unit 15*e* is provided at the center of the floor board 13 on its anterior level.

The posterior cylinder units 15*a*, 15*b* and the anterior supplementary cylinder unit 15*e* are activated alternately.

Figure 21:
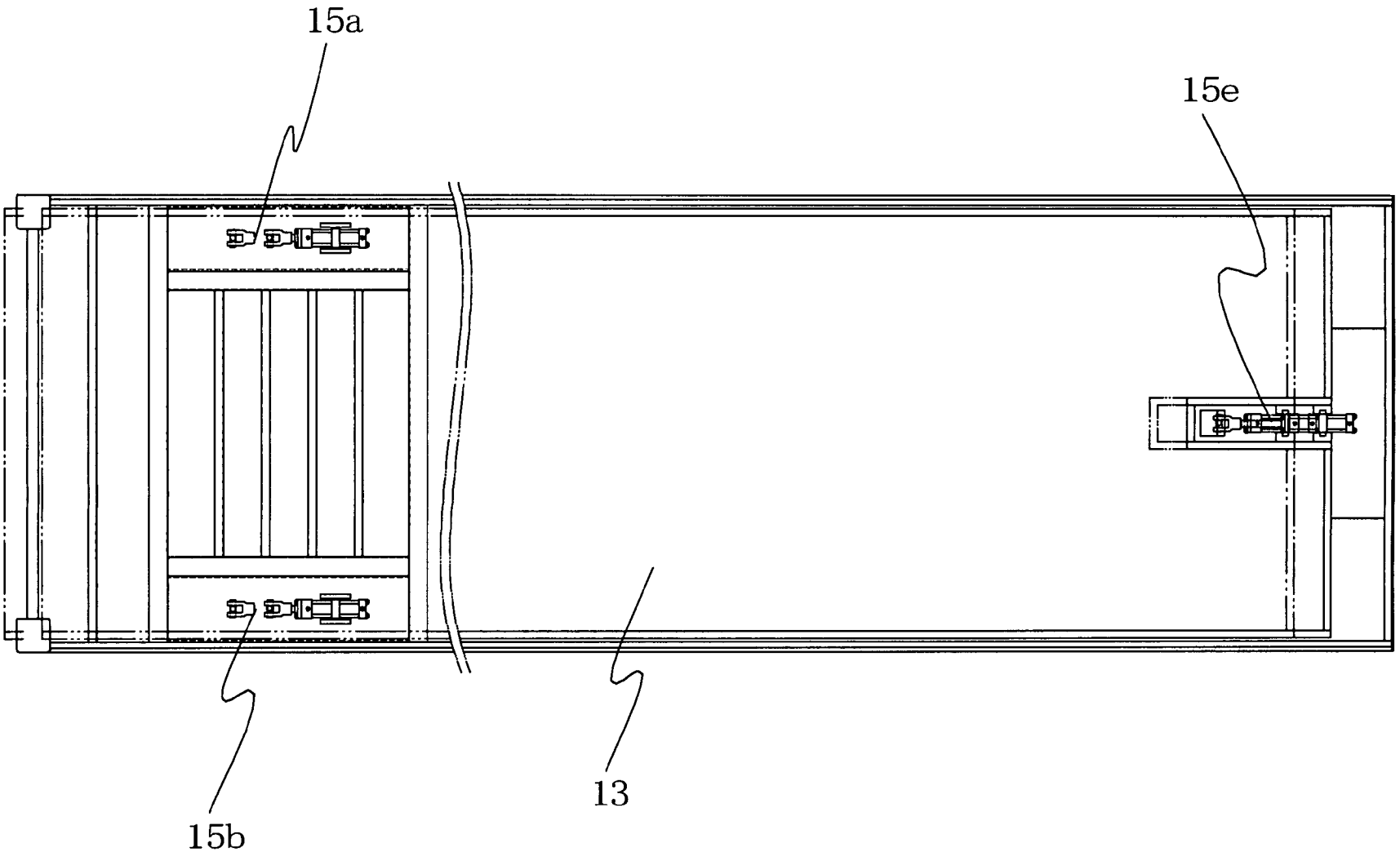
FIG. 21 is a bottom view of a cargo transportation box body with a cargo-handling device representing an eighth embodiment of the invention.

FIG. 21 represents a fourth variant of the embodiment. A supplementary cylinder unit 15*e* provided at the center of the floor board 13 on its anterior level is oriented as are cylinder units 15*a*, 15*b* provided on a posterior level of the floor board 13. Namely, the supplementary cylinder unit 15*e* pulls the floor board in the same direction as do the cylinder units 15*a*, 15*b*.

In the third and fourth variants described above, as with the first and second variants, the floor board 13 can be relieved of any bending or distortion during pulling.

Figure 22:
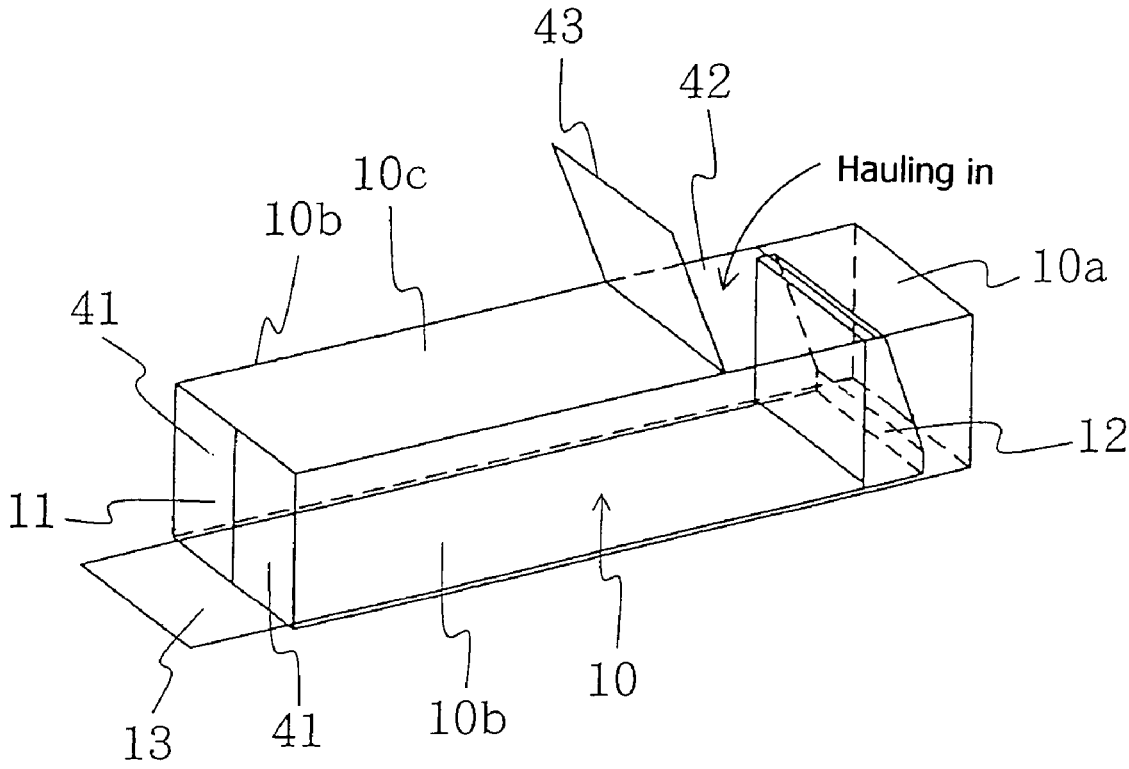
FIG. 22 is a perspective view of a cargo transportation box body with a cargo-handling device representing a ninth embodiment of the invention.

The box body 10 represents the enclosure of a container, and includes a front end plate 10*a* and lateral plates 10*b* as shown in FIG. 22. The rear end of box body 10 is represented by the access port 11. The access port 11 includes double doors 41 that open/close on hinges.

The roof 10*c* may be present or absent. If present, a hatch 43 is preferably provided on the roof so that loads can be hauled into or out of the container through a cargo loading opening 42 in addition to the access port 11 with doors 41 opening/closing on hinges.

The box body 10, like the conventional one described above, contains a movable partition wall 12 movable in an antero-posterior direction to serve as a cargo-handling device which assists the loading and unloading of cargo. The box body further contains a floor board (sliding plate) 13 movable in an antero-posterior direction beneath the movable partition wall 12. The cargo loading opening 42 is provided at such a position as to ensure a sufficient space in the anterior end of the box body 10 to receive the movable partition wall 12 even when the wall 12 is advanced most anteriorly.

The movable partition wall 12 is made of steel, and is in parallel with the plane defined by the access port 11, assuming that the box body 10 has a rectangular shape. The floor board 13 is also made of steel or stainless steel, and may have a comparatively small thickness.

The movable partition wall 12 is placed above the floor board 13 with its lower end being in contact with the latter. A cylinder 15 movable back and forth is provided in a gap between the floor-board 13 and the box body 10. The antero-posterior movement of the floor board 13 is achieved by means of the cylinder.

A fastening means for fastening the movable partition wall 12 to the box body 10 is not limited to any specific one, but may include, for example, a fastener based on a telescopic cylinder like the one 14 mentioned above, a unilateral braking mechanism consisting of a cam mating with a rack, a stopper pin, a chuck mechanism fitting to a rail-like projection, or the like.

Figure 23:
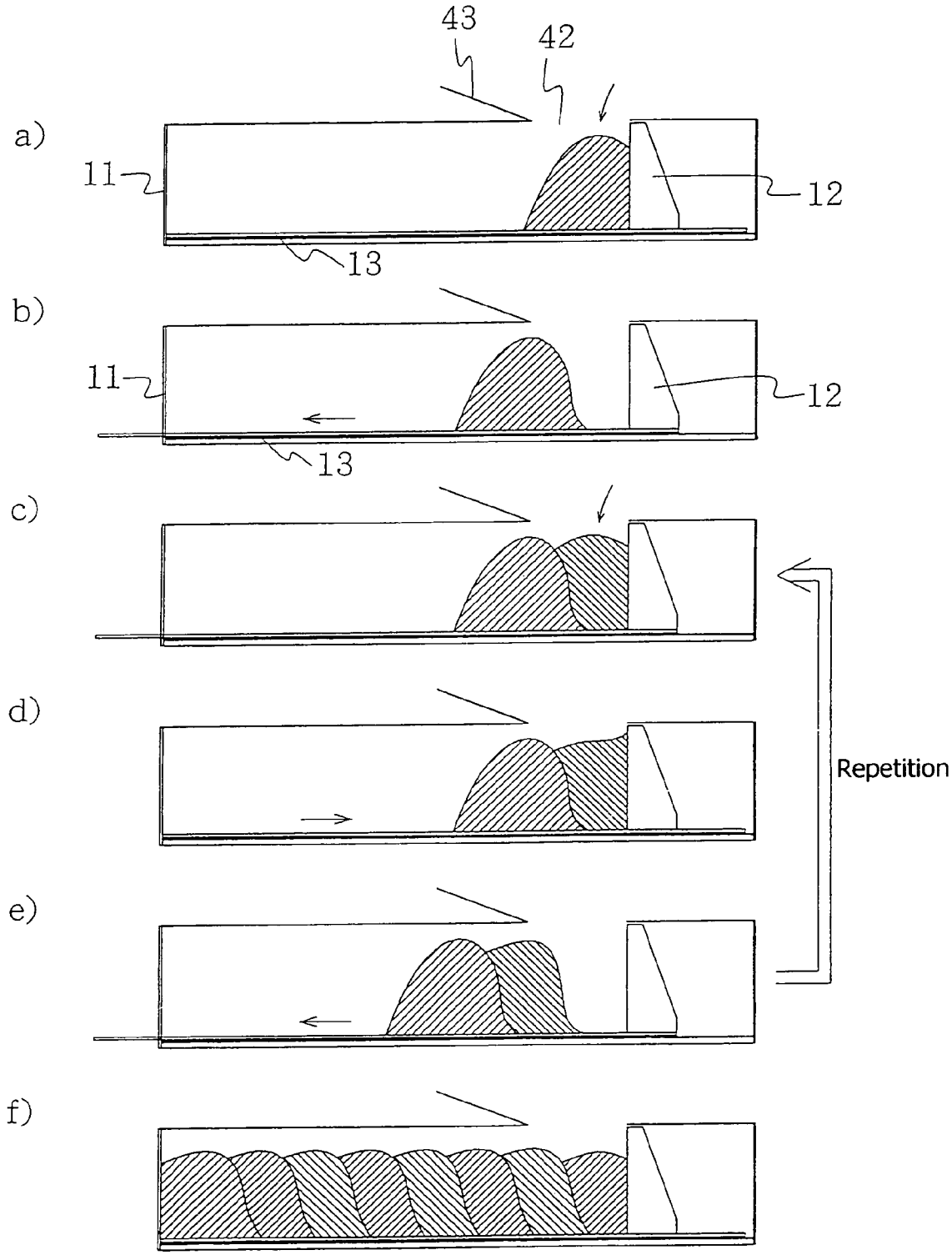
FIG. 23 illustrates the operation of the cargo transportation box body with a cargo-handling device representing the ninth embodiment of the invention.

Now, the operation of the embodiment will be described below. Charging of loads into the box body 10 may occur through the cargo loading opening 42 as shown in FIG. 23*a*. This allows the operator to haul a load from the top of body box 10 into its interior to allow the load to rest on the floor board 13. Thus, for cargo loading, the operator can use a crane or shovel. Even if loads consist of loose loads, the operator can simply drop them from above downward.

When the fastening means is activated to fix the movable partition wall 12 and only the floor board 13 is moved backward, loads hauled in to rest on the floor board 13 also move backward by the same amount with the shift of the floor board 13. Then, a blank space is generated between the forward-shifted loads and the movable partition wall 12, into which a new heap of loads can be hauled (FIGS. 23*b* and 23*c*).

Then, while the movable partition wall 12 is fixed, the floor board 13 is moved forward (FIG. 23*d*), and then backward (FIG. 23*e*). The new heap of loads are also moved backward to leave a blank space between it and the movable partition wall 12, into which another new heap of loads can be hauled.

This step consisting of generating a blank space, hauling a heap of loads into the space, moving the heap of loads backward to give rise to a new blank space is repeated until the box body 10 is filled with loads (FIG. 23*f*).

When it is required to haul the loads out of the box body 10 as a container, the access port 11 is opened. At that time, the movable partition wall 12 stays close to the anterior end plate 10*a*.

When a cylinder is allowed to extend, the floor board 13 moves from the position close to the anterior end plate 10*a* backward. The loads resting on the floor board 13 and the movable partition wall 12 also move by the same distance. Namely, in this state, the movable partition wall 12 is not fastened to the box body 10, and thus is movable in association with the floor board 13 to ensure the movement of the loads.

As a result of the backward shift, the posterior end of floor board 13 protrudes from the access port 11 while carrying a heap of loads thereupon.

Next, when the cylinder is contracted to pull the floor board 13 towards the anterior end plate 10*a*, the movable partition wall 12 is fastened to the box body 10, and the heap of loads, being immobilized by the stationary movable partition wall 12 and now losing the underlying support because of the floor board 13 retreating from the access port 11, falls downward.

Once the heap of loads are dropped, the movable partition wall 12 is fastened to the box body 10, and the cylinder is extended again to push the floor board 13 backward. The process consists of following steps: (1) Pushing backward the floor board 13; (2) Fastening the movable partition wall 12 to box body 10; (3) Pulling forward the floor board 13; (4) Dropping a heap of loads; and (5) Unfastening the movable partition wall 12. This process is repeated until all the loads packed in the box body 10 are hauled out.

When all the loads have been discharged from the box body, the box body should be arranged for a renewed fill or cargo loading. For this purpose, recourse is made to the process consisting of (1) Pushing backward the floor board 13; (2) Unfastening the movable partition wall 12; (3) Pulling forward the floor board 13; and (4) Unfastening the movable partition wall 12. This process is repeated until the movable partition wall 12 moves forward to the anterior endplate 10*a* on the anterior to the floor board 13 sufficiently wide to accept a new fill.

Figure 24:
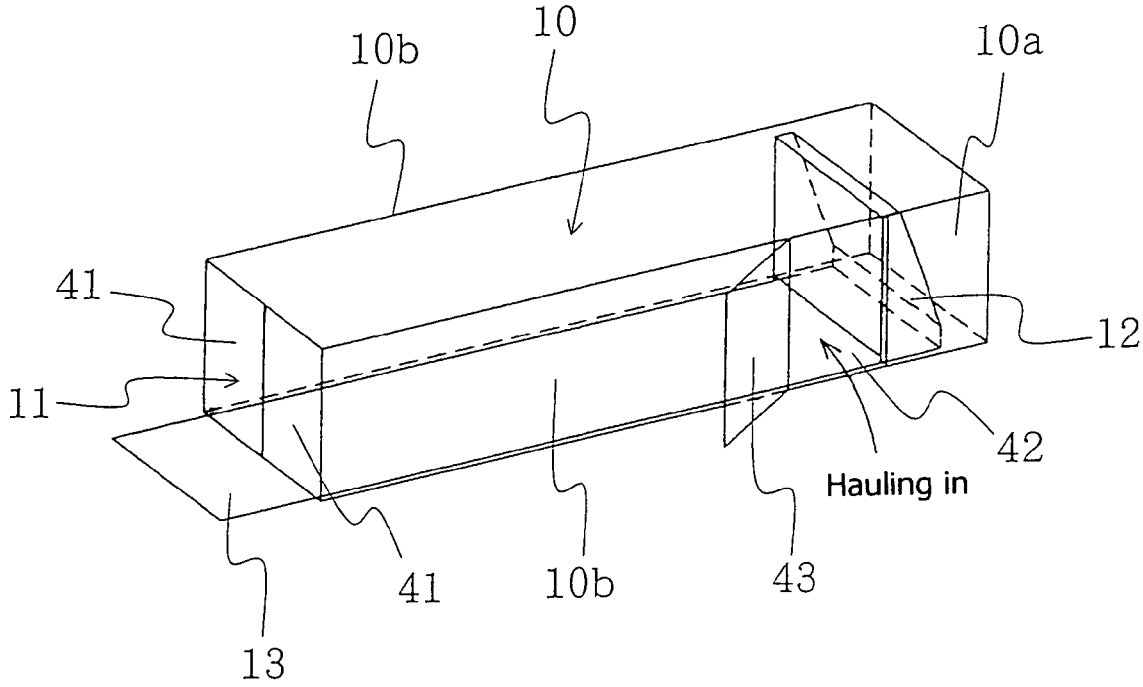
FIG. 24 is a perspective view of a cargo transportation box body with a cargo-handling device representing a tenth embodiment of the invention.

FIG. 24 represents a second variant of the embodiment where an open/closure hatch 43 covering a cargo-loading opening 42 is provided on a side of the box body 10 or on a side plate 10*b*.

Figure 25:
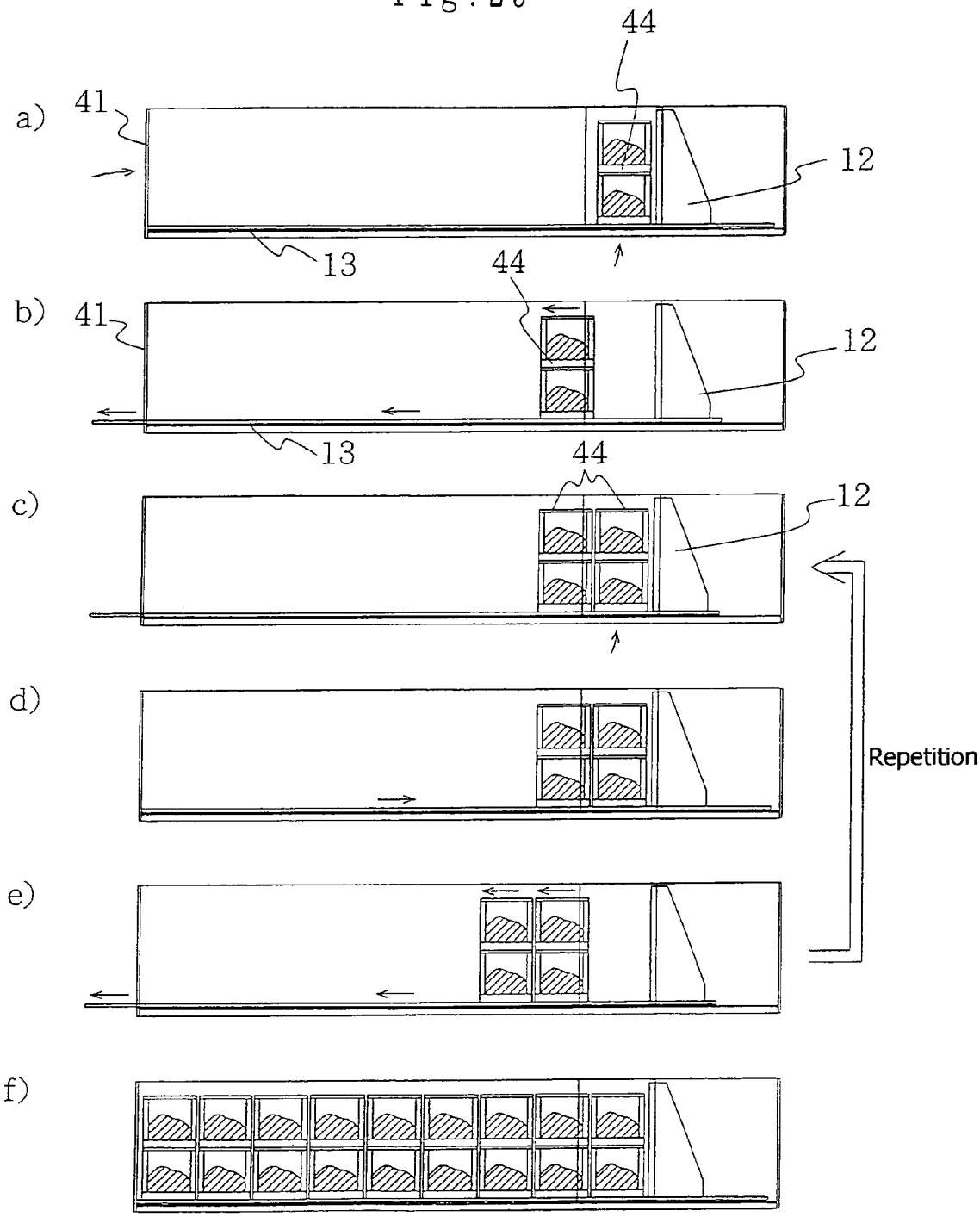
FIG. 25 illustrates the operation of the cargo transportation box body with a cargo-handling device representing the tenth embodiment of the invention.

FIG. 25 illustrates the operation of this embodiment which is the same with that of the first embodiment. In the figure, 44 represents a stack of pallets. The pallets carrying loads thereupon may be put in the box body with a forklift or the like.

Figure 26:
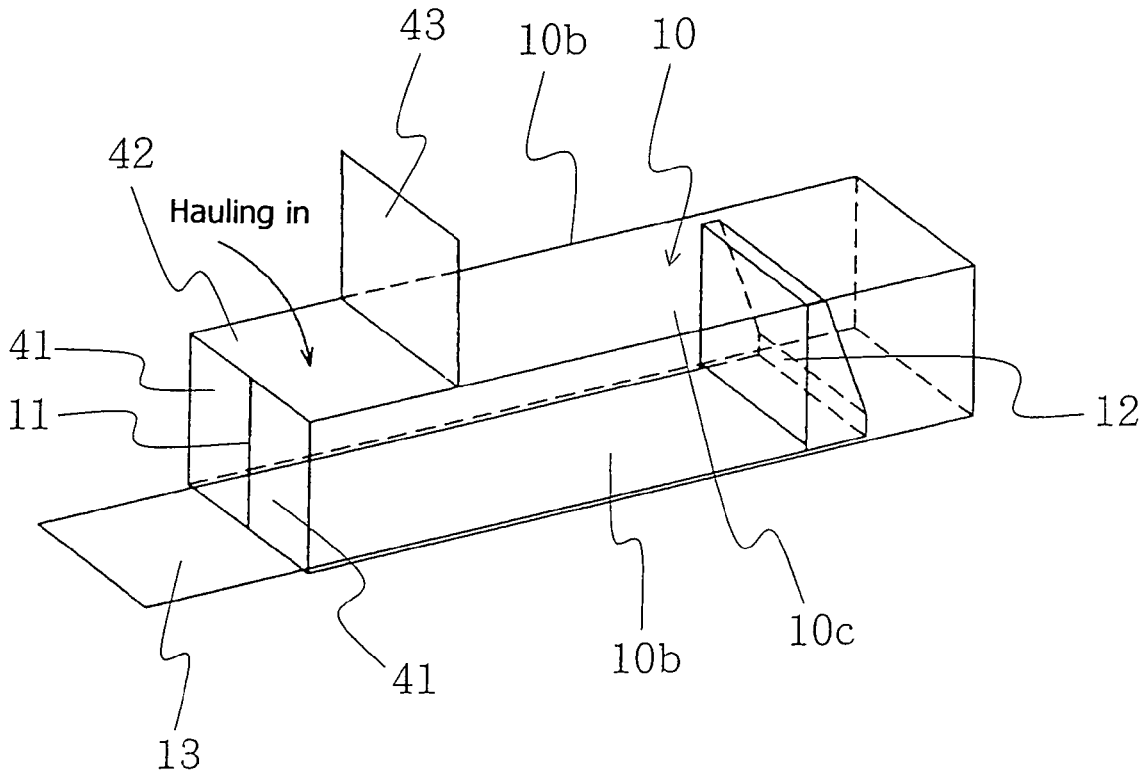
FIG. 26 is a perspective view of a cargo transportation box body with a cargo-handling device representing an eleventh embodiment of the invention.

FIG. 26 represents a third variant of the embodiment. A cargo loading opening 42 covered by an open/closure hatch 43 is provided on the roof of box body 10 adjacent to the access port 11, that is, the cargo loading opening is provided at a backward level of the box body 10.

Figure 27:
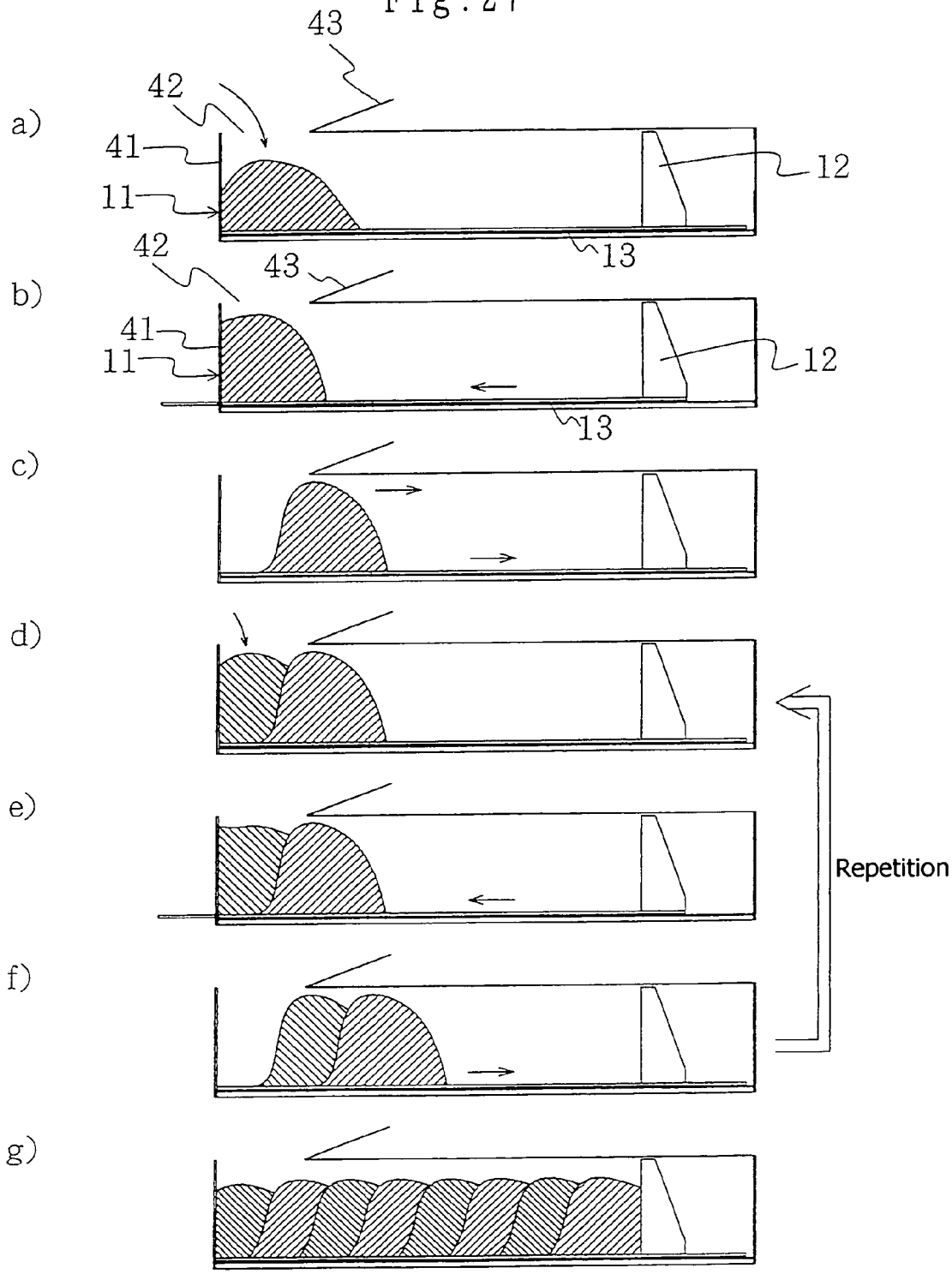
FIG. 27 illustrates the operation of the cargo transportation box body with a cargo-handling device representing the eleventh embodiment of the invention.

With this embodiment, unloading of cargo proceeds as in the first and second embodiments described above. The loading of cargo, however, takes place by using the cargo loading opening 42 as shown in FIG. 27. During this process, the doors 41 of access port 11 are kept closed, that is, the doors 41 play the same role as does the movable partition wall 12 of the first or second embodiment.

Loads rest in front of the doors 41, and even if the floor board 13 is pushed backward, it will bump against the doors 41 to be prevented from advancing further backward. If the floor board 13 is pulled forward, the floor board 13 will move forward carrying loads thereupon. Then, a blank space is generated between the forward-shifted loads and the closed doors 41, into which a new heap of loads can be hauled. This process is repeated until the box body 10 is filled with loads.

Figure 28:
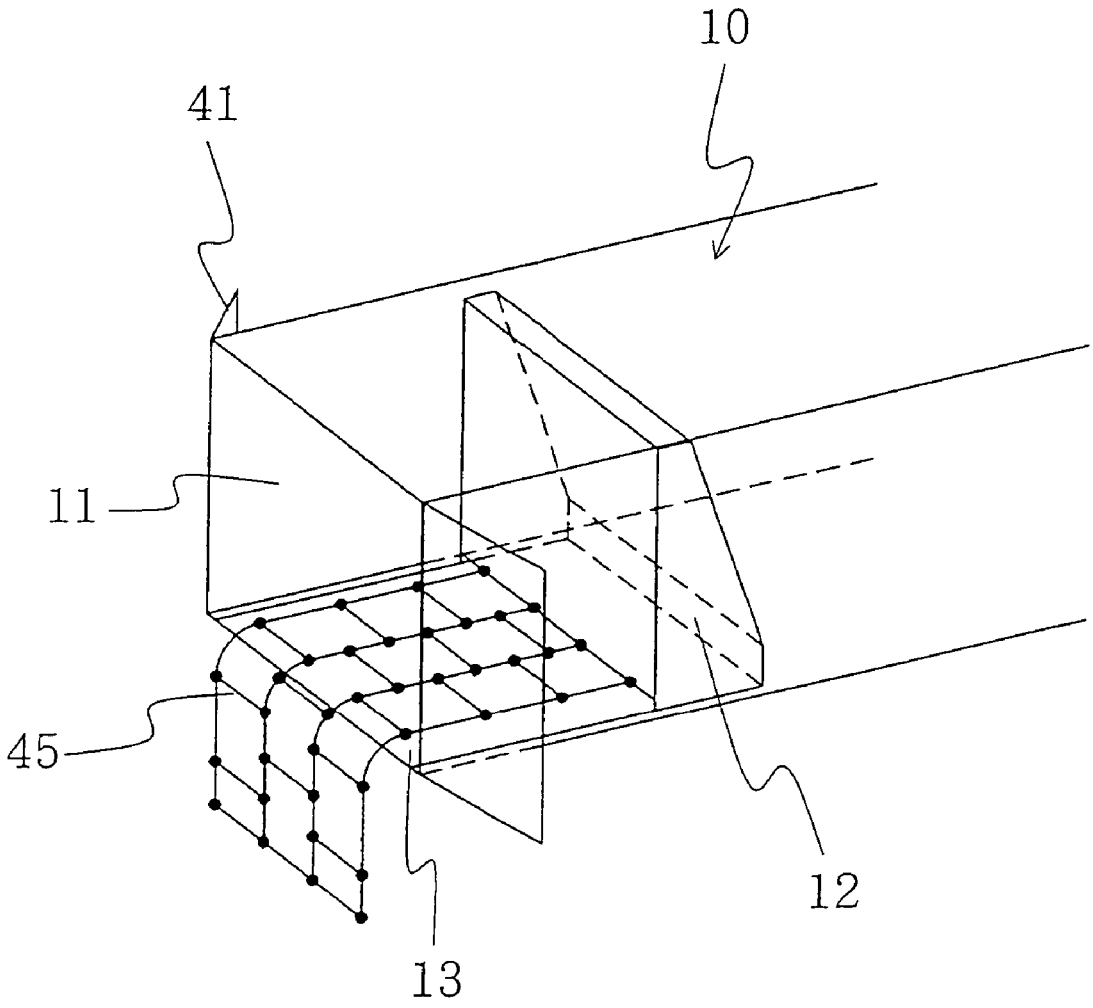
FIG. 28 is a perspective view of a cargo transportation box body with a cargo-handling device representing a twelfth embodiment of the invention.

When the floor board 13 is pushed backward, undesirably loads thereupon may be moved backward in association. To prevent this, a fourth variant shown in FIG. 28 may be employed. Upon the floor board 13 laid is a flexible mat 45 which spreads, having one end fixed on the lower edge of the movable partition wall 12, as far as the posterior end of the floor board 13.

The mat 45 is a net- or sheet-like weave made of a wire or chain, and loads are placed on the mat 45 laid over the floor board 13 during cargo loading.

The redundant end of mat 45 hanging from the posterior end of floor board 13 may be wound.

Figure 29:
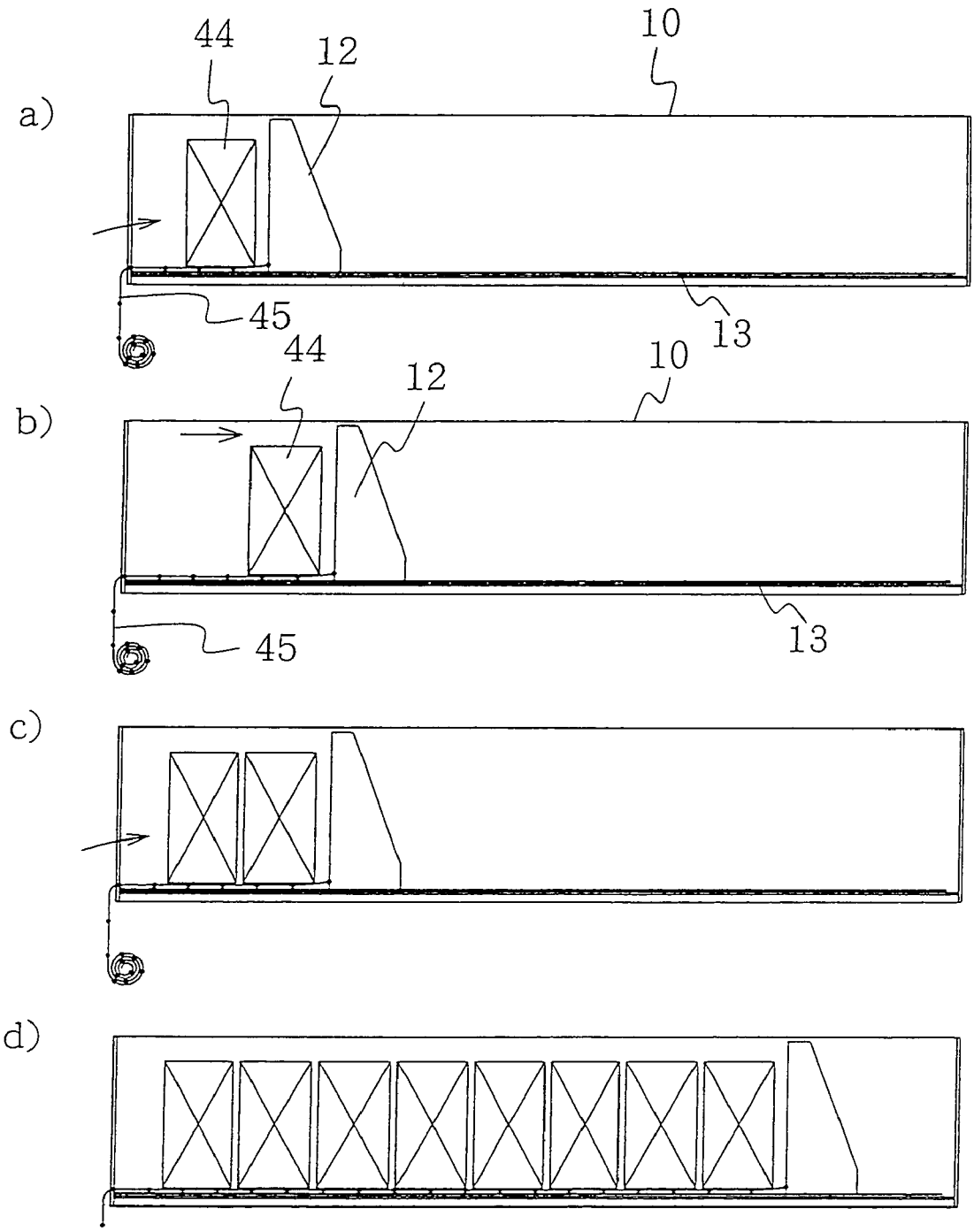
FIG. 29 illustrates the operation of the cargo transportation box body with a cargo-handling device representing the twelfth embodiment of the invention.

FIG. 29 illustrates the cargo loading occurring in the embodiment: initially the movable partition wall 12 is located close to the posterior end of floor board 13, and the movable partition wall 12 is then pulled step by step towards the anterior end 10*a* to sequentially carry loads from back forward. Since loads are placed on the mat 45, they are safely carried forward in association with the movement of the movable partition wall 12. Regardless of whether the movable partition wall 12 is unfastened or fastened, loads move forward in association with the forward movement of the floor board 13. If the movable partition wall 12 is fastened, and the floor board 13 alone is pushed backward, loads resting on the mat 45 are prevented from moving backward in association because they are held from front by the movable partition wall 12 and supported from beneath by the mat 45.

The mat 45 is so flexible that its redundant portion extending from the posterior end of floor board 13 hangs downward from that end and does not disturb the dropping of loads during cargo unloading.

Figure 30:
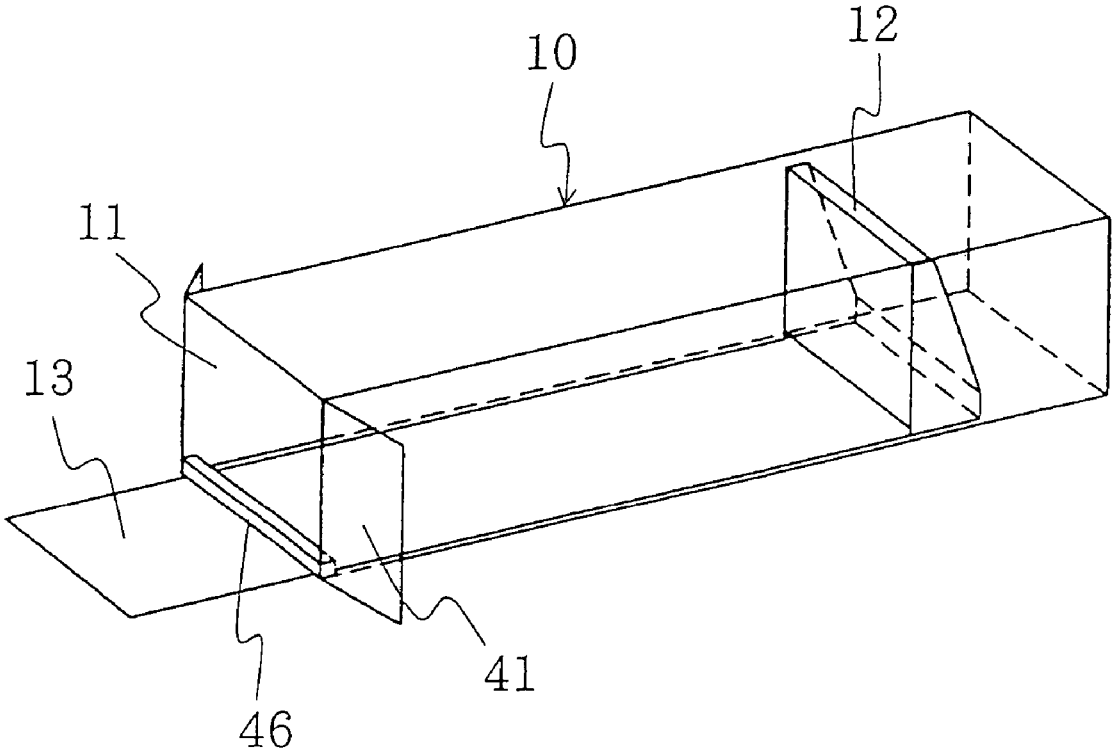
FIG. 30 is a perspective view of a cargo transportation box body with a cargo-handling device representing a thirteenth embodiment of the invention.
Figure 31:
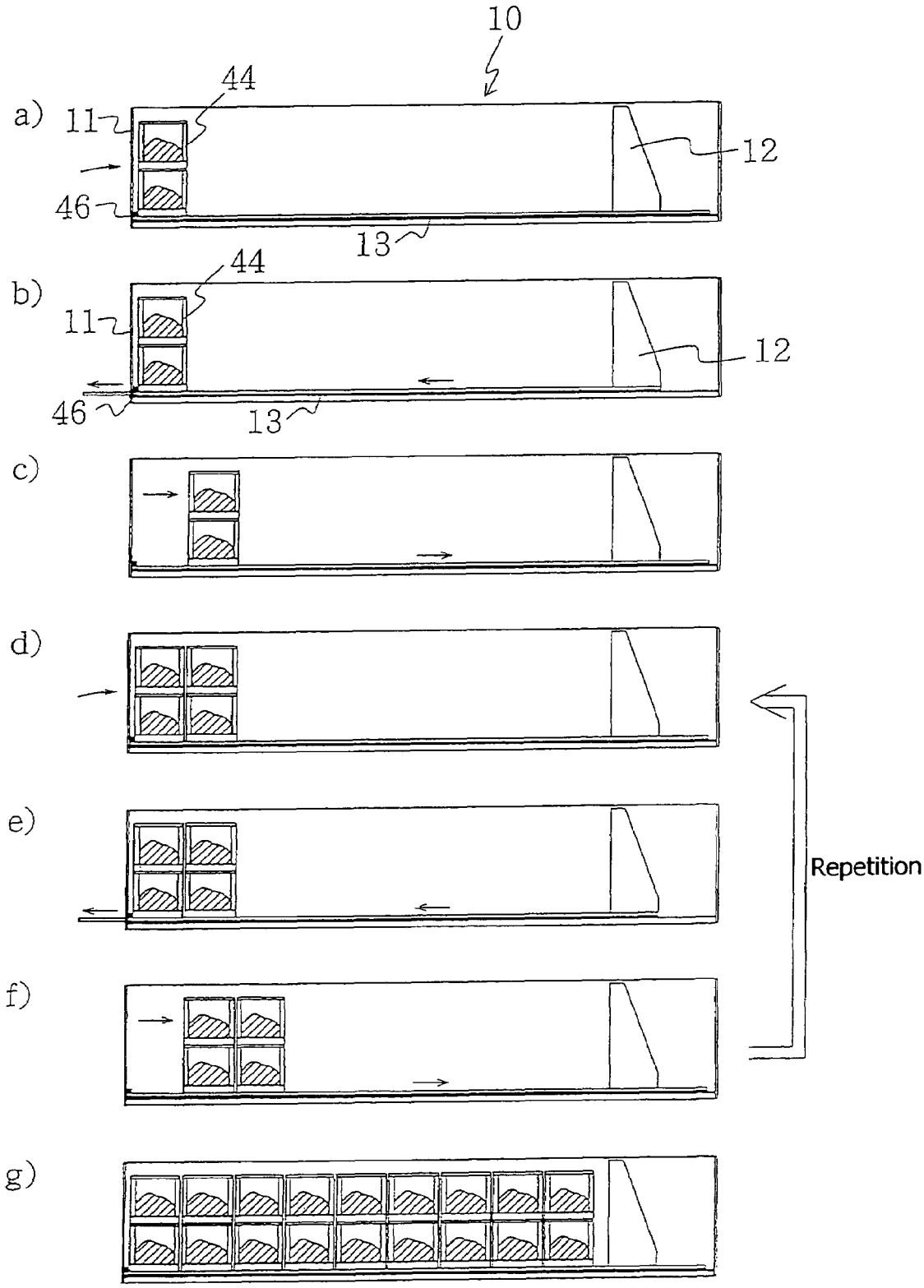
FIG. 31 illustrates the operation of the cargo transportation box body with a cargo-handling device representing the thirteenth embodiment of the invention.

FIG. 30 illustrates a fifth variant of the embodiment. The box body 10 has a single access port 11. At the lower end of access port 10 is provided a threshold 46 for preventing the backward movement of loads. The threshold 46 may be substituted by a bar or wire stretched at a lower level across the access port 11.

FIG. 30 illustrates the cargo loading occurring in the embodiment (cargo unloading occurs in the same manner as in the first to fourth variants described above): initially a heap of loads are placed just anterior to the threshold 46, and even when in the mean time the floor board 13 is pushed backward, the loads are prevented from moving backward by means of the threshold 46. Then, when the floor board 13 is pulled forward, the loads also moves forward, being carried by the floor board 13, to leave a blank space sufficiently wide for accepting a new heap of loads between it and the threshold 46. A new heap of loads are then hauled into the blank space, and this series of actions are repeated until the box body 10 is filled with loads.

Figure 32:
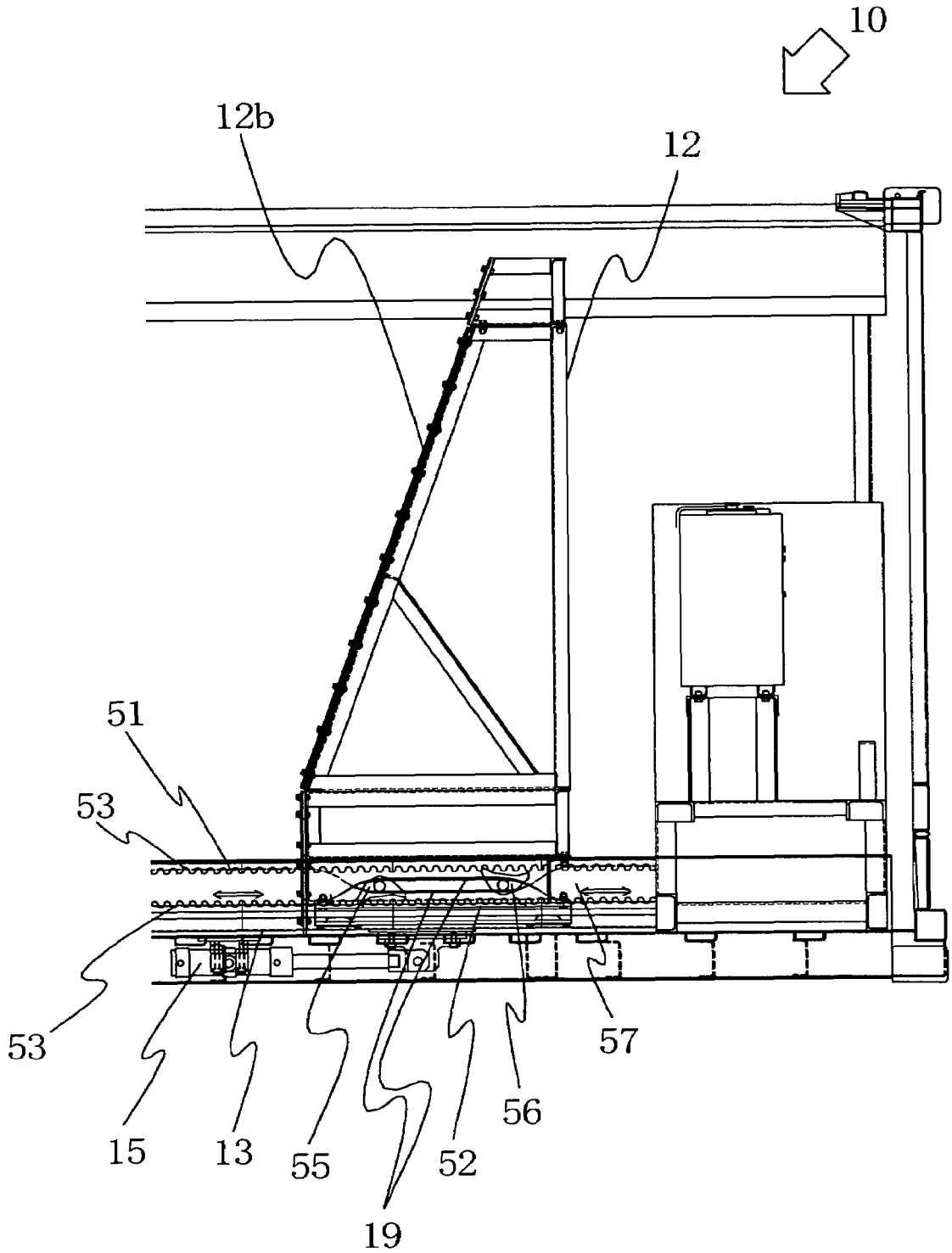
FIG. 32 is a lengthwise sectional lateral view of a cargo transportation box body with a cargo-handling device representing a fourteenth embodiment of the invention.
Figure 33:
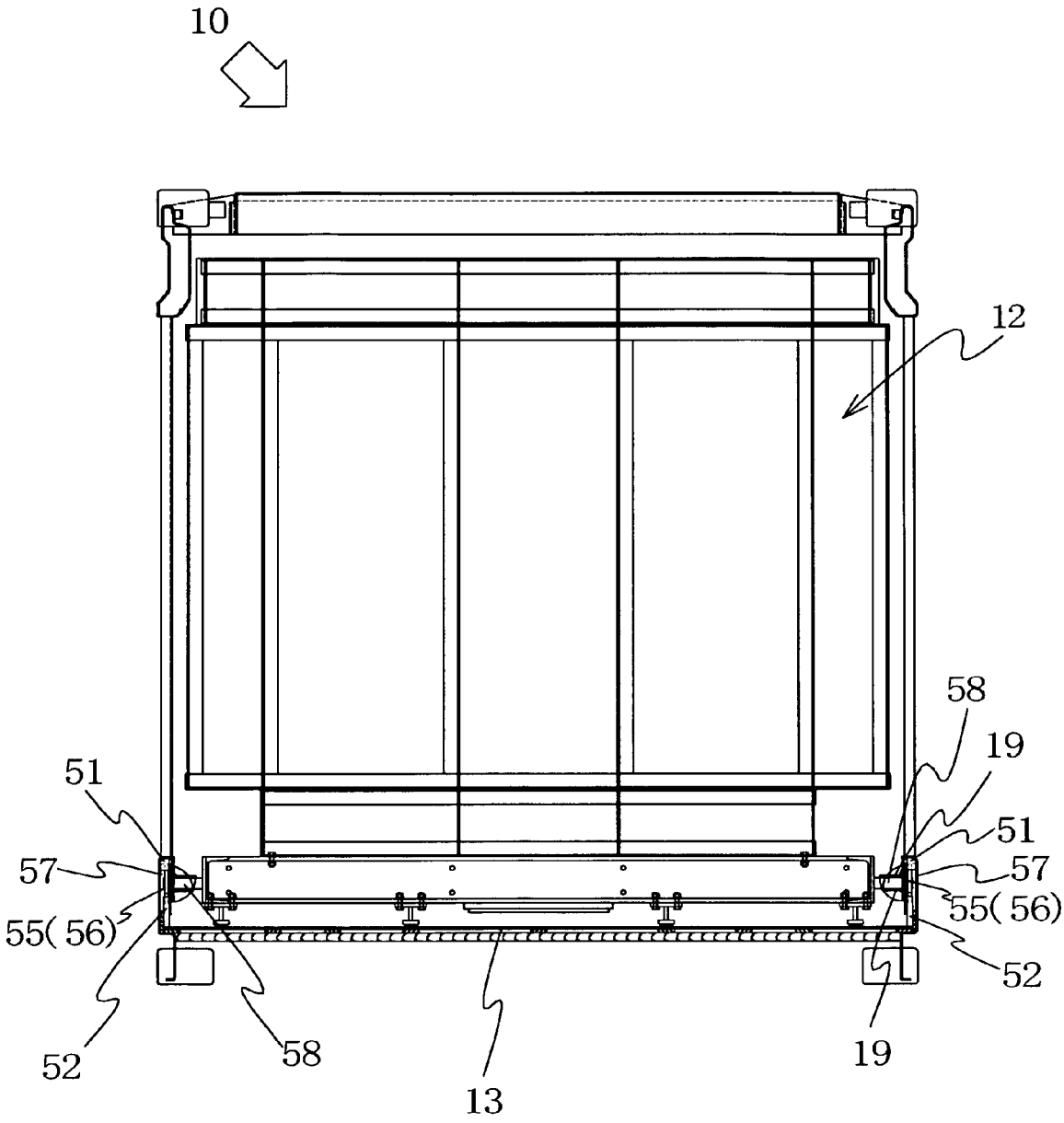
FIG. 33 is a lengthwise sectional front view of the cargo transportation box body with a cargo-handling device representing the fourteenth embodiment of the invention.
Figure 34:
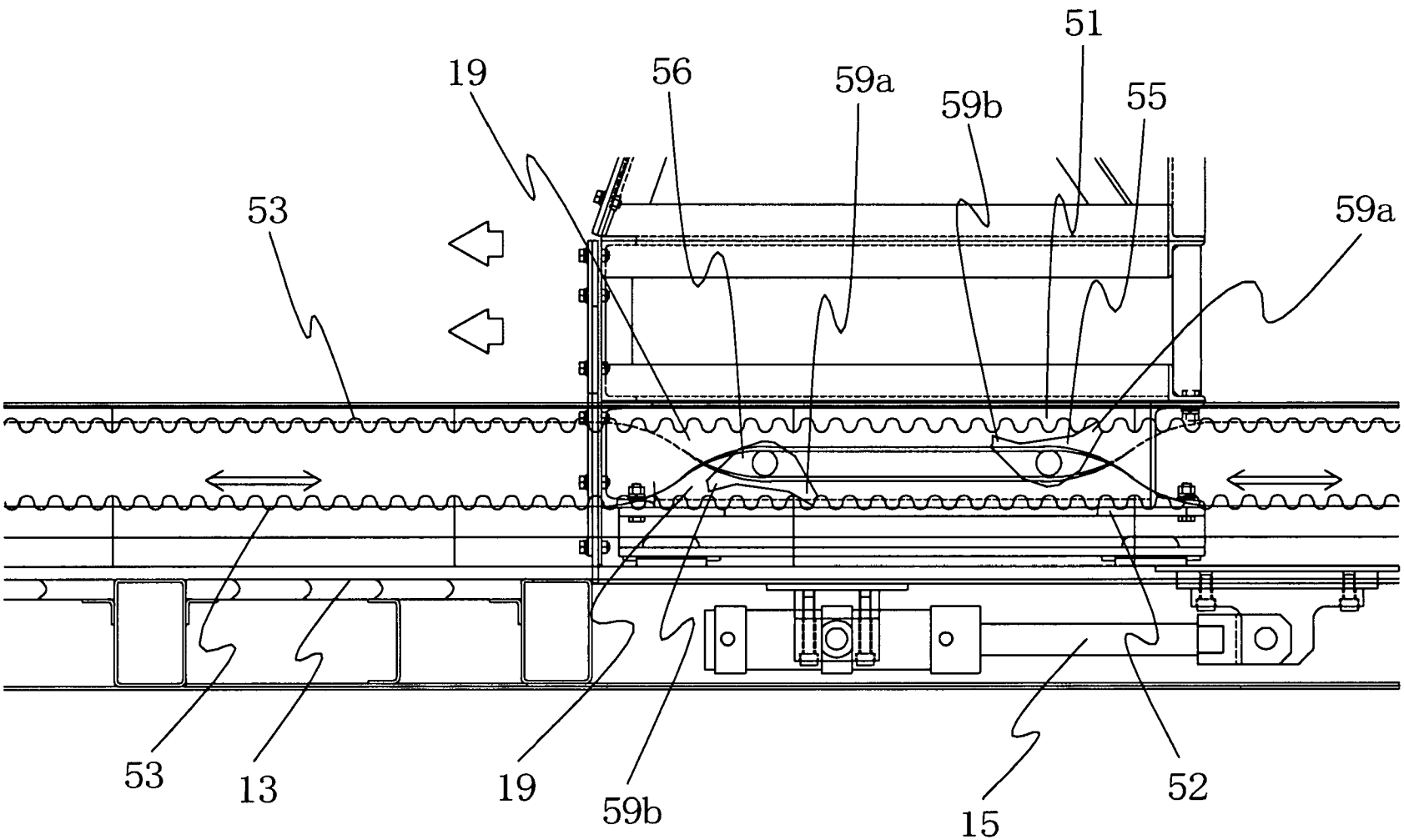
FIG. 34 is a lengthwise sectional front view of the cargo transportation box body with a cargo-handling device representing the fourteenth embodiment of the invention during cargo loading.

FIGS. 32 and 33 represents another variant where the fastening means for fastening the movable partition wall 12 to the box body 10 comprises cams engaging with racks.

An alternative fastening means for fastening the movable partition wall 12 to the box body 10 may comprise another cam-rack mechanism: on the box body 10 are provided rack rails 51 having a series of recesses 53 exhibiting a saw-tooth profile, and on the movable partition wall 12 are provided cams 55 having nails 59*a*, 59*b* each of which engages with a recess 53 formed on the rack rail 51.

Grooves 57 having a slit facing laterally are provided along both the basal lengthwise corners of the box body 10. The rack rail 51 is introduced in the groove 57 in such a manner as to allow the series of recesses to face downward.

The cam 55 is attached to an axis 8 extending laterally from the movable partition wall 12, and has the form of an isosceles triangle with the two equilateral limbs serving as nails 59*a*, 59*b* each of which engages with a recess 53 formed on the rack rail 51 in such a manner as to permit the unilateral movement of the rack rail 51. The cam 55 is attached to the axis 58, and is introduced within the groove 57.

A similar mechanism is prepared with respect to the floor body 13: rack rails 52 are provided along both the basal lengthwise corners of the floor body 13 in such a manner as to allow a series of recesses 53 to face upward. To an axis 58 extending laterally from the movable partition wall 12 is attached a cam 56 having nails 59*a*, 59*b* to rotate round the axis 58. Each of the nails 59*a*, 59*b* engages with a recess 53 formed on the rack rail 52 in such a manner as to permit the unilateral movement of the rack rail 52.

Figure 37:
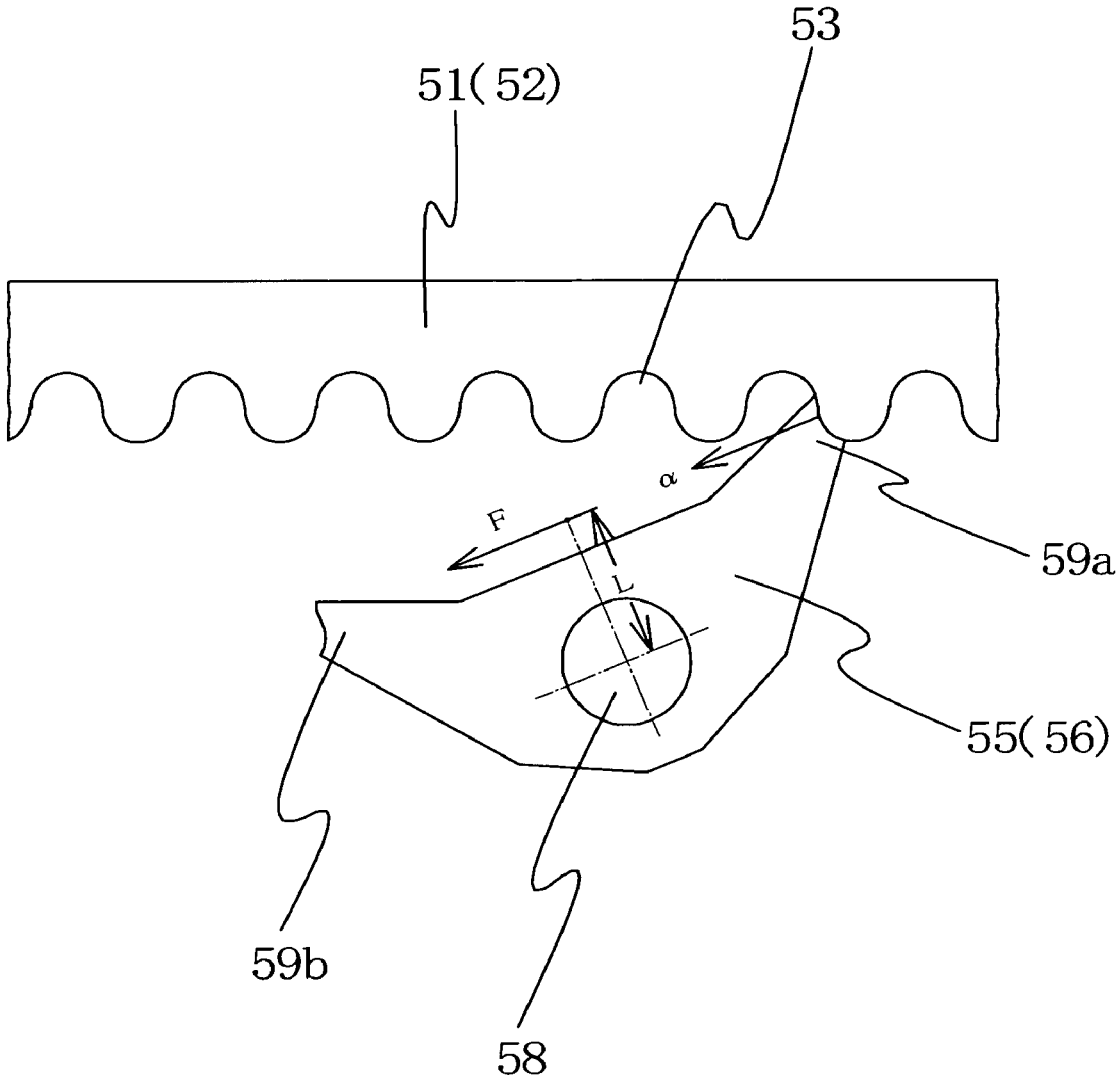
FIG. 37 illustrates how a cam works with a rack rail.
Figure 38:
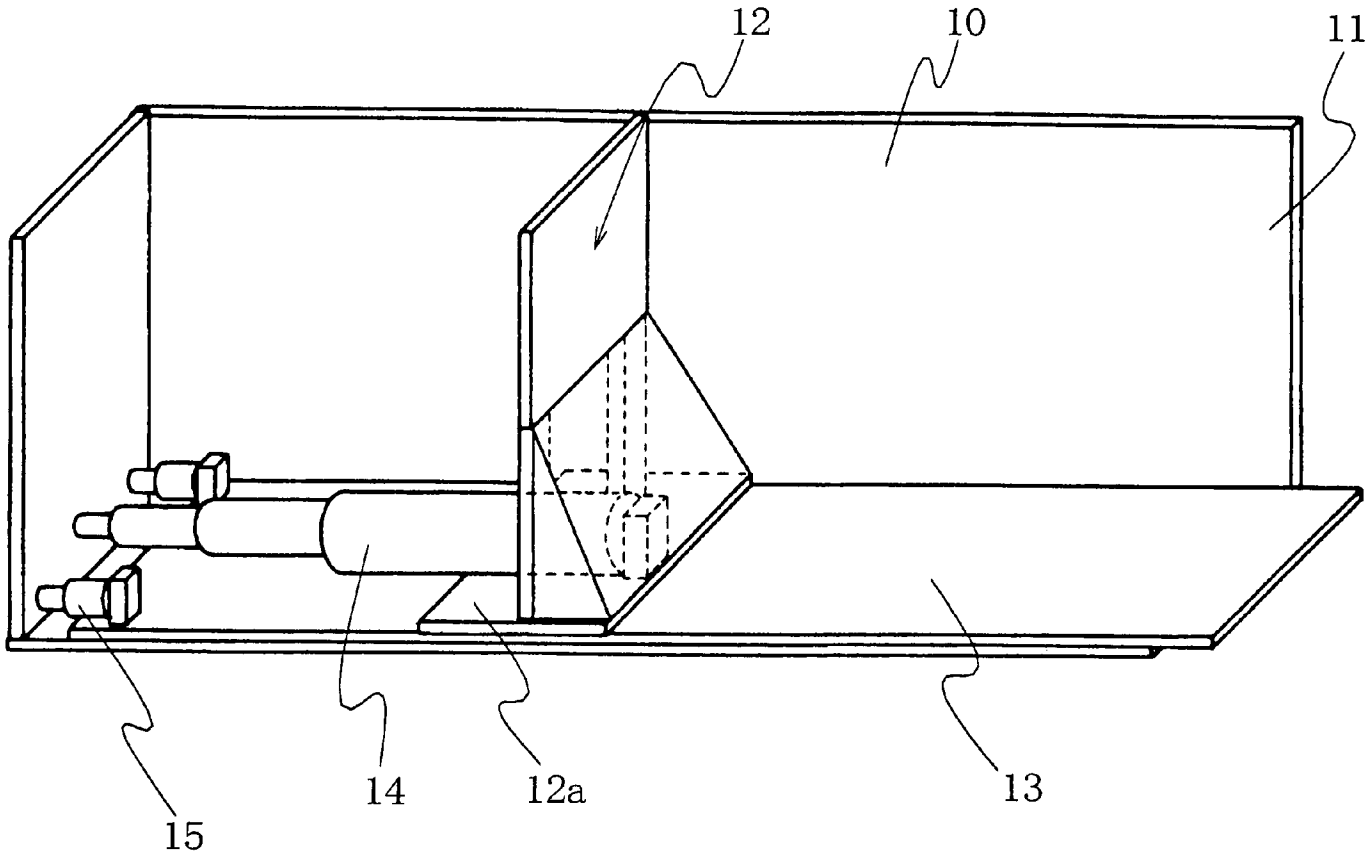
FIG. 38 is a perspective view of a conventional exemplary container.
Figure 39:
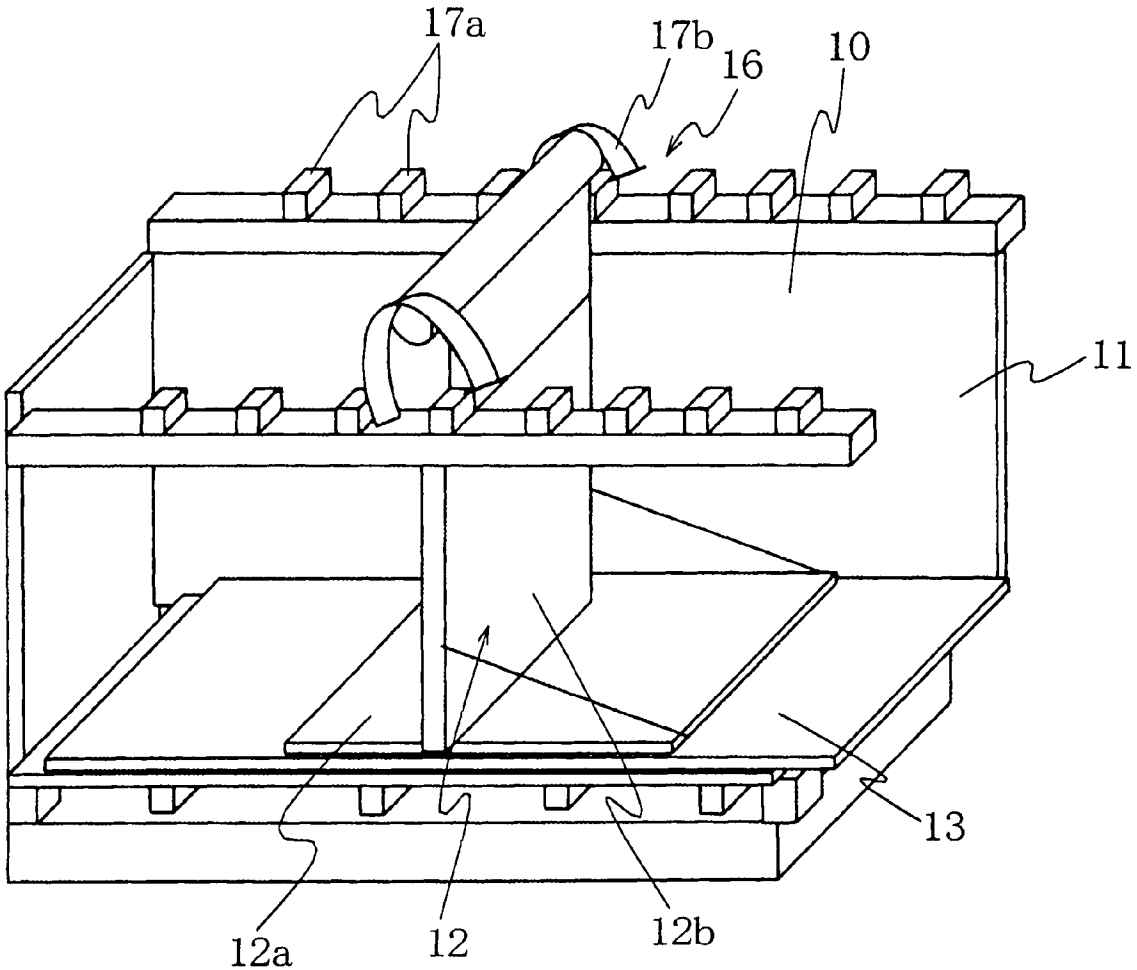
FIG. 39 is a perspective view of an alternative fastening means of the conventional container by which the movable partition wall can be stopped.

When the cam 55 or 56 engages with a tooth on the rack rail 51 or 52 and receives a force ax from the contact point as shown in FIG. 37, a rotational force F x L is transmitted to the nail 59*a* or 59*b* of cam 55 56.

The rack rail 52 is also introduced in the groove 57. Thus, the rack rails 51, 52 and cams 55, 56 are housed in the grooves 57.

Figure 35:
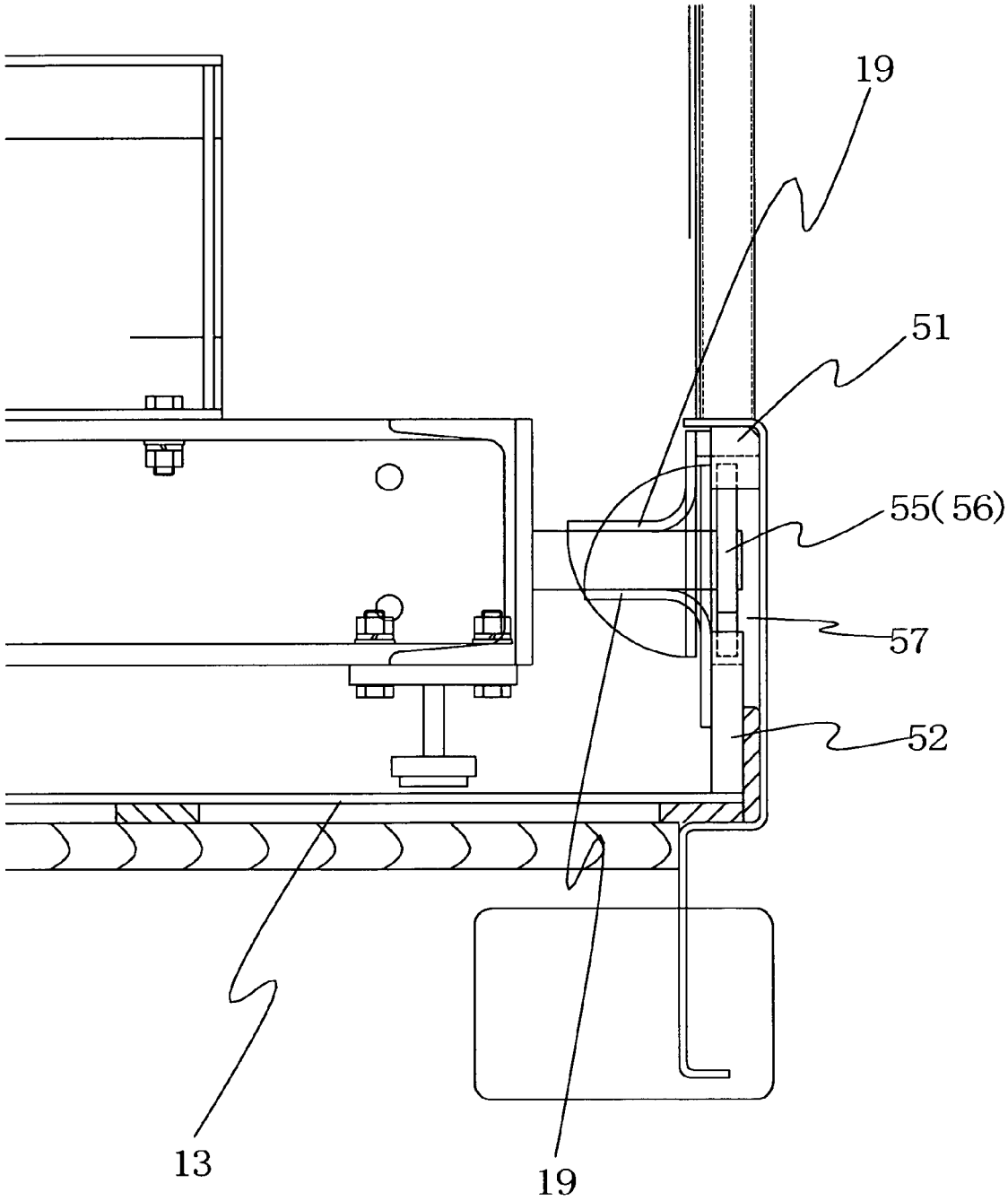
FIG. 35 is a lengthwise sectional front view of a part of interest of the cargo transportation box body with a cargo-handling device representing the fourteenth embodiment of the invention.

Elastic plate bodies 19, 19 such as rubber plates or the like are provided with respect to each groove 57 in such a manner as to close the lengthwise extending slit of the latter as shown in FIG. 35. The upper elastic plate body 19 has its upper edge fixed on the upper end of the groove 57 while the lower elastic plate body 19 has its lower edge fixed on the lower end of the groove 57 such that the lower free end of the upper plastic body 19 and the upper free end of the lower plastic body 19 overlap with each other. The aforementioned axis 58 extending on the lateral edge of the movable partition wall 12 to which the cams 55, 56 are attached passes through a narrow interstice formed between the overlapped outskirts of the two plate bodies 19, 19.

This arrangement allows the laterally facing slit of the groove 57 to be closed with the flexible plate bodies 19, 19 except at a position close to the movable partition wall 12. At that position, the axis 58 of movable partition wall 12 penetrates through a narrow interstice formed between the overlapped outskirts of the plate bodies 19, 19 by shoving the outskirts up- and downward.

Now, the operation of the embodiment will be described. Assume that an inventive box body 10 as a container is filled with cargo. The access port is opened. The movable partition wall 12 is located at a forward position of box body 10. The movable partition wall 12 is fastened to the box body 10 by inserting the nail 59*a* of cam 55 deeply into a recess 53 of the rack rail 51. At this stage, the movement of the movable partition wall 12 towards the anterior end of box body 10 (rightward in the figure) is prohibited, and only its movement towards the access port is permitted.

Likewise, the movable partition wall 12 is fastened to the floor board 13 by inserting the nail 59*a* of cam 56 deeply into a recess 53 of the rack rail 52. At this stage, the movement of the movable partition wall 12 towards the anterior end of box body 10 (rightward in the figure) is prohibited, and only its movement towards the access port is permitted.

When the cylinder 15 is allowed to extend, the floor board 13 moves from a position close to the anterior end of the box body 10 backward. Loads resting on the floor board 13 and the movable partition wall 12 also move by the same distance. During the backward movement of the movable partition wall 12, the nail 59*a* of cam 55 engages lightly with a recess 53 on the rack rail 51, escapes the engagement, moves backward to engage lightly with a next recess, escapes the engagement, moves further backward to engage lightly with a succeeding recess, and keeps on moving along the rack rail 51 while repeating this sequence of engagement and escape. Thus, the engagement of nail 59*a* of cam 55 with recesses 53 on the rack rail 51 does not fasten the movable partition wall 12 to the box body 10.

The movable partition wall 12 moves in association with the floor board 13. During the backward movement of the floor board 13, the nail 59*a* of cam 56 engages with a recess 53 on the rack rail 52, thereby fastening the movable partition wall 12 to the floor board 13. By virtue of this arrangement, the floor board 13 and the movable partition wall 12 move together with no displacements intervened with respect to the box body 10 during their backward movement which ensures the secure backward conveyance of cargo.

As a result of the backward slide of floor board 13, the rear end of floor board 13 protrudes outside from the access port carrying a heap of loads thereupon.

Next, when the cylinder 15 is contracted to pull the floor board 13 forward in the box body 10, the nail 59*a* of cam 55 engages with a recess 53 on the rack rail 51 to be fixed there, thereby fastening the movable partition wall 12 to the box body 10. Then, since loads are pressed against the movable partition wall 12 which is now immobilized, and only the floor board 13 moves forward, the heap of loads drop, losing the underlying support.

During the forward movement of the floor board 13, the nail 59*a* of cam 56 engages lightly with a recess 53 on the rack rail 52, escapes the engagement, moves backward to engage lightly with a next recess, escapes the engagement, moves further backward to engage lightly with a succeeding recess, and keeps on moving along the rack rail 52 while repeating this sequence of engagement and escape. Thus, the engagement of nail 59*a* of cam 56 with a recess 53 on the rack rail 52 does not fasten the movable partition wall 12 to the floor board 13, thereby permitting the forward movement only of the floor board 13.

Once the heap of loads are dropped, the movable partition wall 12 is fastened to the box body 10, and the cylinder 15 is extended again to push the floor board 13 backward. The process consists of following steps: (1) Pushing backward the floor board 13; (2) Fastening the movable partition wall 12 to box body 10; (3) Pulling forward the floor board 13; (4) Dropping a heap of loads; and (5) Unfastening the floor board 13. This process is repeated until all the loads packed in the box body 10 are hauled out.

Escapes the engagement, moves backward to engage lightly with a next recess, escapes the engagement, moves further backward to engage lightly with a succeeding recess, and keeps on moving along the rack rail 52 while repeating this sequence of engagement and escape. Thus, the engagement of nail 59*a* of cam 55 with a recess 53 on the rack rail 51 does not fasten the movable partition wall 12 to the box body 10.

When all the loads have been discharged from the box body, the box body should be arranged for a renewed fill. For this purpose, the movable partition wall 12 should be moved forward on the floor board 13.

Figure 36:
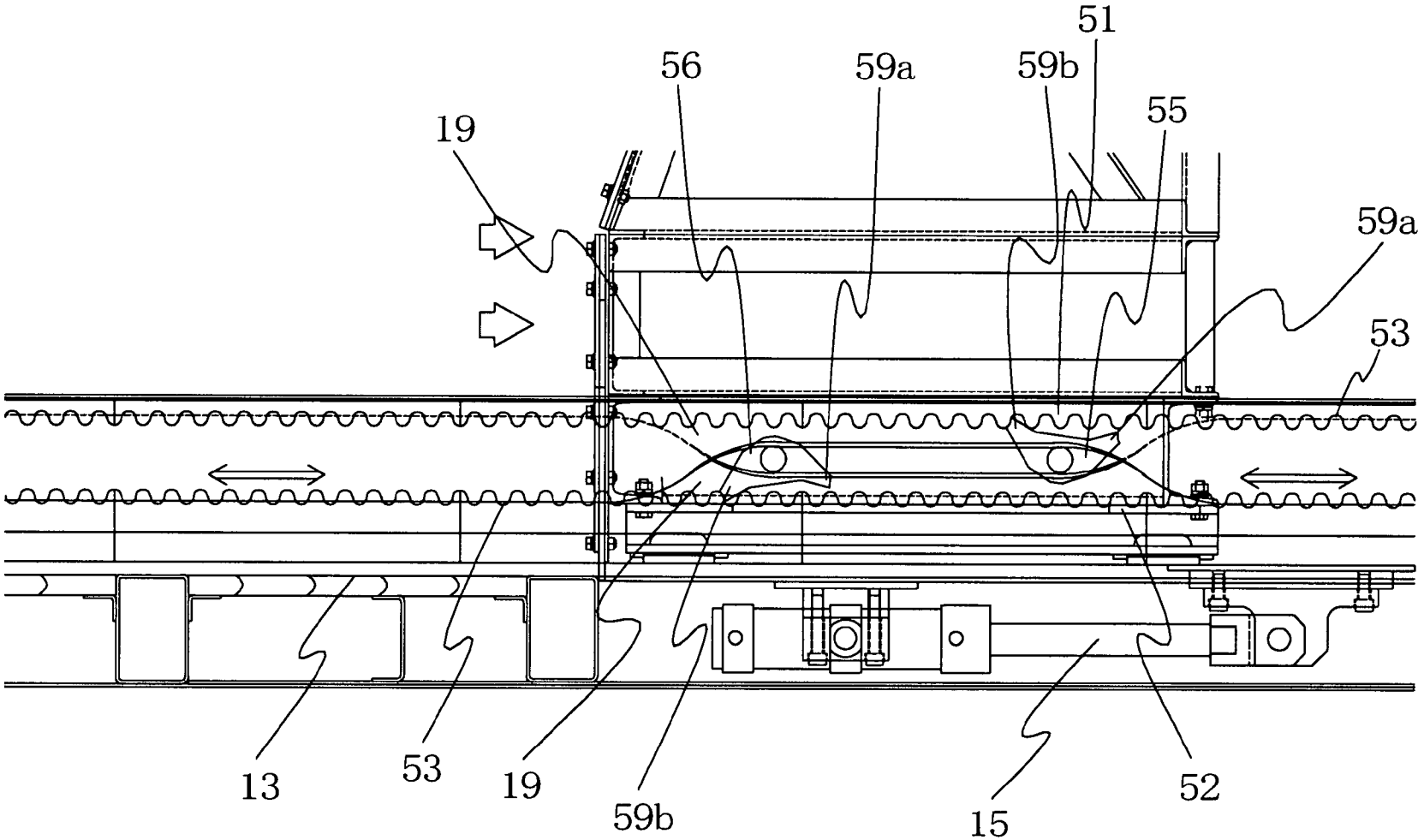
FIG. 36 is a lengthwise sectional of the cargo transportation box body with a cargo-handling device representing the fourteenth embodiment of the invention during cargo loading.

To achieve this, the engagement of cam 55 with a recess on the rack rail 51 and engagement of cam 56 with a recess on the rack rail 52 are altered to take a pattern reverse to the one previously observed during the unloading of cargo as shown in FIG. 36. The cams 55, 56 are rotated such that the nails 59*b*, 59*b* engage with recesses on the rails 51, 52.

The aforementioned manner of engagement of cam 55 with recesses on the rack rail 51 permits the forward movement of cam 55 in the box body 10 while prohibiting the backward movement of the latter.

When the cylinder 15 is allowed to extend, the floor board 13 moves from an anterior position in the box body 10 backward. Then, the nail 59*b* of cam 55 engages with a recess 53 on the rack rail 51 to be fixed there, thereby fastening the movable partition wall 12 to the box body 10 and permitting only the floor board 13 to move backward.

Next, when the cylinder 15 is contracted to pull the floor board 13 forward in the box body 10, the nail 59*b* of cam 55 engages lightly with a recess 53 on the rack rail 51, escapes the engagement, moves forward to engage lightly with a next recess, escapes the engagement, moves further forward to engage lightly with a succeeding recess, and keeps on moving along the rack rail 51 while repeating this sequence of engagement and escape. Thus, the engagement of nail 59*b* of cam 55 with recesses 53 on the rack rail 51 does not fasten the movable partition wall 12 to the box body 10, permitting the movable partition wall 12 to move by the same distance as does the floor board 13.

Then, recourse is made to the process consisting of (1) Pushing backward the floor board 13; (2) Fastening the movable partition wall 12; (3) Pulling forward the floor board 13; and (4) Unfastening the floor board 13. This process is repeated until the movable partition wall 12 moves forward to make a space in the box body 10 sufficiently wide to accept a new fill.

Charging of loads into the box body 10 may occur, in addition to the access port, from the open top of box body 10 or an opening made on its roof, if the box body 10 has an open roof or an opening on its roof.

During the loading of cargo, the movable partition wall 12 may be used as a guide of cargo loading. Namely, the movable partition wall 12 is located sufficiently close to the access port where the hinged doors and a supplementary door are closed to make a space behind the access port capable of accepting a heap of loads, and a heap of loads are hauled into the space through a top opening prepared on the roof.

In the same manner as in the unloading of cargo described above, recourse is made to the process consisting of: (1) Pulling forward the floor board 13; (2) Fastening the movable partition wall 12; (3) Pushing backward the floor board 13; (4) Moving loads forward; and (5) Unfastening the movable partition wall 12. This process is repeated to shift a new heap of loads forward to make a space sufficiently wide on the posterior end of box body 10 to accept a second heap of loads which will be hauled in there through the top opening.

Thus, it is possible to allow a heap of loads to be hauled in through the top opening and shifted forward to make anew a blank space below the opening, another heap of loads to be hauled in there, and the process to be repeated until the box body 10 becomes full of cargo.

The embodiments have been described on the premise that the box body 10 is a container. However, the box body 10 of the invention is not limited to a container but may include, for example, the cargo bed of a truck.

INDUSTRIAL APPLICABILITY

As described above, the invention provides a cargo transportation box body with a cargo-handling device for cargo unloading or loading, the box body having on its bottom a floor board movable via a cylinder in an antero-posterior direction, and a movable partition wall on the floor board such that, when the movable partition wall is latched, only the floor board is movable, and when allowed to move, the movable partition wall moves in association with the floor board, wherein whether the movable partition wall should be moved synchronously with the floor board or with a divergence relative to the latter is securely selectable, and the movable partition wall maintains a stabilized condition, being safely prevented against lateral swinging fluctuations.

According to the inventive cargo transportation box body with a cargo-handling device, it is possible to mechanize the loading and/or unloading of multiple loads which have been packed densely in the box body such as a container haphazardly with no pallets being inserted therebetween, thereby dispensing with the need for manual cargo handling which is often burdensome, and thus permitting even a mature or senior worker to handle heavy cargo safely and the improved efficiency of cargo handling.

The inventive cargo transportation box body with a cargo-handling device imposes no limitations in work place, that is, allows the operator to work at any place, and ensures the advantages characteristic with container-based transportation.

In addition, with the inventive cargo transportation box body with a cargo-handling device, the floor board is safely protected against bends since it is exclusively moved by a pulling force instead of a pushing force.

The invention claimed is:

1. A cargo transportation box body for a container or the cargo bed of a truck with a cargo-handling device for cargo unloading or loading, the box body comprising on its bottom a floor board movable via a cylinder in an antero-posterior direction, and a movable partition wall on the floor board such that, when the movable partition wall is latched, only the floor board is movable, and when the movable partition wall is not latched, the movable partition wall moves in association with the floor board, and wherein;

first and second rotary bodies are attached at on the sides of and beneath the movable partition wall so as to be one on each side, and third and fourth rotary bodies are similarly attached on the sides of the movable partition wall such that the first and third rotary bodies come into proximity on one side while the second and fourth rotary bodies come into proximity on the other side;

a mid portion of a first chain comprising a series of rings is wound around the first and fourth rotary bodies while a mid portion of a second chain comprising a series of rings is wound around the second and third rotary bodies such that the two chains are stretched between the respective two rotary bodies;

the first and second chains are stretched between the first and fourth rotary bodies and the second and third rotary bodies, respectively, and a sprocket that engages with the first and second chains is provided between the first and second chains so as to be rotatable around an axis;

the first chain with an other end thereof being fixed at a front end side and the second chain with an end thereof fixed at a front end side of the box body and another end thereof being fixed at a rear end side are stretched to cross each other so that mid portions of said chains engage with said sprocket;

a rotation arresting mechanism attached to the axis of the sprocket so that a motor, when inactivated, serves as braking mechanism for arresting a rotation of the sprocket;

one set comprising the first chain engaging with the first and fourth rotary bodies and the other set comprising the second chain engaging with the second and third rotary bodies form a stack such that, when one set engages with the sprocket, the movable partition wall is fastened to the box body and when the other set engages with the sprocket, the movable partition wall is fastened to the floor board or the floor board is fastened to the movable partition wall; and a stretch of each of the first and second chains from the fixed terminal end to the initially encountered rotary body is housed in a groove with a laterally opened slit provided over the floor board along a basal lengthwise corner of the box body.

2. The cargo transportation box body with a cargo-handling device according to claim 1 wherein the groove has its laterally opened slit closed with a hanging flexible plate body.

3. The cargo transportation box body with a cargo-handling device according to claim 1 wherein the cargo transportation box body is a container.

4. The cargo transportation box body with a cargo-handling device according to claim 1 wherein cylinder units are provided at anterior and posterior positions of the floor board, and when activated, the cylinder units move the floor board in the same direction.

5. The cargo transportation box body with a cargo-handling device according to claim 1 wherein cylinder units are provided at anterior and posterior positions of the floor board, the anterior cylinder unit moves the floor board in a direction opposite to the one wrought by the posterior cylinder unit, and only the cylinder unit to pull the floor board is activated.

6. A cargo transportation box body with a cargo-handling device according to claim 2 wherein the cargo transportation box body is a container.

* * * * *